US005629116A

United States Patent [19]

Kashizaki et al.

[11] Patent Number: 5,629,116

[45] Date of Patent: May 13, 1997

[54] ELECTROPHOTOGRAPHIC PHOTOSENSITIVE MEMBER, PROCESS CARTRIDGE AND ELECTROPHOTOGRAPHIC APPARATUS HAVING THE ELECTROPHOTOGRAPHIC PHOTOSENSITIVE MEMBER

[75] Inventors: Yoshio Kashizaki, Yokohama; Akihiro Senoo, Tokyo; Masato Tanaka, Kawasaki, all of Japan

[73] Assignee: Canon Kabushiki Kaisha, Tokyo, Japan

[21] Appl. No.: 399,044

[22] Filed: Mar. 6, 1995

[30] Foreign Application Priority Data

Mar. 7, 1994 [JP] Japan ..... 6-059820
Mar. 7, 1994 [JP] Japan ..... 6-059821

[51] Int. Cl.[6] ..... G03G 5/047; G03G 5/06; G03G 15/00

[52] U.S. Cl. ..... 430/58; 430/70; 430/75; 430/76; 430/78; 430/83; 358/302; 399/159

[58] Field of Search ..... 430/70, 75, 76, 430/78, 58, 83

[56] References Cited

U.S. PATENT DOCUMENTS

| | | | |
|---|---|---|---|
| 4,895,781 | 1/1990 | Takai | 430/76 |
| 4,939,053 | 7/1990 | Ueda | 430/76 |
| 4,988,593 | 1/1991 | Takai | 430/70 |
| 5,229,237 | 7/1993 | Kawamorita et al. | 430/78 |
| 5,281,503 | 1/1994 | Law et al. | 430/78 |

FOREIGN PATENT DOCUMENTS

| | | |
|---|---|---|
| 3545468 | 7/1986 | Germany . |
| 60-46561 | 3/1985 | Japan . |
| 60-131539 | 7/1985 | Japan . |
| 62-295062 | 12/1987 | Japan . |
| 1-252966 | 10/1989 | Japan . |
| 4-96068 | 3/1992 | Japan . |

OTHER PUBLICATIONS

Patent Abstracts, Japan, vol. 16, No. 286 (P-1376) 1992.
Patent Abstracts, Japan, vol. 13, No. 222 (P-876) [3570] 1989.
Patent Abstracts, Japan, vol. 6, No. 221, (P-153) [1099] 1982.

*Primary Examiner*—Roland Martin
*Attorney, Agent, or Firm*—Fitzpatrick, Cella, Harper & Scinto

[57] ABSTRACT

An electrophotographic photosensitive member and a process cartridge and an electrophotographic apparatus. The process cartridge and the electrophotographic apparatus both contain the electrophotographic photosensitive member. The electrophotographic photosensitive member constitutes a conductive substrate and a photosensitive layer on the substrate. The photosensitive layer contains an azo pigment of formula (1), formula (2), formula (3), formula (4) or formula (5), as shown below:

(1)

(2)

(3)

(4)

(5)

39 Claims, 1 Drawing Sheet

ELECTROPHOTOGRAPHIC PHOTOSENSITIVE MEMBER, PROCESS CARTRIDGE AND ELECTROPHOTOGRAPHIC APPARATUS HAVING THE ELECTROPHOTOGRAPHIC PHOTOSENSITIVE MEMBER

BACKGROUND OF THE INVENTION

1. Field of the Invention

The present invention relates to an electrophotographic photosensitive member, and more particularly to an electrophotographic photosensitive member comprising a photosensitive layer containing an azo pigment having a specific structure, and to a process cartridge and an electrophotographic apparatus having the electrophotographic photosensitive member.

2. Related Background Art

Electrophotographic photosensitive members having organic photoconductive materials exhibit advantages in that their productivity is satisfactory, their cost can be reduced relatively and their color sensitivity can desirably be controlled by adequately selecting the pigment or dye used. Therefore, various studies of such electrophotographic photosensitive members has been carried out. In particular, an electrophotographic photosensitive member having a function-separated-type photosensitive layer has been developed in order that poor sensitivity and unsatisfactory durability as have been experienced with the conventional organic electrophotographic photosensitive member can be overcome. The foregoing function-separated-type photosensitive member has a charge generating layer which contains charge generating materials, such as an organic photoconductive pigment and dye, and a charge transporting layer which contains charge transporting materials, such as photoconductive polymers and low-molecular weight organic photoconductive materials.

Among the organic photoconductive materials, the azo pigments exhibit excellent photoconductivity and various kinds of these materials can be relatively easily obtained by combining amine components and coupler components. Therefore, various azo pigments have been disclosed, for example, in Japanese Patent Laid-Open No. 60-46561, Japanese Patent Laid-Open No. 60-131539, Japanese Patent Laid-Open No. 62-295062, Japanese Patent Laid-Open No. 1-252966 and Japanese Patent Laid-Open No. 4-96068.

In recent years, however, there have been demands for higher image quality and superior durability. To meet these demands, electrophotographic photosensitive members having higher sensitivity and superior electrophotographic characteristics, even after repeated use, have been desired.

SUMMARY OF THE INVENTION

Accordingly, an object of the present invention is to provide an electrophotographic photosensitive member having excellent sensitivity.

Another object of the present invention is to provide an electrophotographic photosensitive member exhibiting stable and excellent potential characteristics even after repeated use.

Another object of the present invention is to provide a process cartridge and an electrophotographic apparatus having the foregoing electrophotographic photosensitive member.

According to one aspect of the present invention, there is provided an electrophotographic photosensitive member, comprising a conductive substrate and a photosensitive layer on said conductive substrate, said photosensitive layer containing an azo pigment represented by at least one formula selected from the group consisting of formulas (1), (2), (3), (4) and (5) below:

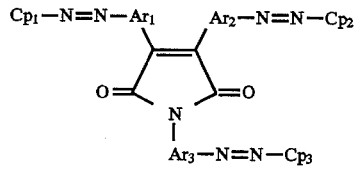

(1)

wherein $Ar_1$, $Ar_2$ and $Ar_3$ are the same or different and are each a substituted or unsubstituted aromatic hydrocarbon ring or a substituted or unsubstituted aromatic heterocyclic ring, and $Cp_1$, $Cp_2$ and $Cp_3$ are the same or different and are each a coupler residual group having a phenolic hydroxyl group.

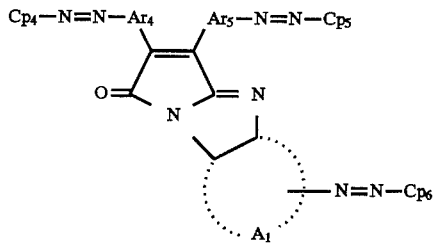

(2)

wherein $Ar_4$ and $Ar_5$ are the same or different and are each a substituted or unsubstituted aromatic hydrocarbon ring or a substituted or unsubstituted aromatic heterocyclic ring, $A_1$ is a residual group required to form a substituted or unsubstituted aromatic hydrocarbon ring or a substituted or unsubstituted aromatic heterocyclic ring with the carbon atoms in the formula above, and $Cp_4$, $Cp_5$ and $Cp_6$ are the same or different and are each a coupler residual group having a phenolic hydroxyl group.

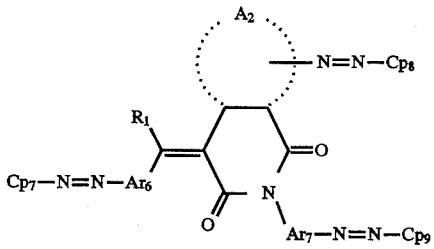

(3)

wherein $R_1$ is a hydrogen atom, a substituted or unsubstituted alkyl group or a cyano group, $Ar_6$ and $Ar_7$ are the same or different and are each a substituted or unsubstituted aromatic hydrocarbon ring or a substituted or unsubstituted aromatic heterocyclic ring, $A_2$ is a residual group required to form a substituted or unsubstituted aromatic hydrocarbon ring or a substituted or unsubstituted aromatic heterocyclic ring with the carbon atoms in the formula above, and $Cp_7$, $Cp_8$ and $Cp_9$ are the same or different and are each a coupler residual group having a phenolic hydroxyl group.

(4)

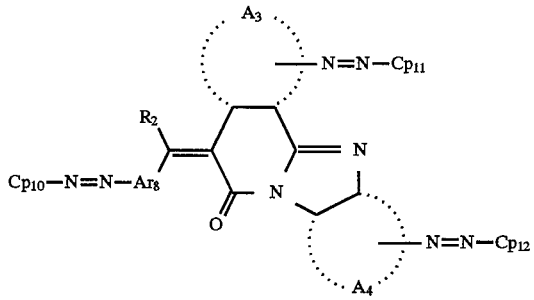

wherein $R_2$ is a hydrogen atom, a substituted or unsubstituted alkyl group or a cyano group, $Ar_8$ is the same or different and is a substituted or unsubstituted aromatic hydrocarbon ring or a substituted or unsubstituted aromatic heterocyclic ring, $A_3$ and $A_4$ are the same or different and are each a residual group required to form a substituted or unsubstituted aromatic hydrocarbon ring or a substituted or unsubstituted aromatic heterocyclic ring with the carbon atoms in the formula above, and $Cp_{10}$, $Cp_{11}$ and $Cp_{12}$ are the same or different and are each a coupler residual group having a phenolic hydroxyl group.

(5)

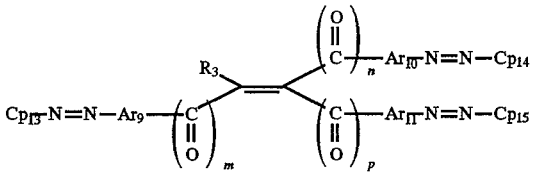

wherein $R_3$ is a hydrogen atom, a substituted or unsubstituted alkyl group or a cyano group, $Ar_9$, $Ar_{10}$ and $Ar_{11}$ are the same or different and are each a substituted or unsubstituted aromatic hydrocarbon ring or a substituted or unsubstituted aromatic heterocyclic ring, $Cp_{13}$, $Cp_{14}$ and $Cp_{15}$ are the same or different and are each a coupler residual group having a phenolic hydroxyl group, and m, n and p are the same or different and are each zero or a positive integer wherein m, n and p are not simultaneously zero.

According to a further aspect of the present invention, a process cartridge comprises an electrophotographic photosensitive member as described above, and at least one means selected from the group consisting of a charging means, a developing means and a cleaning means.

According to yet another aspect of the present invention, an electrophotographic apparatus comprises an electrophotographic photosensitive member as described above, charging means, image exposing means, developing means and transfer means.

Other objects, and features and advantages of the invention will be evident from the following detailed description of the preferred embodiments in conjunction with the attached drawings.

DETAILED DESCRIPTION OF THE INVENTION

Figure 1:
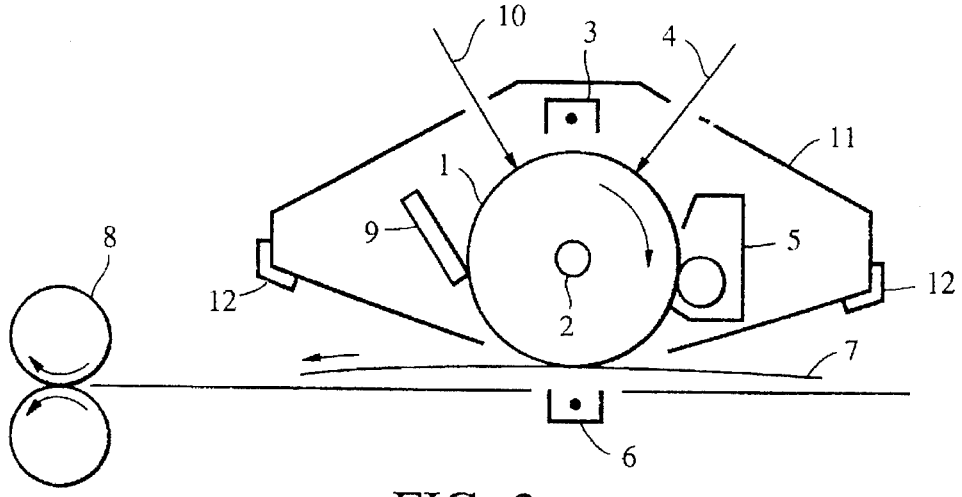
FIG. 1 illustrates an example of a schematic structure of an electrophotographic apparatus having a process cartridge having an electrophotographic photosensitive member according to the present invention.

An electrophotographic photosensitive member according to the present invention has a photosensitive layer containing an azo pigment represented by at least one formula selected from the group consisting of the formulas (1), (2), (3), (4) and (5) below:

(1)

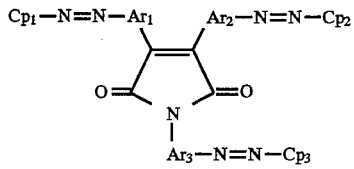

wherein $Ar_1$, $Ar_2$ and $Ar_3$ are the same or different and are each a substituted or unsubstituted aromatic hydrocarbon ring or a substituted or unsubstituted aromatic heterocyclic ring, and $Cp_1$, $Cp_2$ and $Cp_3$ are the same or different and are each a coupler residual group having a phenolic hydroxyl group.

(2)

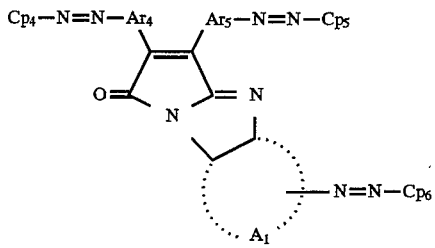

wherein $Ar_4$ and $Ar_5$ are the same or different and are each a substituted or unsubstituted aromatic hydrocarbon ring or a substituted or unsubstituted aromatic heterocyclic ring, $A_1$ is a residual group required to form a substituted or unsubstituted aromatic hydrocarbon ring or a substituted or unsubstituted aromatic heterocyclic ring with the carbon atoms in the formula above, and $Cp_4$, $Cp_5$ and $Cp_6$ are the same or different and are each a coupler residual group having a phenolic hydroxyl group.

(3)

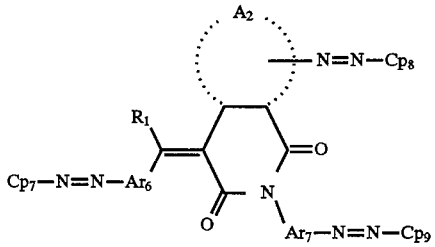

wherein $R_1$ is a hydrogen atom, a substituted or unsubstituted alkyl group or a cyano group, $Ar_6$ and $Ar_7$ are the same or different and are each a substituted or unsubstituted aromatic hydrocarbon ring or a substituted or unsubstituted aromatic heterocyclic ring, $A_2$ is a residual group required to form a substituted or unsubstituted aromatic hydrocarbon ring or a substituted or unsubstituted aromatic heterocyclic ring with the carbon atoms in the formula above, and $Cp_7$, $Cp_8$ and $Cp_9$ are the same or different and are each a coupler residual group having a phenolic hydroxyl group.

(4)

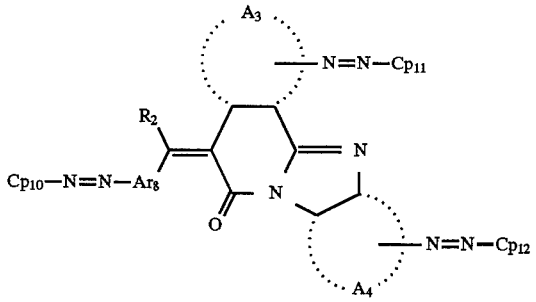

wherein $R_2$ is a hydrogen atom, a substituted or unsubstituted alkyl group or a cyano group, $Ar_8$ is the same or different and is a substituted or unsubstituted aromatic hydrocarbon ring or a substituted or unsubstituted aromatic heterocyclic ring, $A_3$ and $A_4$ are the same or different and are each a residual group required to form a substituted or unsubstituted aromatic hydrocarbon ring or a substituted or unsubstituted aromatic heterocyclic ring with the carbon atoms in the formula above, and $Cp_{10}$, $Cp_{11}$ and $Cp_{12}$ are the same or different and are each a coupler residual group having a phenolic hydroxyl group.

(5)

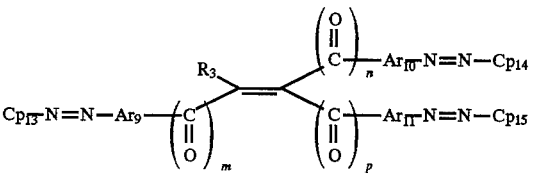

wherein $R_3$ is a hydrogen atom, a substituted or unsubstituted alkyl group or a cyano group, $Ar_9$, $Ar_{10}$ and $Ar_{11}$ are the same or different and are each a substituted or unsubstituted aromatic hydrocarbon ring or a substituted or unsubstituted aromatic heterocyclic ring, $Cp_{13}$, $Cp_{14}$ and $Cp_{15}$ are the same or different and are each a coupler residual group having a phenolic hydroxyl group, and m, n and p are the same or different and are each zero or a positive integer wherein m, n and p are not simultaneously zero.

In each of the foregoing formulas (1) to (5), $Ar_1$ to $Ar_{11}$ are the same or different and are each a substituted or unsubstituted aromatic hydrocarbon ring or a substituted or unsubstituted aromatic heterocyclic ring. The aromatic hydrocarbon ring is exemplified by a benzene ring and a naphthalene ring. The aromatic heterocyclic ring is exemplified by a pyridine ring and a thiophene ring. $Ar_1$ to $Ar_{11}$ may have substituents exemplified by alkyl groups, such as methyl, ethyl and propyl groups; alkoxy groups, such as methoxy, ethoxy and propoxy groups; halogen atoms, such as fluorine, chlorine, bromine and iodine atoms; and halomethyl groups, such as cyano groups and trifluoromethyl groups. It is preferable for the present invention that $Ar_1$ to $Ar_6$ and $Ar_8$ to $Ar_{11}$ be benzene rings, and $Ar_7$ be a naphthalene ring or a pyridine ring.

In the formulas (1) to (5), $Cp_1$ to $Cp_{15}$ are the same or different coupler residual groups each having a phenolic hydroxyl group. The coupler residual group is a group corresponding to a portion of a coupler bonded to an azo group due to a coupling reaction between the azo components and the coupler taking place at the time of obtaining the azo pigment. It is preferable that the coupler residual group be bonded at the ortho position with respect to the phenolic hydroxyl group. $A_1$ and $A_2$ may be any coupler residual group that has a phenolic hydroxyl group and it is preferable that they are the coupler residual groups represented by the following formulas (6) to (11):

(6)

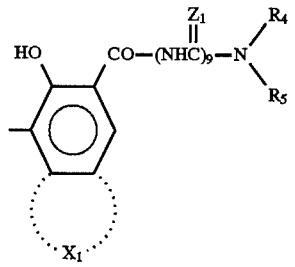

(7)

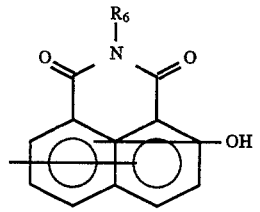

(8)

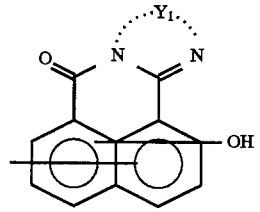

(9)

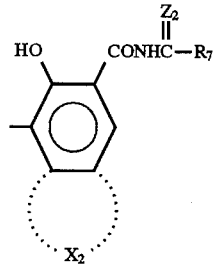

(10)

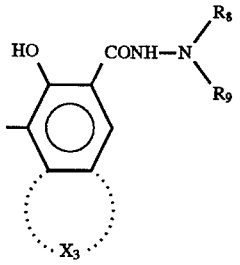

(11)

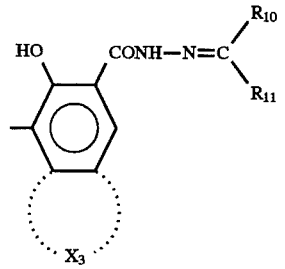

$X_1$ to $X_4$ in the formulas (6), (9), (10) and (11) are residual groups each of which is required to form a polycyclic aromatic hydrocarbon ring, such as a naphthalene ring or an anthracene ring, or a heterocyclic ring such as a carbazole ring, a benzocarbazole ring or a dibenzocarbazole ring by condensing with the benzene ring.

$Y_1$ in the formula (8) is an arylene group or a bivalent heterocyclic group containing a nitrogen atom. Specifically, it is exemplified by an o-phenylene, o-naphthylene, perinaphthylene, 1,2-anthrylene, 3,4-pyrazolediyl, 2,3-pyridinediyl, 4,5-pyridinediyl, 6,7-indazolediyl and 6,7-quinolinediyl group.

$R_4$, $R_5$, $R_8$ and $R_9$ in the formulas (6) and (10) are each hydrogen atoms, alkyl groups, aryl groups, aralkyl groups or heterocyclic ring groups. $R_4$ and $R_5$, and $R_8$ and $R_9$ are residual groups which are respectively bonded to each other to form a cyclic amino group.

$R_6$ in the formula (7) is an alkyl group, an aryl group, an aralkyl group or a heterocyclic ring group.

$R_7$ in the formula (9) is a hydrogen atom, an alkyl group, an aryl group, an aralkyl group or a heterocyclic ring group.

$R_{10}$ and $R_{11}$ in the formula (11) are each a hydrogen atom, an alkyl group, an aryl group, an aralkyl group, a heterocyclic group and a residual group to form a cyclic group by bonding each other.

The foregoing alkyl group is exemplified by a methyl group, an ethyl group and a propyl group, the aryl group is exemplified by a phenyl group, a naphthyl group and an anthryl group, the aralkyl group is exemplified by a benzyl group or a phenetyl group, the heterocyclic ring group is exemplified by a pyridyl group, a thienyl group, a thiazoryl group, a carbazoryl group, a benzoimidazolyl group and a benzothiazoryl group. The cyclic amino group is exemplified by a pyrrolyl group, an indolyl group, an indolinyl group, a carbazolyl group, an imidazolyl group, a benzoimidazolyl group, a pyrazolyl group, a phenothiazinyl group and a phenoxazinyl group. The cyclic group formed by bonding $R_{10}$ and $R_{11}$ is exemplified by a fluorenylidene group, a xanthenylidene group, an anthronylidene group and a hydroindenylidene group.

Each of $X_1$ to $X_4$, $Y_1$, and $R_4$ to $R_{11}$ may have a substituent exemplified by an alkyl group, such as a methyl group, an ethyl group or a propyl group; an alkoxy group, such as a methoxy group, an ethoxy group or a propoxy group; a halogen atom, such as a fluorine atom, a chlorine atom, a bromine atom or an iodine atom; an acyl group, such as an acetyl group or a benzoyl group; an alkyl amino group, such as a dimethyl amino group or a diethyl amino group; phenylcarbamoyl group; a nitro group; a cyano group; and a halomethyl group, such as a trifluoromethyl group.

q in the formula (6) is 0 or 1, and $Z_1$ and $Z_2$ in the formulas (6) and (9) are each an oxygen atom or a sulfur atom.

In a case where $Cp_1$ to $Cp_{15}$ are represented by the formula selected from the group consisting of the formulas (6), (9), (10) and (11) as well as $X_1$ to $X_4$ in the formulas are coupler residual groups that are condensed with the benzene ring to form the benzocarbazole ring, the azo pigment has a sensitive region widened to substantially reach the near infrared region. Therefore, the foregoing material can be used as a preferred charge generating material for a semiconductor laser.

$A_1$ to $A_4$ in the formulas (2) to (4) are the same or different and are each a residual group required to form a substituted or unsubstituted aromatic hydrocarbon ring or a substituted or unsubstituted aromatic heterocyclic ring with carbon atoms in the formula above. The formed aromatic hydrocarbon ring is exemplified by a benzene ring and a naphthalene ring, and the formed aromatic heterocyclic ring is exemplified by a pyridine ring and a thiophene ring. The substituents that may be included in $A_1$ to $A_4$ are exemplified by alkyl groups, such as methyl groups and ethyl groups; alkoxy groups, such as methoxy groups, ethoxy groups and propoxy groups; halogen atoms, such as fluorine atoms, chlorine atoms and iodine atoms; nitro groups; cyano groups; and halomethyl groups, such as trifluoromethyl groups. It is preferable for the present invention that each of $A_1$ to $A_4$ be a residual group required to form a benzene ring.

$R_1$ to $R_3$ in the formulas (3) to (5) are hydrogen atoms or substituted or unsubstituted alkyl groups or cyano groups. The alkyl group is exemplified by a methyl group, an ethyl group and a propyl group. The substituents that may be included in $R_1$ to $R_3$ are exemplified by alkyl groups, such as methyl groups, ethyl groups or propyl groups; alkoxy groups, such as methoxy groups, ethoxy groups or propoxy groups; halogen atoms, such as fluorine atoms, chlorine atoms, bromine atoms, iodine atoms; acyl groups, such as acetyl groups or benzoyl groups; alkyl amino groups, such as dimethyl amino groups or diethyl amino groups; phenylcarbarnoyl; nitro groups; cyano groups; and halomethyl groups, such as trifluoromethyl groups. In the present invention, it is preferable that $R_1$ and $R_2$ be hydrogen atoms, methyl groups or cyano groups and $R_3$ be a hydrogen atom, a methyl group, an ethyl group or a cyano group.

In the formula (5) m, n and p are zero or positive integers and m, n and p are not simultaneously zero. That is, the azo pigment represented by the formula (5) has, in the molecule thereof, one or more carbonyl groups. In the present invention, it is preferable that m be 0, n be 1 and p be 1 or 2.

Although the azo pigments represented by the formulas (3) and (4) have isomers capable of enabling a similar electrophotographic characteristic to be obtained, the isomers are also represented by the formulas (3) and (4) in the present invention in order to simplify the description. That is, the formula (3) also represents:

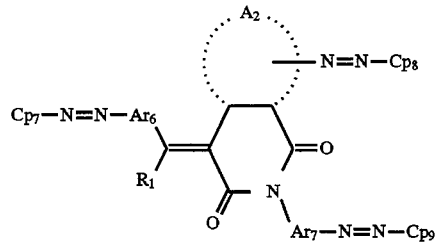

Correspondingly, the formula (4) also represents:

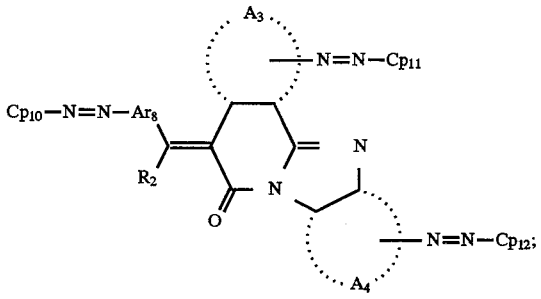

-continued

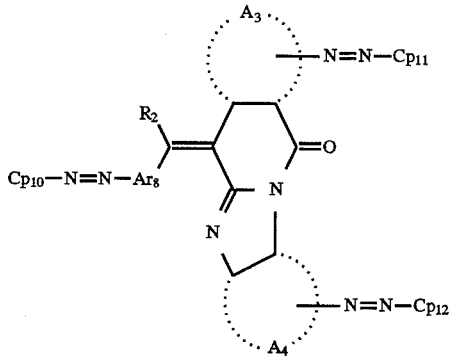

and

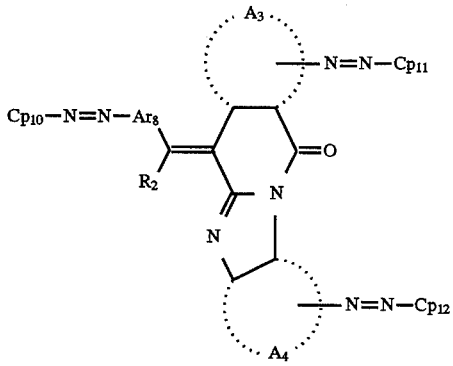

Preferred examples of the azo pigment represented by the formula (1) to (5) will now be listed. Note that the azo pigments for use in the present invention are not limited to the contents of the list below. The exemplified pigments are first shown for its basic form and then variations of, $Ar_1$ to $Ar_{11}$, $Cp_1$ to $Cp_{15}$, $A_1$ to $A_4$, $R_1$ to $R_3$, m, n and p are shown.

Basic Form 1

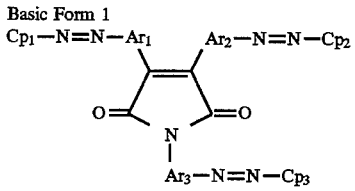

Pigment Example 1-1

$Ar_1$, $Ar_2$ and $Ar_3$:

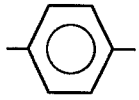

$Cp_1$, $Cp_2$ and $Cp_3$: HO

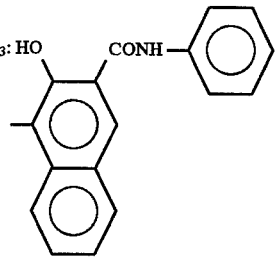

Pigment Example 1-2

$Ar_1$, $Ar_2$ and $Ar_3$:

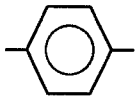

-continued $Cp_1$, $Cp_2$ and $Cp_3$: HO

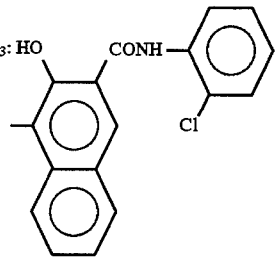

Pigment Example 1-3

$Ar_1$ and $Ar_2$:

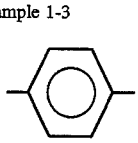

, $Ar_3$:

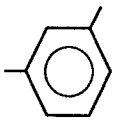

$Cp_1$, $Cp_2$ and $Cp_3$: HO

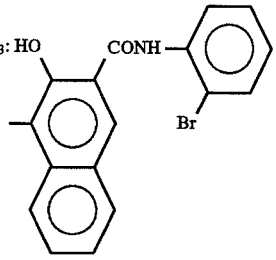

Pigment Example 1-4

$Ar_1$ and $Ar_2$:

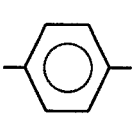

, $Ar_3$:

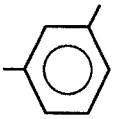

$Cp_1$, $Cp_2$ and $Cp_3$: HO

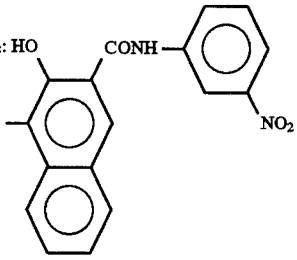

Pigment Example 1-5

$Ar_1$, $Ar_2$ and $Ar_3$:

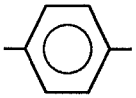

$Cp_1$, $Cp_2$ and $Cp_3$: HO

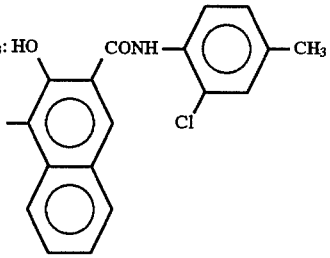

Pigment Example 1-6

$Ar_1$ and $Ar_2$:

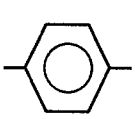

, $Ar_3$:

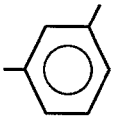

-continued
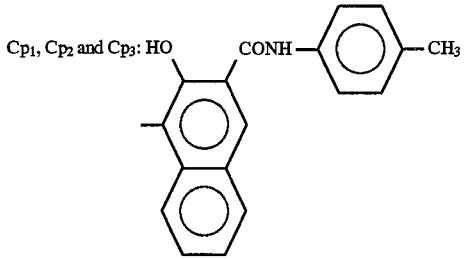
Pigment Example 1-7
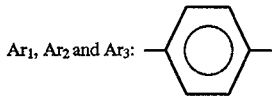
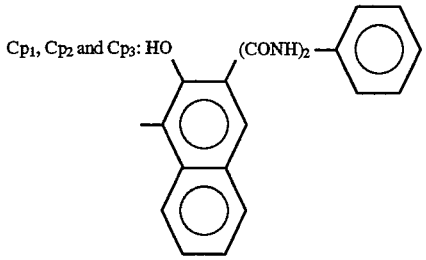
Pigment Example 1-8
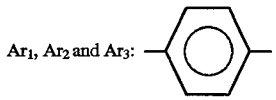
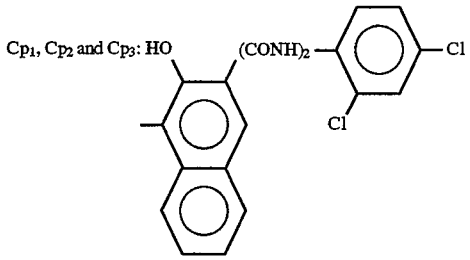
Pigment Example 1-9
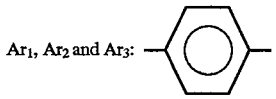
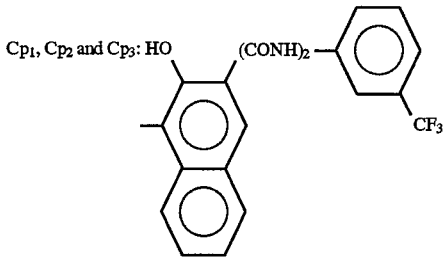
Pigment Example 1-10
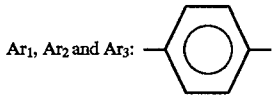
-continued
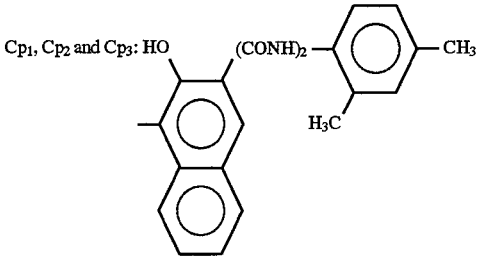
Pigment Example 1-11
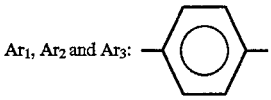
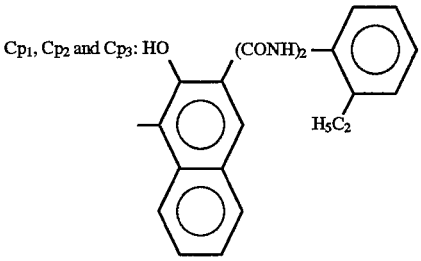
Pigment Example 1-12
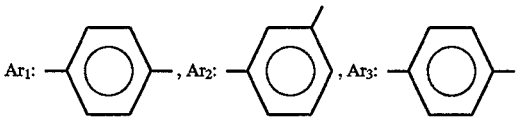
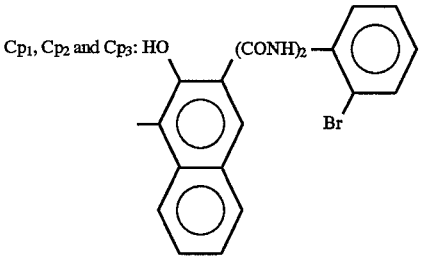
Pigment Example 1-13
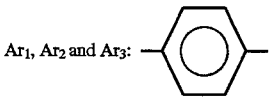
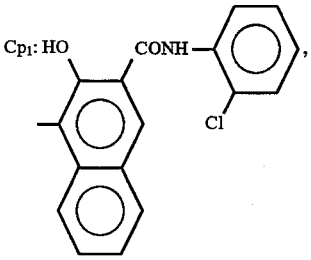

-continued
$Cp_2$ and $Cp_3$: HO
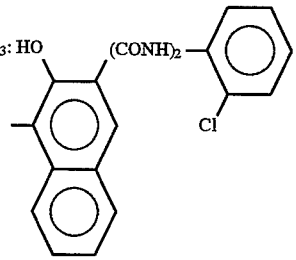
Pigment Example 1-14
$Ar_1$, $Ar_2$ and $Ar_3$:
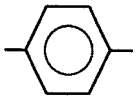
$Cp_1$, $Cp_2$ and $Cp_3$: HO
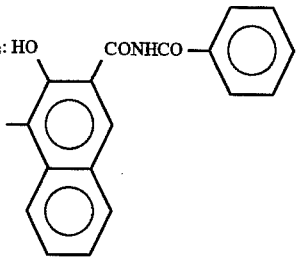
Pigment Example 1-15
$Ar_1$, $Ar_2$ and $Ar_3$:
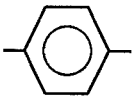
$Cp_1$: HO
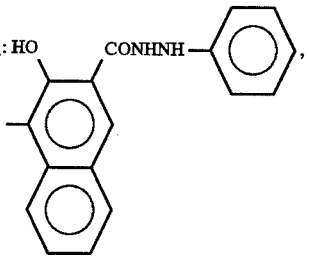
$Cp_2$ and $Cp_3$: HO
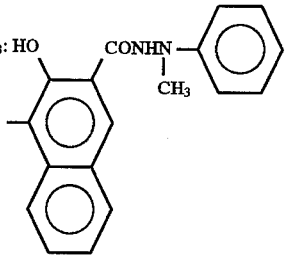
Pigment Example 1-16
$Ar_1$, $Ar_2$ and $Ar_3$:
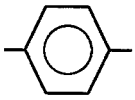
-continued
$Cp_1$, $Cp_2$ and $Cp_3$: HO
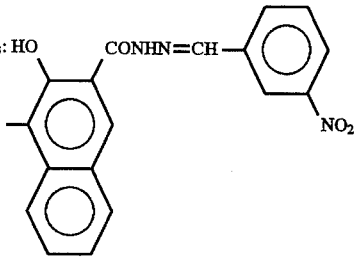
Pigment Example 1-17
$Ar_1$, $Ar_2$ and $Ar_3$:
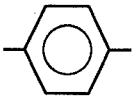
$Cp_1$, $Cp_2$ and $Cp_3$: HO
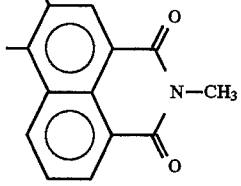
Pigment Example 1-18
$Ar_1$, $Ar_2$ and $Ar_3$:
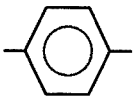
$Cp_1$, $Cp_2$ and $Cp_3$: HO
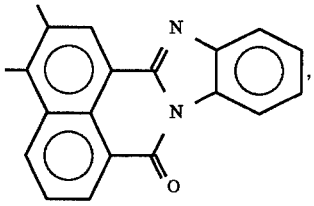
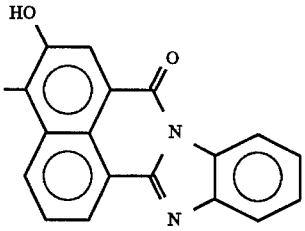
Pigment Example 1-19
$Ar_1$, $Ar_2$ and $Ar_3$:
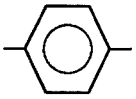
$Cp_1$:
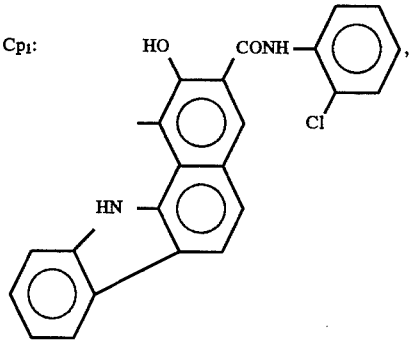

-continued
$Cp_2$ and $Cp_3$:
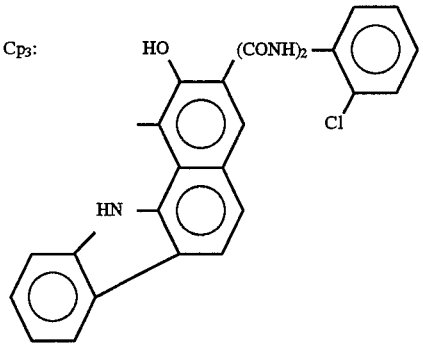
Pigment Example 1-20
$Ar_1$, $Ar_2$ and $Ar_3$:
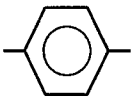
$Cp_1$, $Cp_2$ and $Cp_3$:
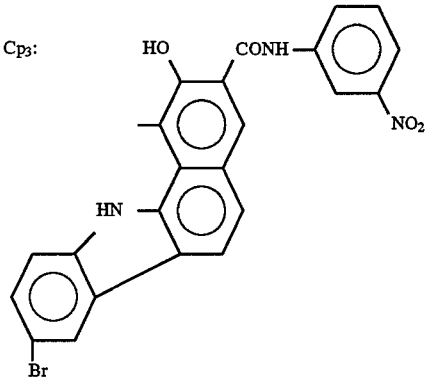
Pigment Example 1-21
$Ar_1$, $Ar_2$ and $Ar_3$:
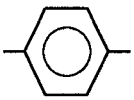
$Cp_1$, $Cp_2$ and $Cp_3$:
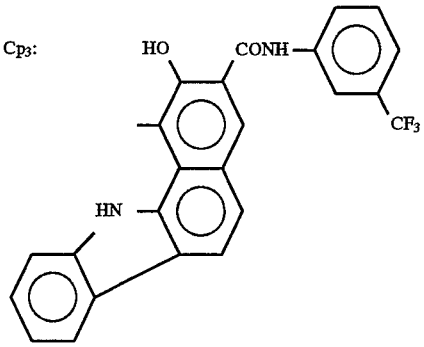
Pigment Example 1-22
$Ar_1$, $Ar_2$ and $Ar_3$:
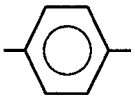
-continued
$Cp_1$, $Cp_2$ and $Cp_3$:
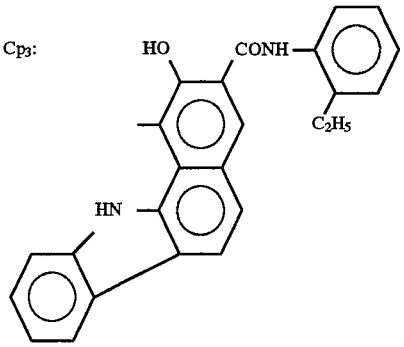
Pigment Example 1-23
$Ar_1$, $Ar_2$ and $Ar_3$:
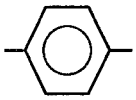
$Cp_1$, $Cp_2$ and $Cp_3$:
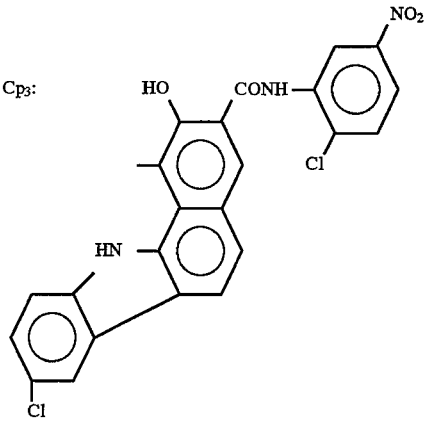
Pigment Example 1-24
$Ar_1$, $Ar_2$ and $Ar_3$:
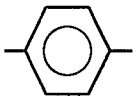
$Cp_1$, $Cp_2$ and $Cp_3$:
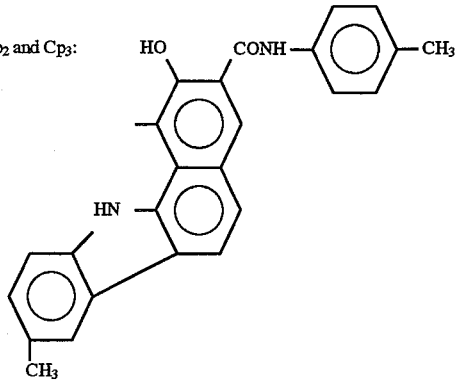
Pigment Example 1-25
$Ar_1$: 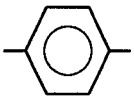 , $Ar_2$: 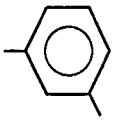 , $Ar_3$: 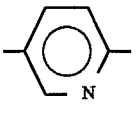

-continued
$Cp_1$: HO CONH $OCH_3$,
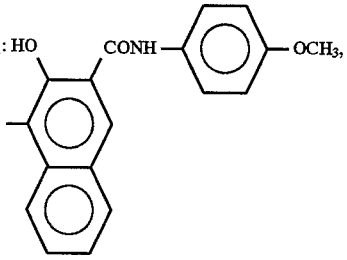
$Cp_2$: HO CONH $CH_3$
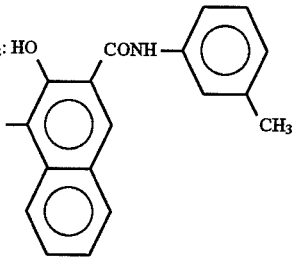
$Cp_3$: HO CONH Cl
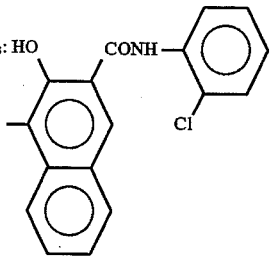
Pigment Example 1-26
$Ar_1$: 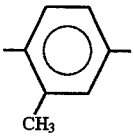 , $Ar_2$: 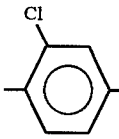 , $Ar_3$: 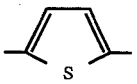
$Cp_1$, $Cp_2$ and $Cp_3$: HO CONH Cl Cl HN
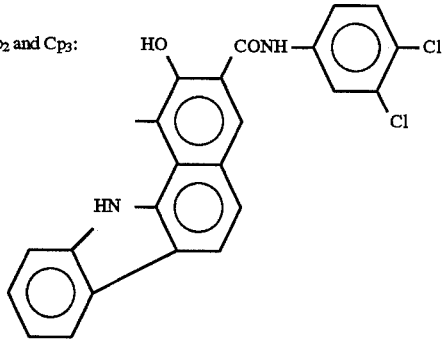
Pigment Example 1-27
$Ar_1$: 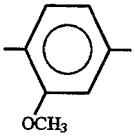 , $Ar_2$: 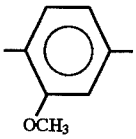 , $Ar_3$: 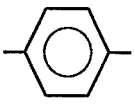
-continued
$Cp_1$, $Cp_2$ and $Cp_3$: HO
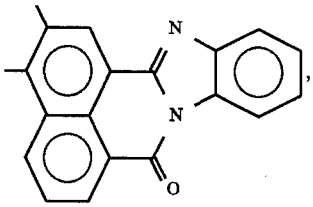
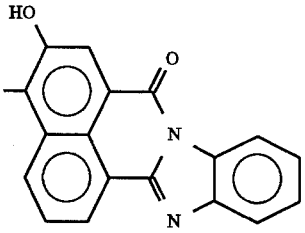
Pigment Example 1-28
$Ar_1$, $Ar_2$ and $Ar_3$: 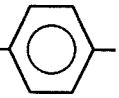
$Cp_1$: HO CONH Br
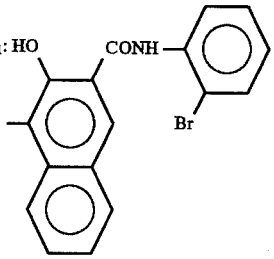
$Cp_2$ and $Cp_3$: HO CONH $CH_3$ HN Cl
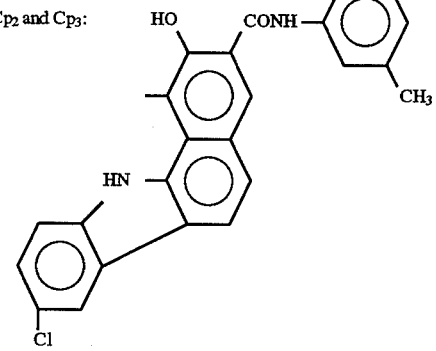
Pigment Example 1-29
$Ar_1$: 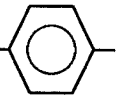 , $Ar_2$: 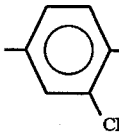 , $Ar_3$: 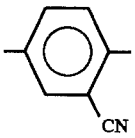

-continued
$Cp_1$, $Cp_2$ and $Cp_3$:
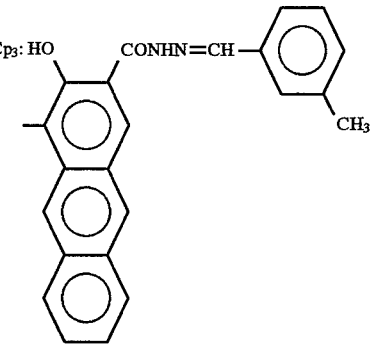
Pigment Example 1-30
$Ar_1$: 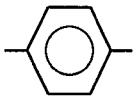 , $Ar_2$: 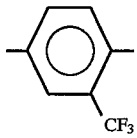 , $Ar_3$: 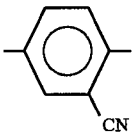
$Cp_1$, $Cp_2$ and $Cp_3$:
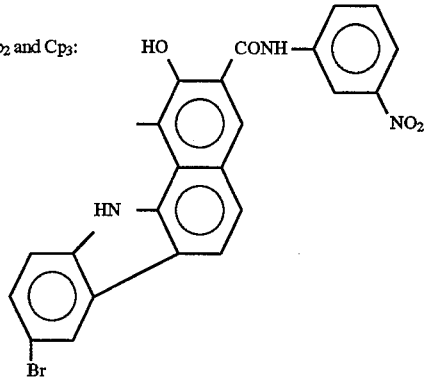
Pigment Example 1-31
$Ar_1$: 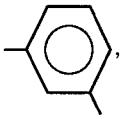 , $Ar_2$: 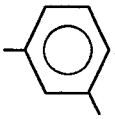 , $Ar_3$: 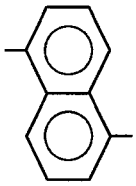
$Cp_1$, $Cp_2$ and $Cp_3$:
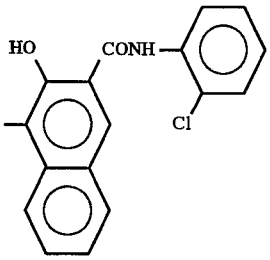
Pigment Example 1-32
$Ar_1$, $Ar_2$ and $Ar_3$: 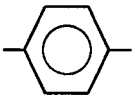
-continued
$Cp_1$ and $Cp_3$:
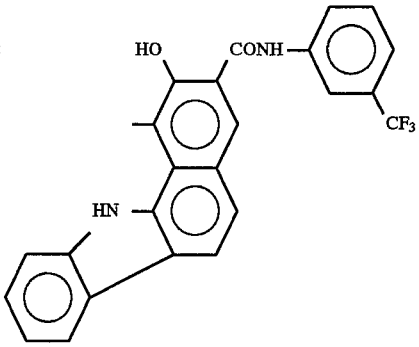
$Cp_2$:
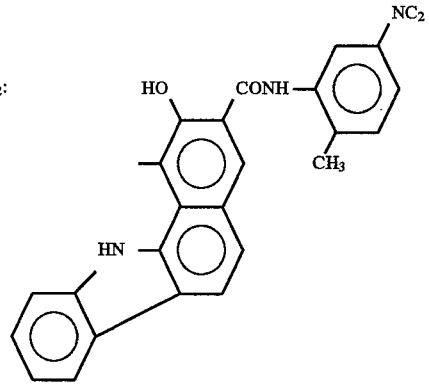
Basic Form 2
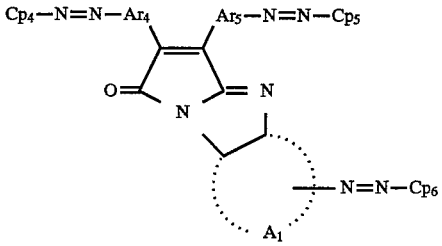
Pigment Example 2-1
$Ar_4$ and $Ar_5$: 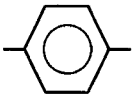 , $A_1$: 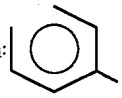
$Cp_4$, $Cp_5$ and $Cp_6$:
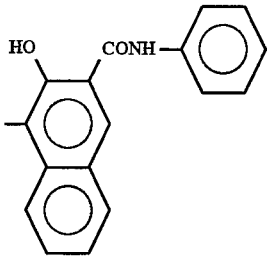
Pigment Example 2-2
$Ar_4$ and $Ar_5$: 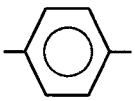 , $A_1$: 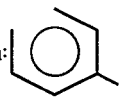

-continued $Cp_4$, $Cp_5$ and $Cp_6$:

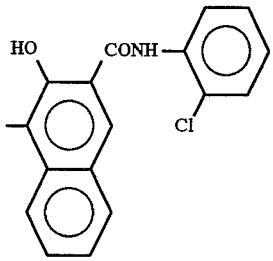

Pigment Example 2-3

$Ar_4$ and $Ar_5$: 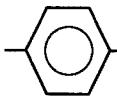 , $A_1$: 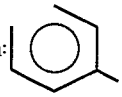

$Cp_4$, $Cp_5$ and $Cp_6$:

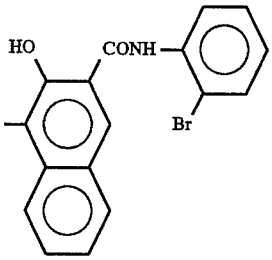

Pigment Example 2-4

$Ar_4$ and $Ar_5$: 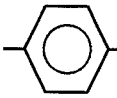 , $A_1$: 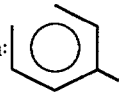

$Cp_4$, $Cp_5$ and $Cp_6$:

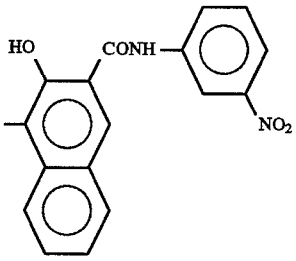

Pigment Example 2-5

$Ar_4$ and $Ar_5$: 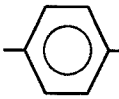 , $A_1$: 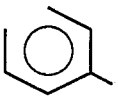

$Cp_4$, $Cp_5$ and $Cp_6$:

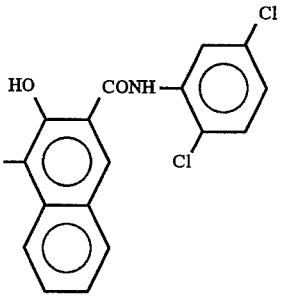

Pigment Example 2-6

$Ar_4$ and $Ar_5$: 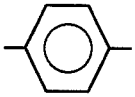 , $A_1$: 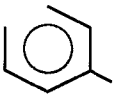

-continued $Cp_4$, $Cp_5$ and $Cp_6$:

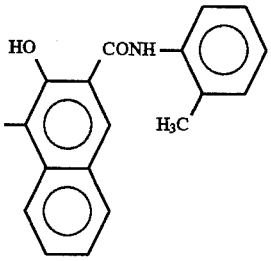

Pigment Example 2-7

$Ar_4$ and $Ar_5$: 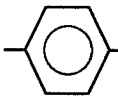 , $A_1$: 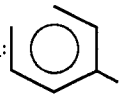

$Cp_4$, $Cp_5$ and $Cp_6$:

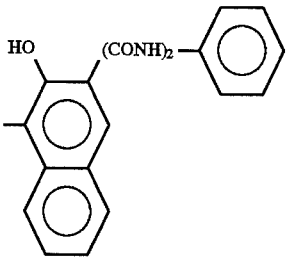

Pigment Example 2-8

$Ar_4$ and $Ar_5$: 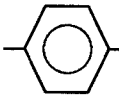 , $A_1$: 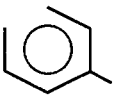

$Cp_4$, $Cp_5$ and $Cp_6$:

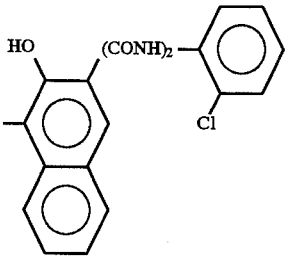

Pigment Example 2-9

$Ar_4$ and $Ar_5$: 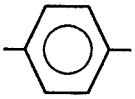 , $A_1$: 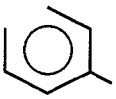

$Cp_4$, $Cp_5$ and $Cp_6$:

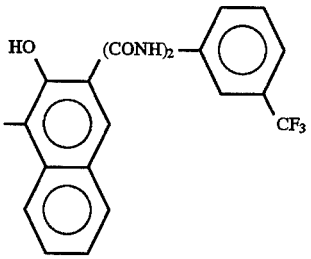

Pigment Example 2-10

$Ar_4$ and $Ar_5$: 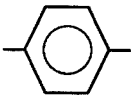 , $A_1$: 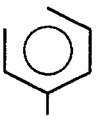

-continued
Cp4, Cp5 and Cp6:
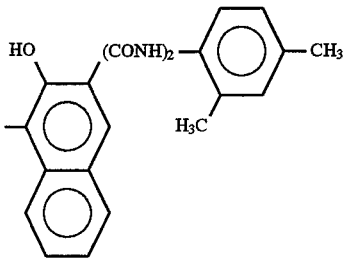
Pigment Example 2-11
Ar4 and Ar5:
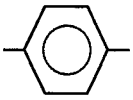
, A1:
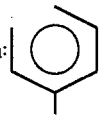
Cp4:
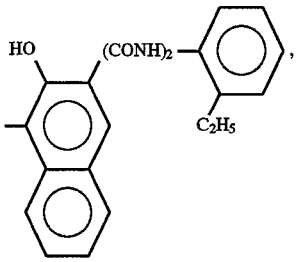
Cp5 and Cp6:
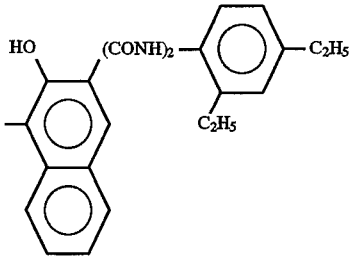
Pigment Example 2-12
Ar4 and Ar5:
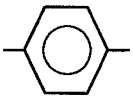
, A1:
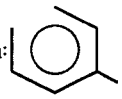
Cp4, Cp5 and Cp6:
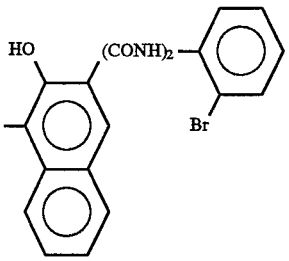
Pigment Example 2-13
Ar4 and Ar5:
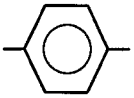
, A1:
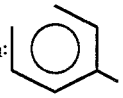
-continued
Cp4:
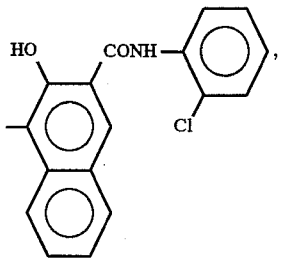
Cp5 and Cp6:
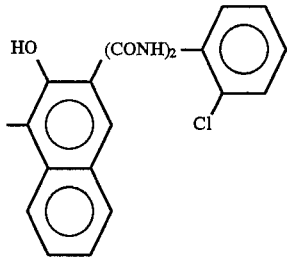
Pigment Example 2-14
Ar4 and Ar5:
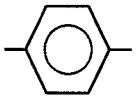
, A1:
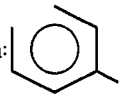
Cp4, Cp5 and Cp6:
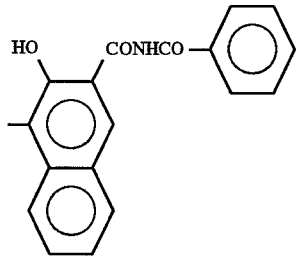
Pigment Example 2-15
Ar4 and Ar5:
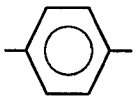
, A1:
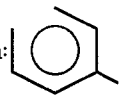
Cp4, Cp5 and Cp6:
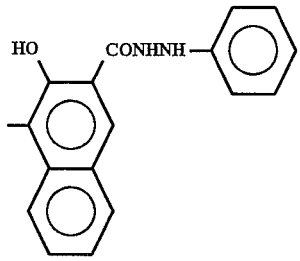
Pigment Example 2-16
Ar4 and Ar5:
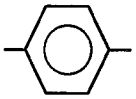
, A1:
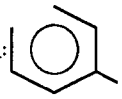

-continued
$Cp_4$, $Cp_5$ and $Cp_6$:
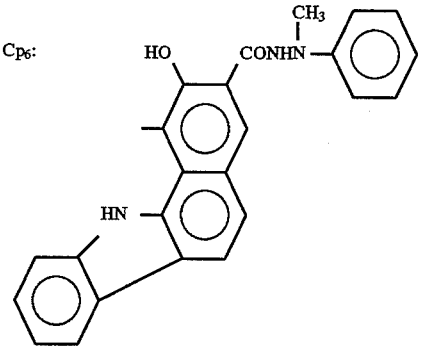
Pigment Example 2-17
$Ar_4$ and $Ar_5$: 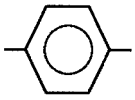 , $A_1$: 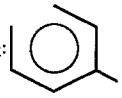
$Cp_4$, $Cp_5$ and $Cp_6$:
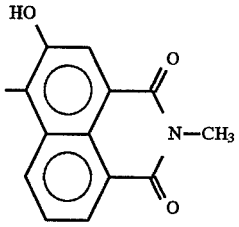
Pigment Example 2-18
$Ar_4$ and $Ar_5$: 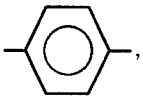 , $A_1$: 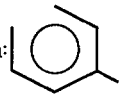
$Cp_4$, $Cp_5$ and $Cp_6$:
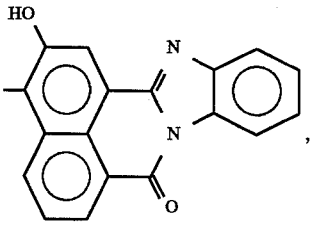
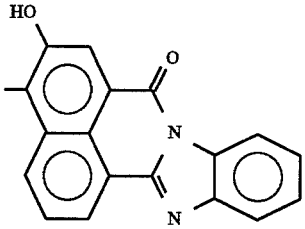
Pigment Example 2-19
$Ar_4$ and $Ar_5$: 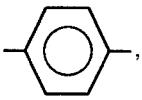 , $A_1$: 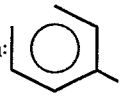
-continued
$Cp_4$, $Cp_5$ and $Cp_6$:
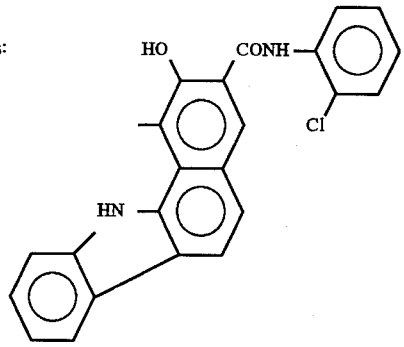
Pigment Example 2-20
$Ar_4$ and $Ar_5$: 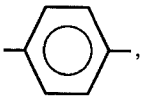 , $A_1$: 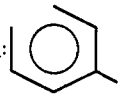
$Cp_4$, $Cp_5$ and $Cp_6$:
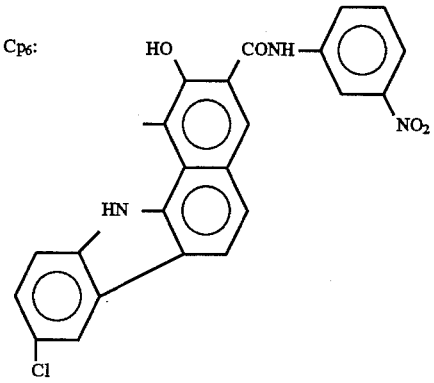
Pigment Example 2-21
$Ar_4$ and $Ar_5$: 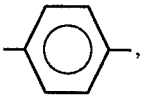 , $A_1$: 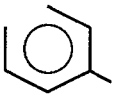
$Cp_4$, $Cp_5$ and $Cp_6$:
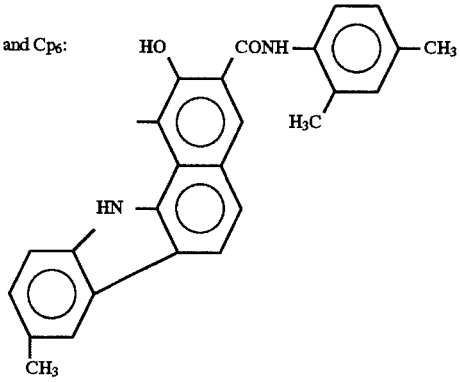
Pigment Example 2-22
$Ar_4$ and $Ar_5$: 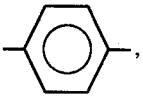 , $A_1$: 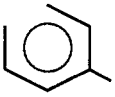

-continued
$Cp_4$, $Cp_5$ and $Cp_6$:
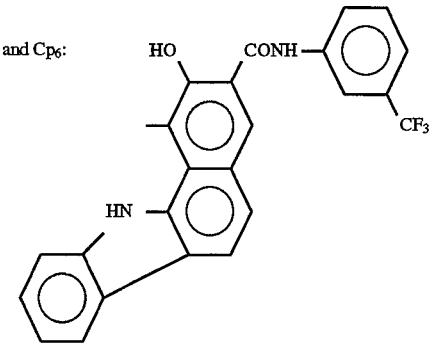
Pigment Example 2-23
$Ar_4$ and $Ar_5$: 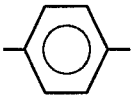 , $A_1$: 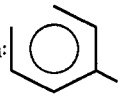
$Cp_4$, $Cp_5$ and $Cp_6$:
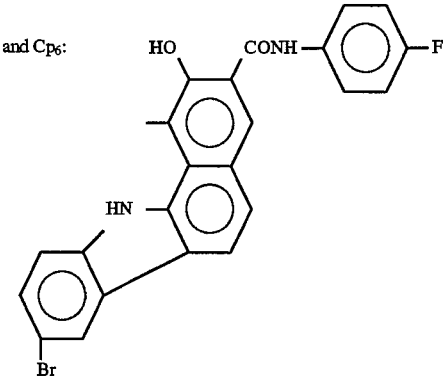
Pigment Example 2-24
$Ar_4$ and $Ar_5$: 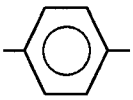 , $A_1$: 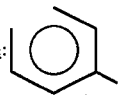
$Cp_4$, $Cp_5$ and $Cp_6$:
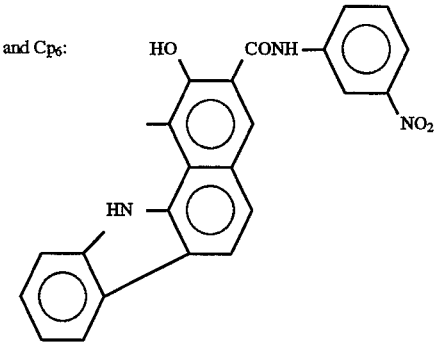
Pigment Example 2-25
$Ar_4$ and $Ar_5$: 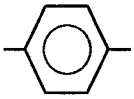 , $A_1$: 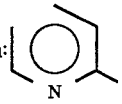
-continued
$Cp_4$, $Cp_5$ and $Cp_6$:
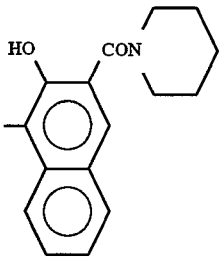
Pigment Example 2-26
$Ar_4$ and $Ar_5$: 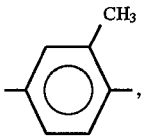
, $A_1$: 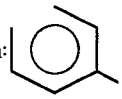
$Cp_4$, $Cp_5$ and $Cp_6$:
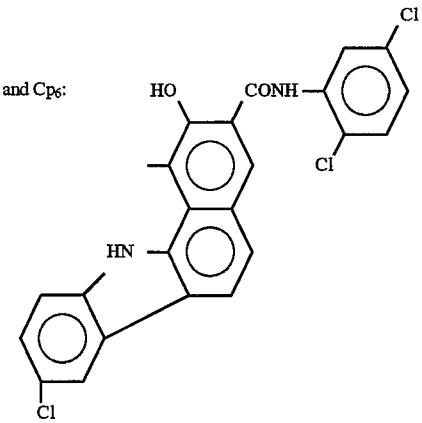
Pigment Example 2-27
$Ar_4$ and $Ar_5$: 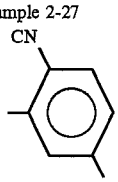
, $A_1$: N 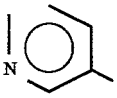
$Cp_4$, $Cp_5$ and $Cp_6$:
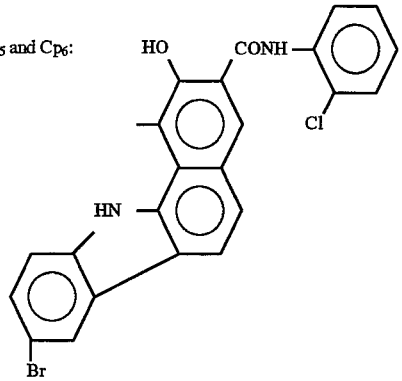
Pigment Example 2-28
$Ar_4$ and $Ar_5$: 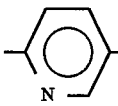
, $A_1$: 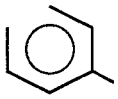

-continued
$Cp_4$, $Cp_5$ and $Cp_6$:
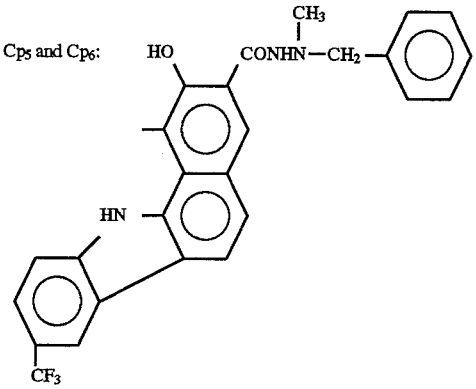
Pigment Example 2-29
$Ar_4$ and $Ar_5$:
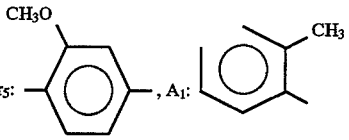
, $A_1$:
$Cp_4$, $Cp_5$ and $Cp_6$:
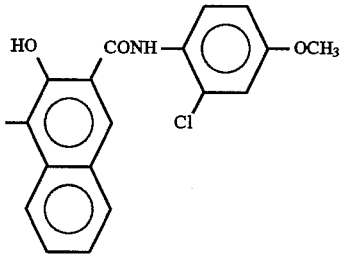
Pigment Example 2-30
$Ar_4$ and $Ar_5$:
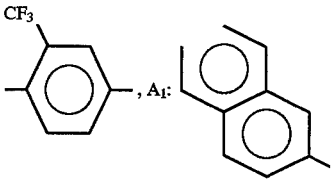
, $A_1$:
$Cp_4$, $Cp_5$ and $Cp_6$:
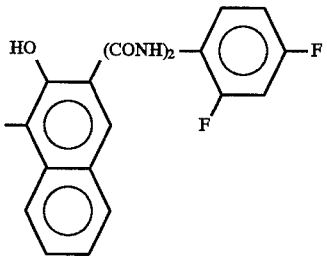
Pigment Example 2-31
$Ar_4$ and $Ar_5$:
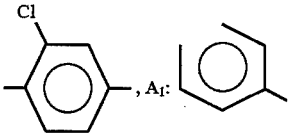
, $A_1$:
-continued
$Cp_4$, $Cp_5$ and $Cp_6$:
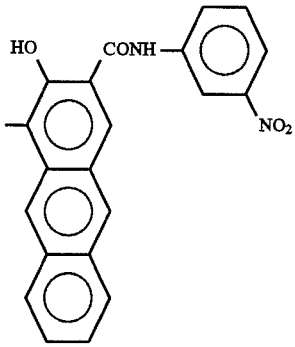
Pigment Example 2-32
$Ar_4$ and $Ar_5$:
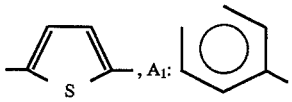
, $A_1$:
$Cp_4$:
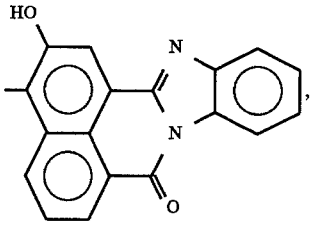
,
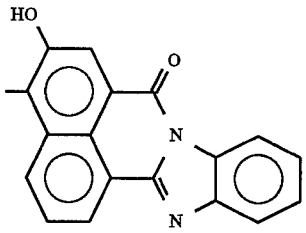
$Cp_5$:
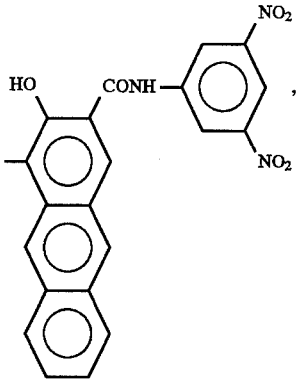
, -continued
Cp6:
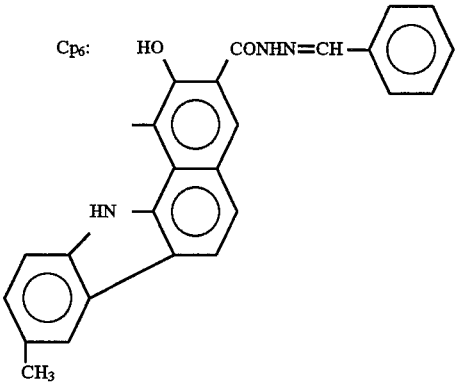
Basic Form 3
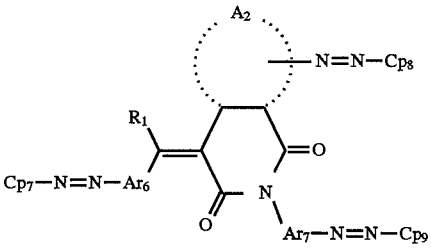
Pigment Example 3-1
R1: —CN, Ar6: 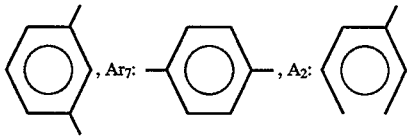 , Ar7: , A2: 
Cp7, Cp8 and Cp9: 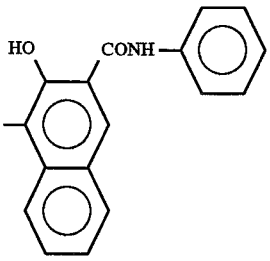
Pigment Example 3-2
R1: —CN, Ar6: 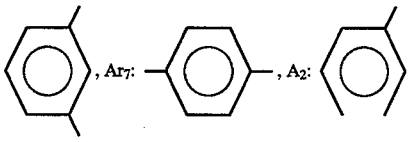 , Ar7: , A2: 
Cp7, Cp8 and Cp9: 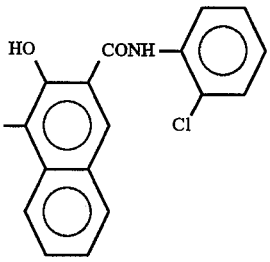
-continued
Pigment Example 3-3
R1: —CN, Ar6: 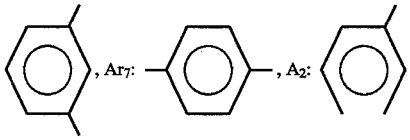 , Ar7: , A2: 
Cp7, Cp8 and Cp9: 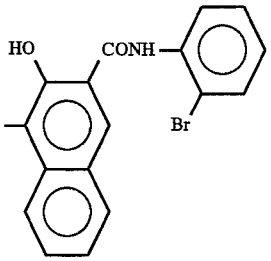
Pigment Example 3-4
R1: —CN, Ar6: 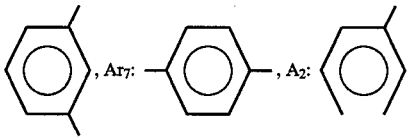 , Ar7: , A2: 
Cp7, Cp8 and Cp9: 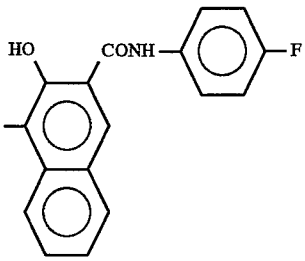
Pigment Example 3-5
R1: —CN, Ar6: 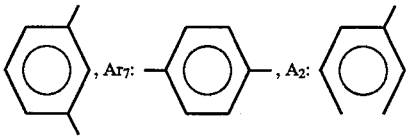 , Ar7: , A2: 
Cp7, Cp8 and Cp9: 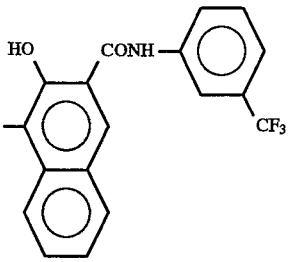
Pigment Example 3-6
R1: —CN, Ar6: 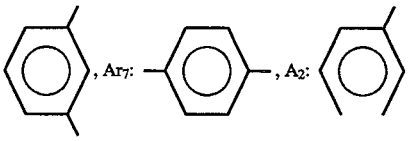 , Ar7: , A2:

-continued
$Cp_7$, $Cp_8$ and $Cp_9$:
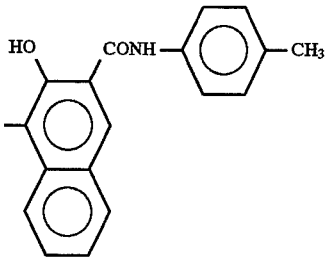
Pigment Example 3-7
$R_1$: —CN, $Ar_6$: 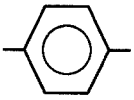 , $Ar_7$: 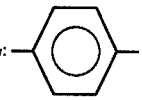 ,
$A_2$: 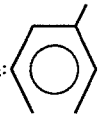
$Cp_7$, $Cp_8$ and $Cp_9$:
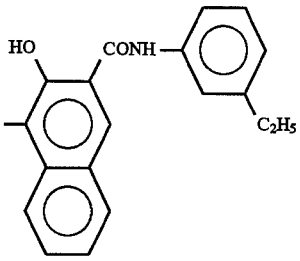
Pigment Example 3-8
$R_1$: —CN, $Ar_6$: 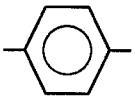 , $Ar_7$: 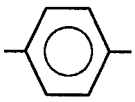 ,
$A_2$: 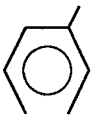
$Cp_7$, $Cp_8$ and $Cp_9$:
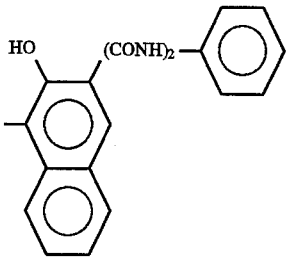
Pigment Example 3-9
$R_1$: —CN, $Ar_6$: 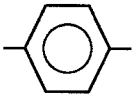 , $Ar_7$: 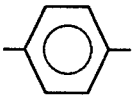 ,
$A_2$: 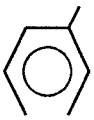
-continued
$Cp_7$, $Cp_8$ and $Cp_9$:
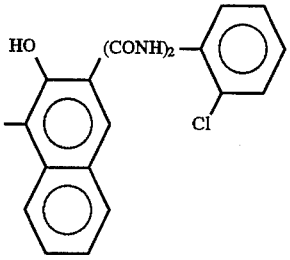
Pigment Example 3-10
$R_1$: —CN, $Ar_6$: 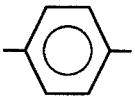 , $Ar_7$: 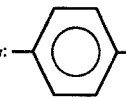 ,
$A_2$: 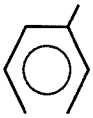
$Cp_7$, $Cp_8$ and $Cp_9$:
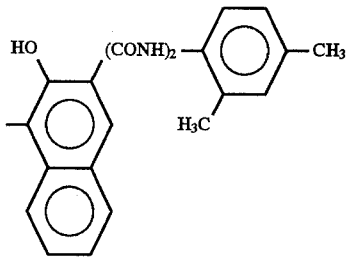
Pigment Example 3-11
$R_1$: —CN, $Ar_6$: 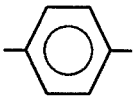 , $Ar_7$: 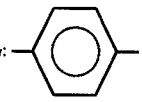 ,
$A_2$: 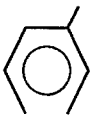
$Cp_7$, $Cp_8$ and $Cp_9$:
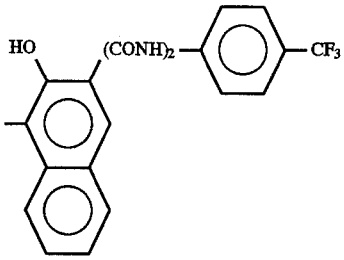
Pigment Example 3-12
$R_1$: —CN, $Ar_6$: 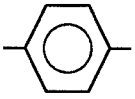 , $Ar_7$: 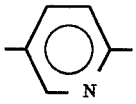 ,
$A_2$: 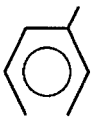

-continued
$Cp_7$, $Cp_8$ and $Cp_9$:
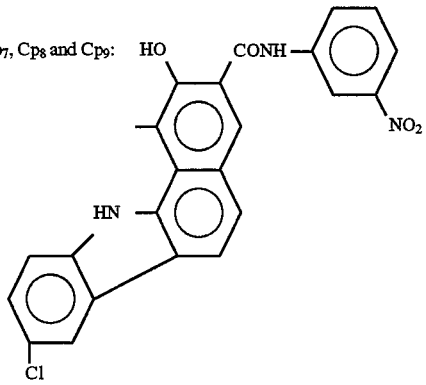
Pigment Example 3-13
$R_1$: —CN, $Ar_6$:
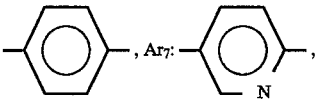
$A_2$:
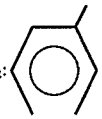
$Cp_7$, $Cp_8$ and $Cp_9$:
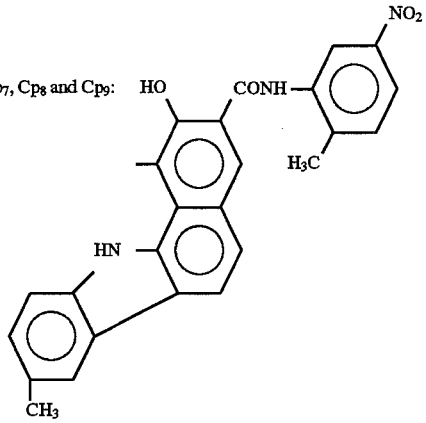
Pigment Example 3-14
$R_1$: —CN, $Ar_6$:
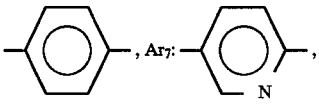
$A_2$:
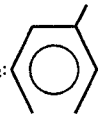
$Cp_7$, $Cp_8$ and $Cp_9$:
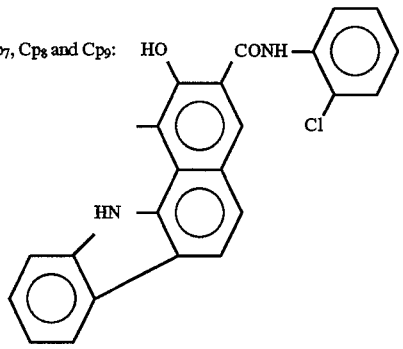
-continued
Pigment Example 3-15
$R_1$: —$CH_3$, $Ar_6$:
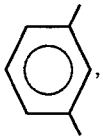
, $Ar_7$:
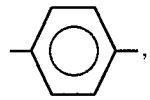
$A_2$:
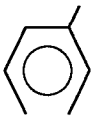
$Cp_7$, $Cp_8$ and $Cp_9$:
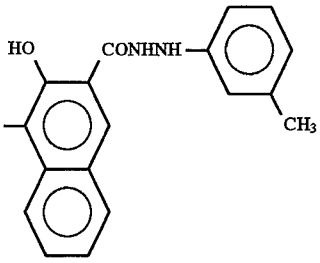
Pigment Example 3-16
$R_1$: —CN, $Ar_6$:
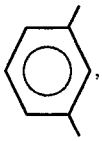
, $Ar_7$:
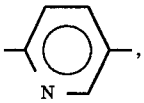
$A_2$:
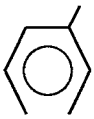
$Cp_7$, $Cp_8$ and $Cp_9$:
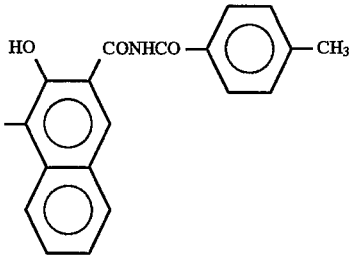
Pigment Example 3-17
$R_1$: —H, $Ar_6$:
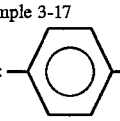
, $Ar_7$:
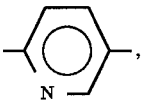
$A_2$:
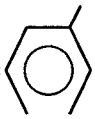
$Cp_7$, $Cp_8$ and $Cp_9$:
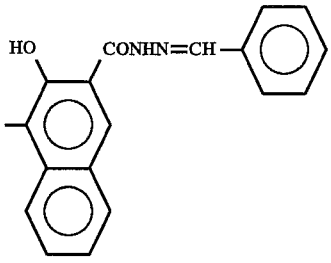

-continued
Pigment Example 3-18
$R_1$: —H, $Ar_6$: 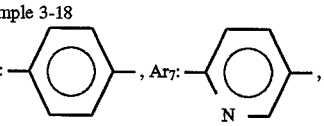 , $Ar_7$: ,
$A_2$: 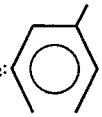
$Cp_7$, $Cp_8$ and $Cp_9$: 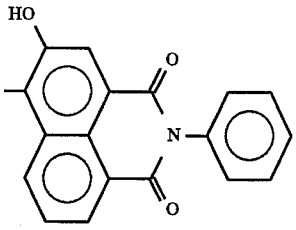
Pigment Example 3-19
$R_1$: —CN, $Ar_6$: 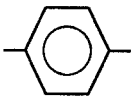 , $Ar_7$: 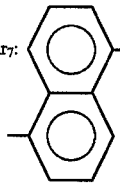 ,
$A_2$: 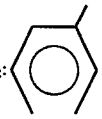
$Cp_7$, $Cp_8$ and $Cp_9$: 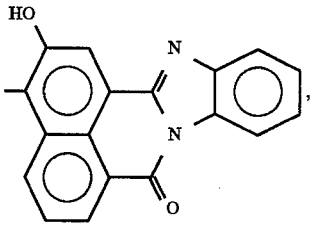
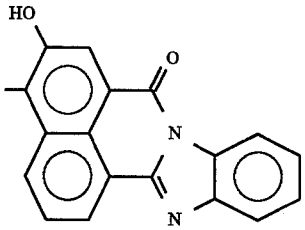
Pigment Example 3-20
$R_1$: —CN, $Ar_6$: 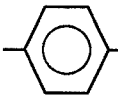 , $Ar_7$: 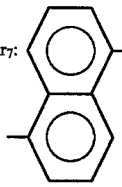 ,
$A_2$: 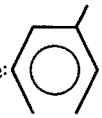
-continued
$Cp_7$: 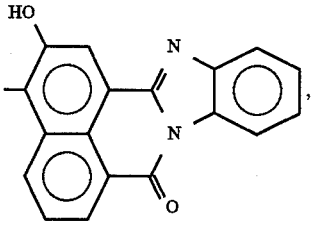 ,
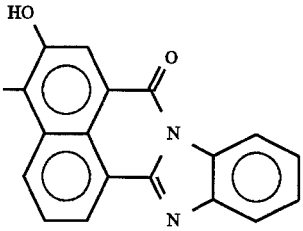
$Cp_8$ and $Cp_9$: 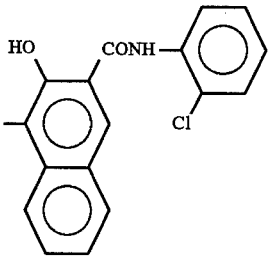
Pigment Example 3-21
$R_1$: —CN, $Ar_6$: 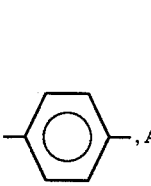 , $Ar_7$: 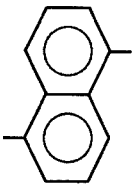 ,
$A_2$: 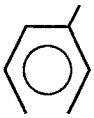
$Cp_7$: 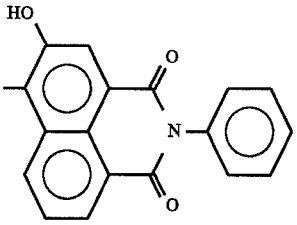 ,
$Cp_8$ and $Cp_9$: 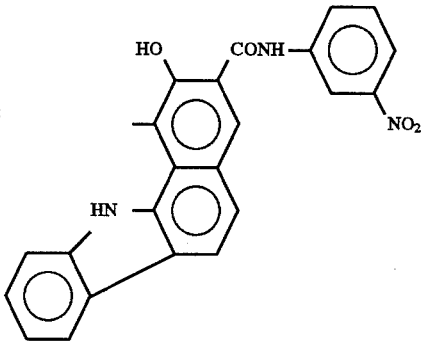

-continued
Pigment Example 3-22
$R_1$: —H, $Ar_6$: 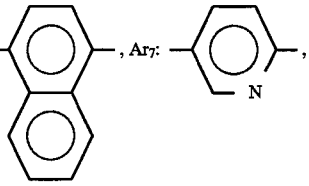 , $Ar_7$: ,
$A_2$: 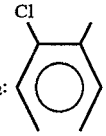
$Cp_7$, $Cp_8$ and $Cp_9$: 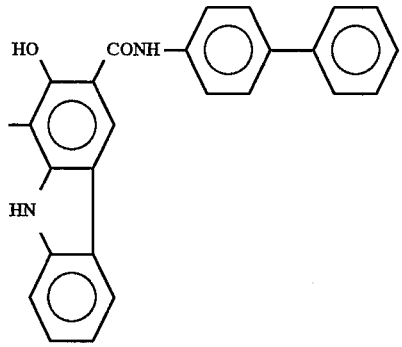
Pigment Example 3-23
$R_1$: —CN, $Ar_6$: 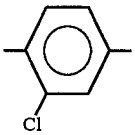 , $Ar_7$: 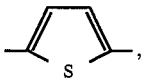 ,
$A_2$: 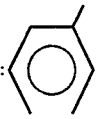
$Cp_7$, $Cp_8$ and $Cp_9$: 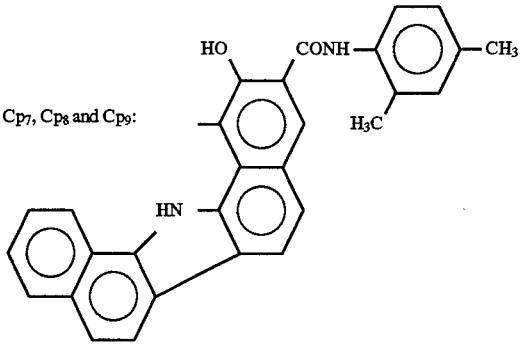
Pigment Example 3-24
$R_1$: —H, $Ar_6$: 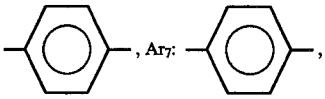 , $Ar_7$: ,
$A_2$: 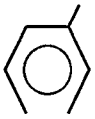
-continued
$Cp_7$, $Cp_8$ and $Cp_9$: 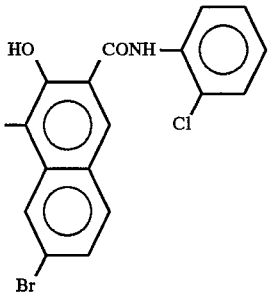
Pigment Example 3-25
$R_1$: —H, $Ar_6$: 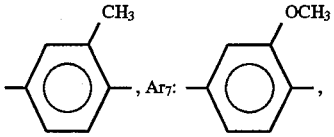 , $Ar_7$: ,
$A_2$: 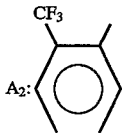
$Cp_7$, $Cp_8$ and $Cp_9$: 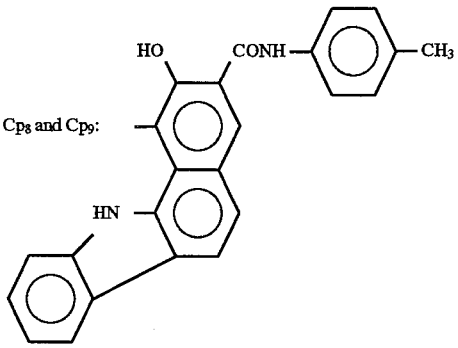
Pigment Example 3-26
$R_1$: —H, $Ar_6$: 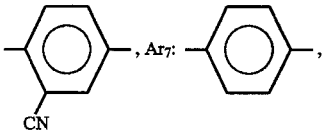 , $Ar_7$: ,
$A_2$: 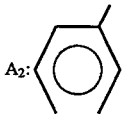
$Cp_7$, $Cp_8$ and $Cp_9$: 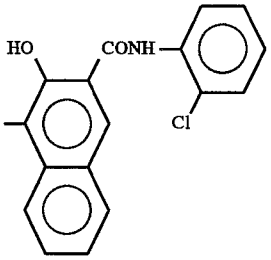
Pigment Example 3-27
$R_1$: —$C_2H_5$, $Ar_6$: 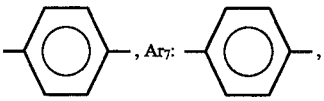 , $Ar_7$: , -continued
$A_2$:
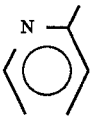
$Cp_7$, $Cp_8$ and $Cp_9$:
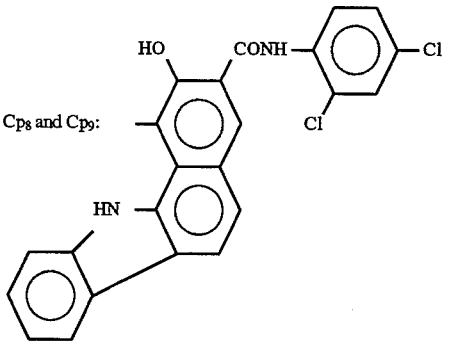
Pigment Example 3-28
$R_1$: —CN, $Ar_6$: , $Ar_7$: ,
$A_2$:
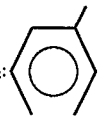
$Cp_7$, $Cp_8$ and $Cp_9$:
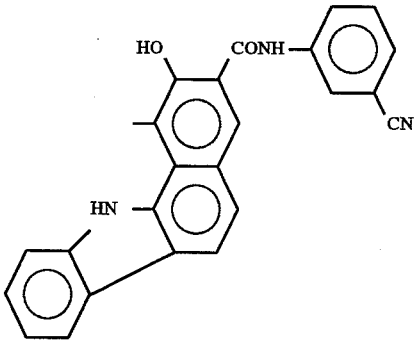
Pigment Example 3-29
$R_1$: —CN, $Ar_6$: , $A_7$: ,
$A_2$:
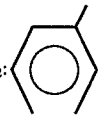
$Cp_7$, $Cp_8$ and $Cp_9$:
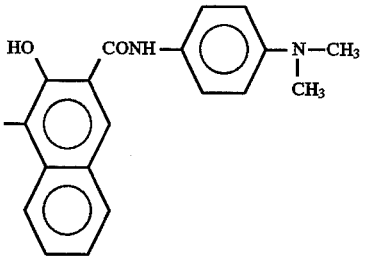
-continued
Basic Form 4
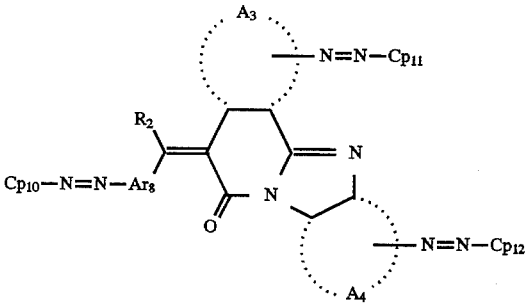
Pigment Example 4-1
$R_2$: —CN, $Ar_8$: , $A_3$: , $A_4$:
$Cp_{10}$, $Cp_{11}$ and $Cp_{12}$:
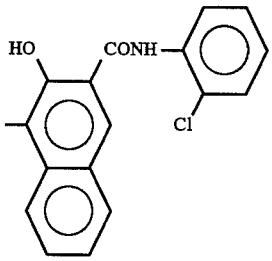
Pigment Example 4-2
$R_2$: —CN, $Ar_8$: , $A_3$: , $A_4$:
$Cp_{10}$, $Cp_{11}$ and $Cp_{12}$:
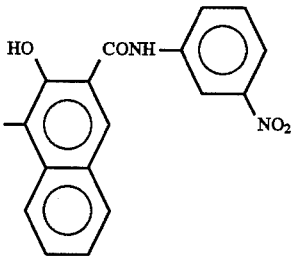
Pigment Example 4-3
$R_2$: —CN, $Ar_8$: , $A_3$: , $A_4$:
$Cp_{10}$, $Cp_{11}$ and $Cp_{12}$:
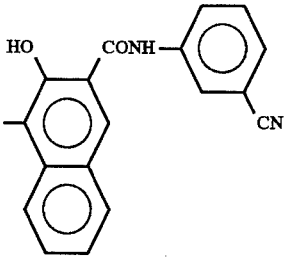

-continued
Pigment Example 4-4
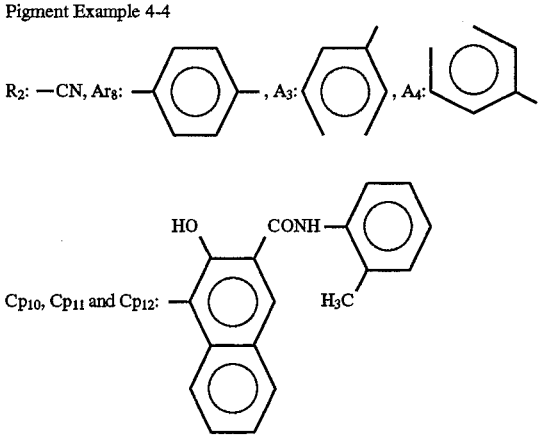
Pigment Example 4-5
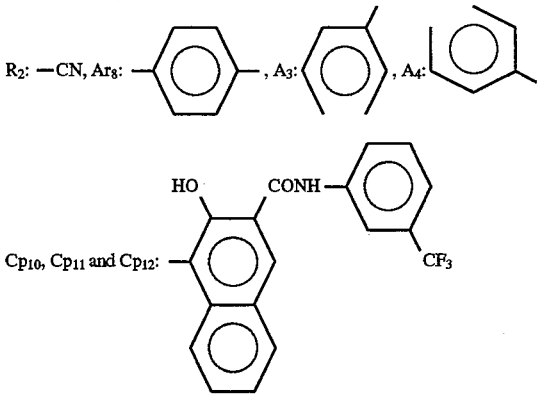
Pigment Example 4-6
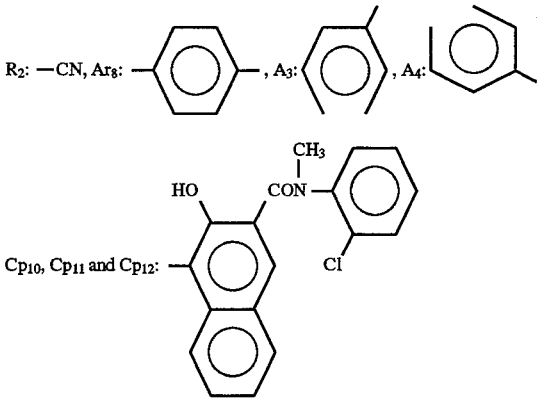
Pigment Example 4-7
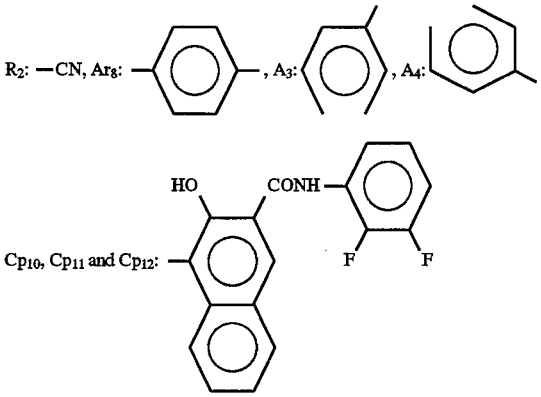
-continued
Pigment Example 4-8
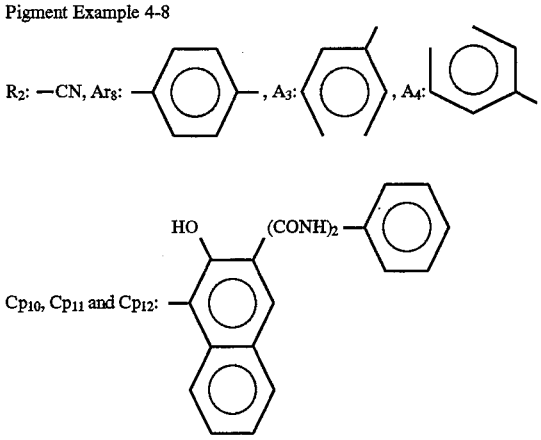
Pigment Example 4-9
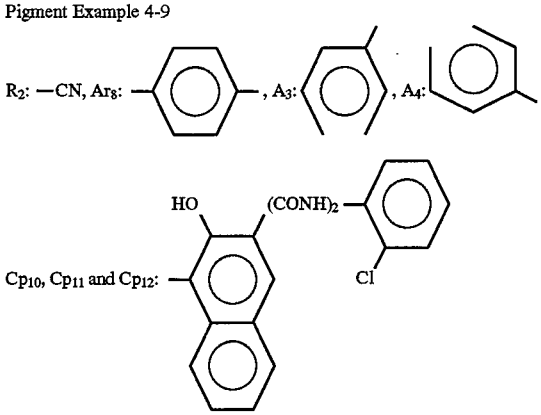
Pigment Example 4-10
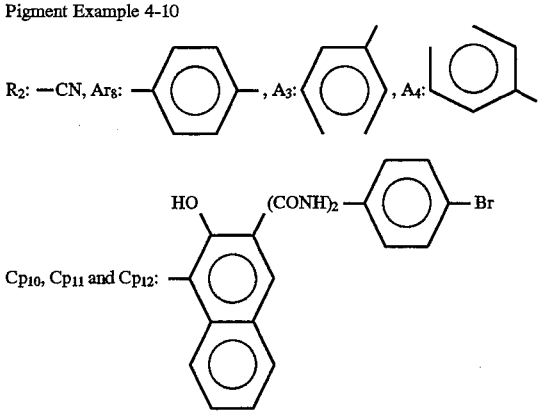
Pigment Example 4-11
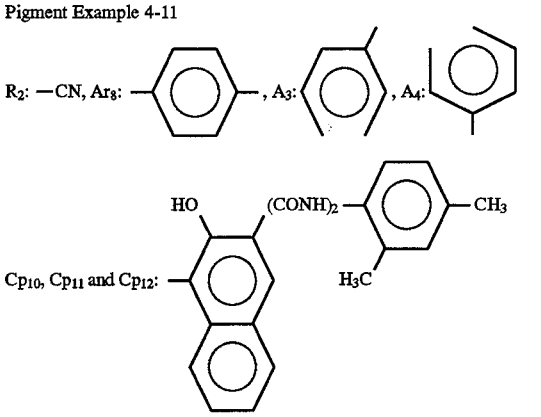

Pigment Example 4-12
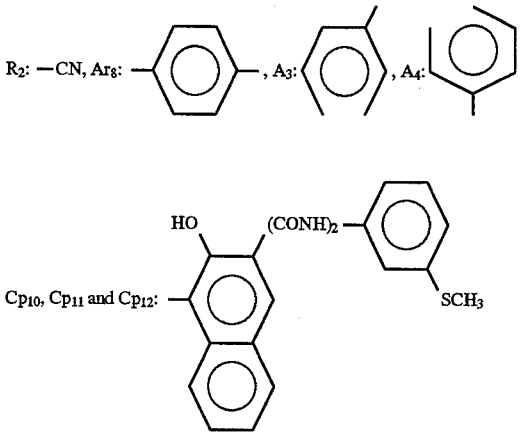
Pigment Example 4-13
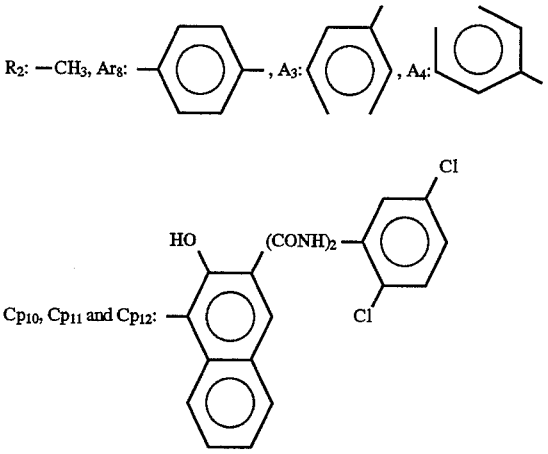
Pigment Example 4-14
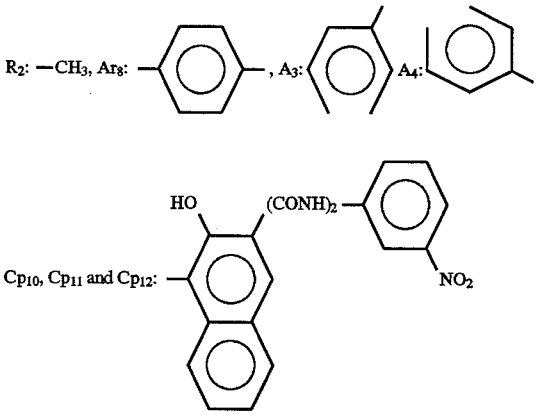
Pigment Example 4-15
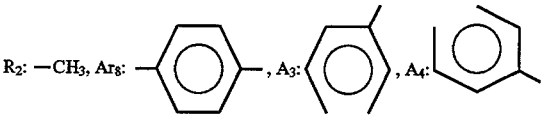
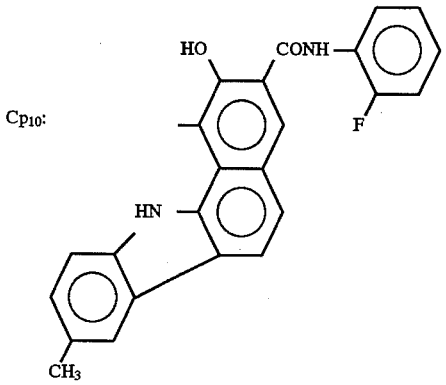
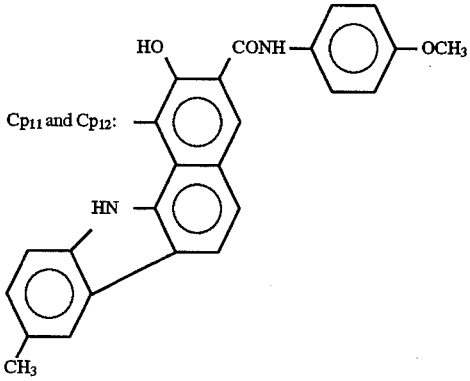
Pigment Example 4-16
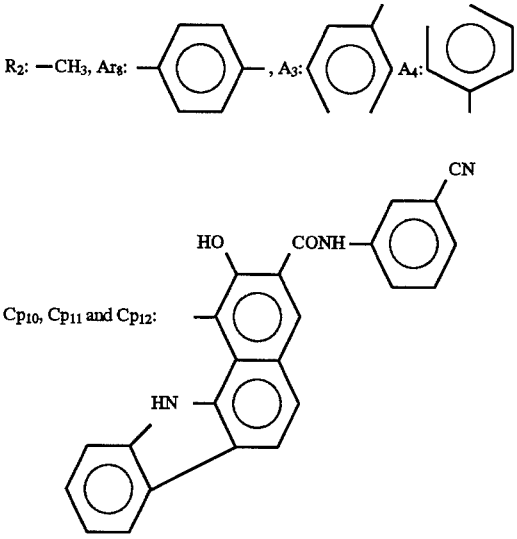
Pigment Example 4-17
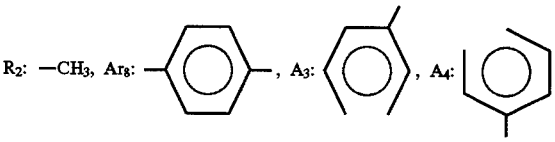

-continued
$Cp_{10}$, $Cp_{11}$ and $Cp_{12}$:
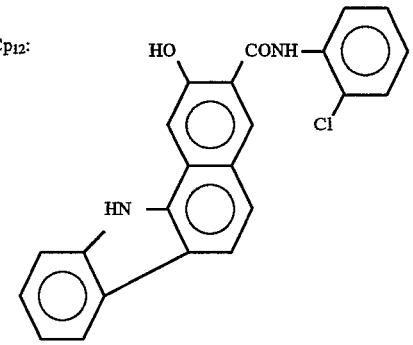
Pigment Example 4-18
$R_2$: $-CH_3$, $Ar_8$: 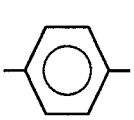 , $A_3$: 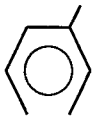 , $A_4$: 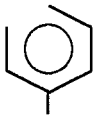
$Cp_{10}$: 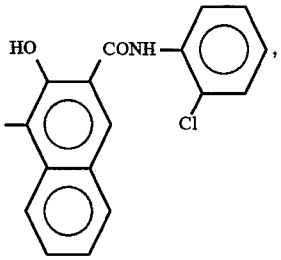 ,
$Cp_{11}$ and $Cp_{12}$:
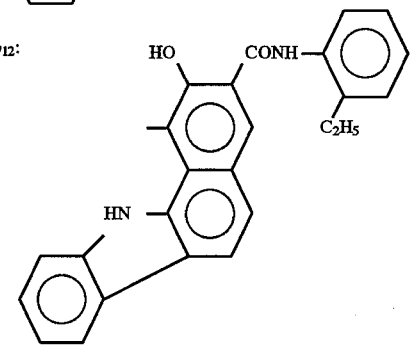
Pigment Example 4-19
$R_2$: $-CH_3$, $Ar_8$: 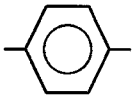 , $A_3$: 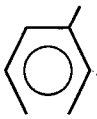 , $A_4$: 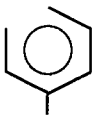
$Cp_{10}$: 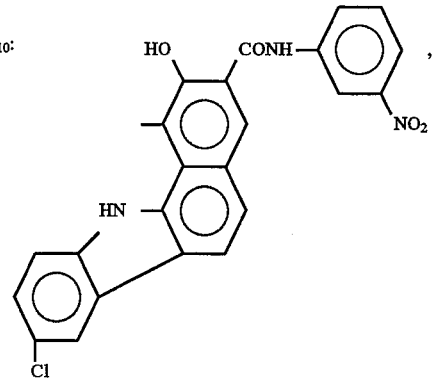 ,
-continued
$Cp_{11}$ and $Cp_{12}$:
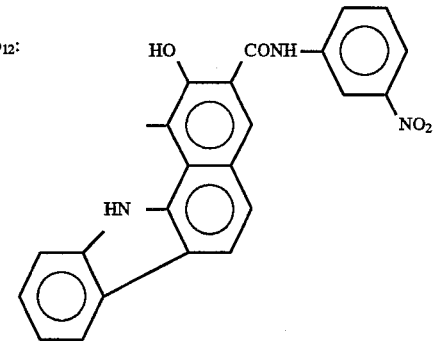
Pigment Example 4-20
$R_2$: $-CH_3$, $Ar_8$: 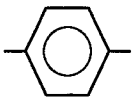 , $A_3$: 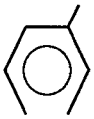 ,
$A_4$: 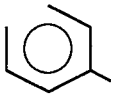
$Cp_{10}$ and $Cp_{11}$: 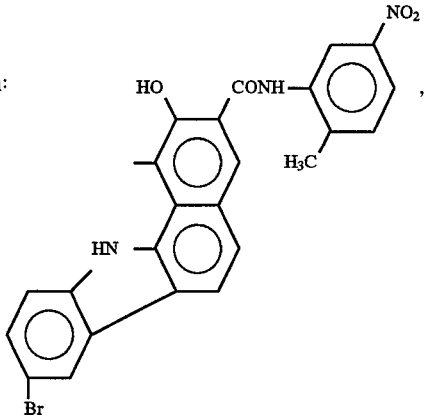 ,
$Cp_{12}$: 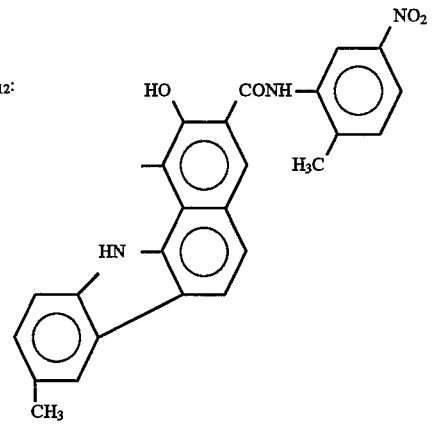
Pigment Example 4-21
$R_2$: $-CH_3$, $Ar_8$: 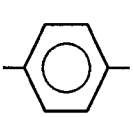 , $A_3$: 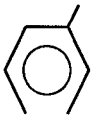 , $A_4$:
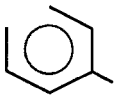
$Cp_{10}$ and $Cp_{11}$:
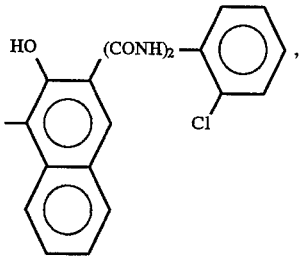
$Cp_{12}$:
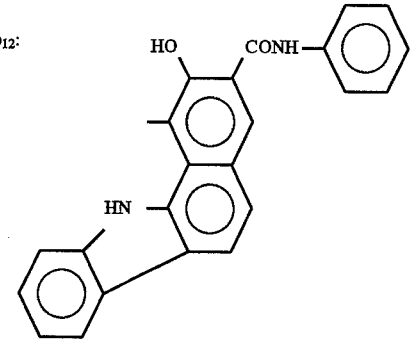
Pigment Example 4-22
$R_2$: —CN, $Ar_8$:
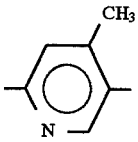
$A_3$:
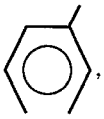
$A_4$:
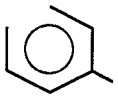
$Cp_{10}$, $Cp_{11}$ and $Cp_{12}$:
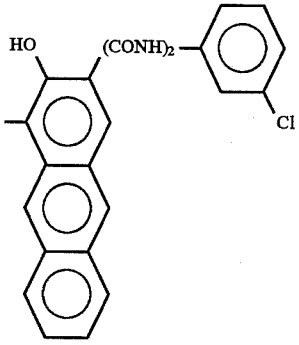
Pigment Example 4-23
$R_2$: —CN, $Ar_8$:
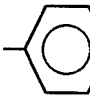
, $A_3$:
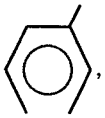
$A_4$:
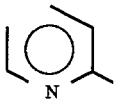
$Cp_{10}$, $Cp_{11}$ and $Cp_{12}$:
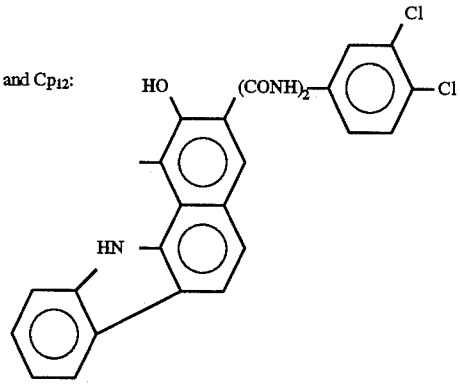
Pigment Example 4-24
$R_2$: $-C_2H_5$, $Ar_8$:
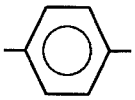
, $A_3$:
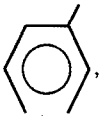
$A_4$:
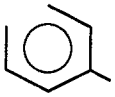
$Cp_{10}$, $Cp_{11}$ and $Cp_{12}$:
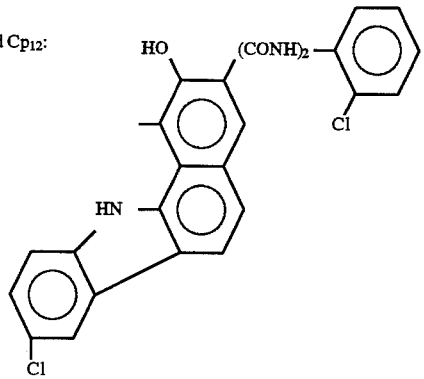
Pigment Example 4-25
$R_2$: —CN, $Ar_8$:
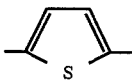
, $A_3$:
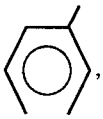
$A_4$:
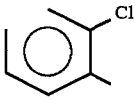
$Cp_{10}$:
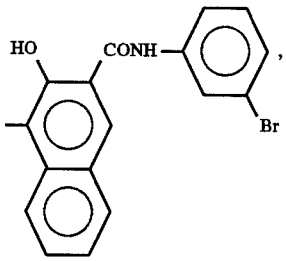

-continued
$Cp_{11}$:
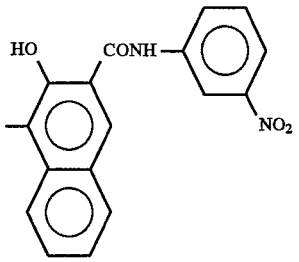
$Cp_{12}$:
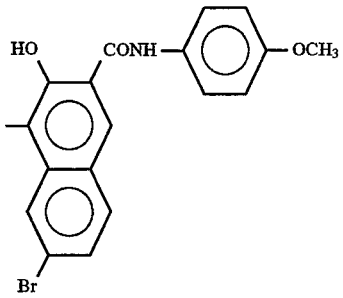
Pigment Example 4-26
$R_2$: —H, $Ar_8$:
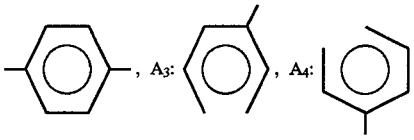
, $A_3$:
, $A_4$:
$Cp_{10}$, $Cp_{11}$ and $Cp_{12}$:
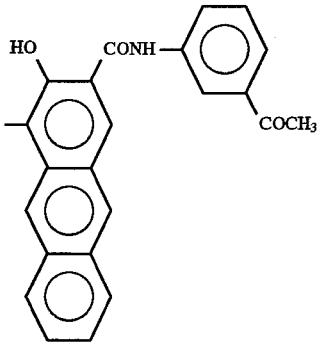
Pigment Example 4-27
$R_2$: —H, $Ar_8$:
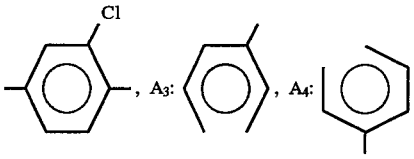
, $A_3$:
, $A_4$:
$Cp_{10}$, $Cp_{11}$ and $Cp_{12}$:
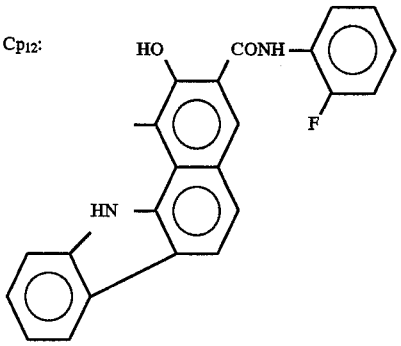
-continued
Pigment Example 4-28
$R_2$: —CN, $Ar_8$:
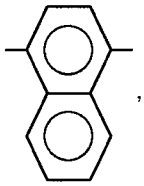
, $A_3$:
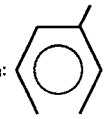
, $A_4$:
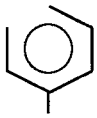
$Cp_{10}$, $Cp_{11}$ and $Cp_{12}$:
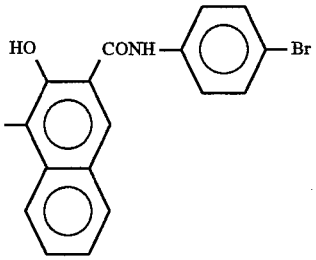
Pigment Example 4-29
$R_2$: —CN, $Ar_8$:
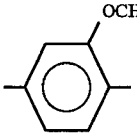
, $A_3$:
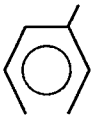
,
$A_4$:
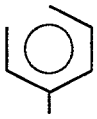
$Cp_{10}$, $Cp_{11}$ and $Cp_{12}$:
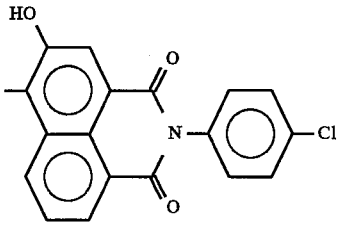
Basic Form 5
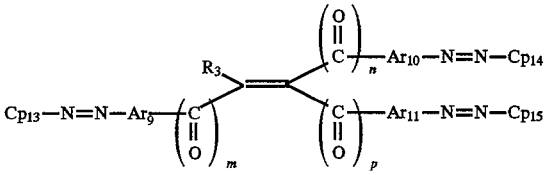
Pigment Example 5-1
$R_3$: —CN, $Ar_9$, $Ar_{10}$ and $Ar_{11}$:
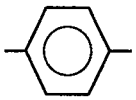
m: 0, n and p: 1
$Cp_{13}$, $Cp_{14}$ and $Cp_{15}$:
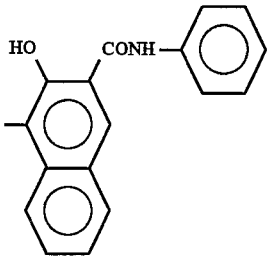

-continued

Pigment Example 5-2

$R_3$: —CN, $Ar_9$, $Ar_{10}$ and $Ar_{11}$: 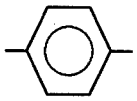

m: 0, n and p: 1

$Cp_{13}$, $Cp_{14}$ and $Cp_{15}$: 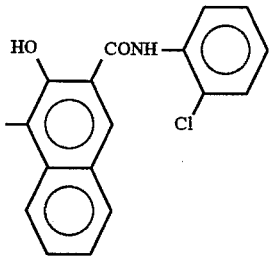

Pigment Example 5-3

$R_3$: —CN, $Ar_9$, $Ar_{10}$ and $Ar_{11}$: 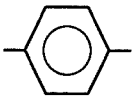

m: 0, n and p: 1

$Cp_{13}$, $Cp_{14}$ and $Cp_{15}$: 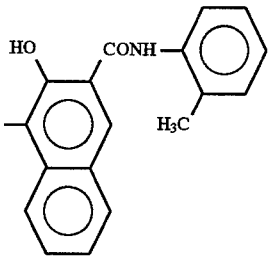

Pigment Example 5-4

$R_3$: —CN, $Ar_9$, $Ar_{10}$ and $Ar_{11}$: 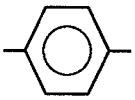

m: 0, n and p: 1

$Cp_{13}$, $Cp_{14}$ and $Cp_{15}$: 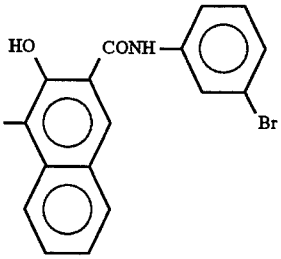

Pigment Example 5-5

$R_3$: —CN, $Ar_9$, $Ar_{10}$ and $Ar_{11}$: 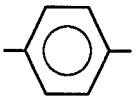

m: 0, n and p: 1

$Cp_{13}$, $Cp_{14}$ and $Cp_{15}$: 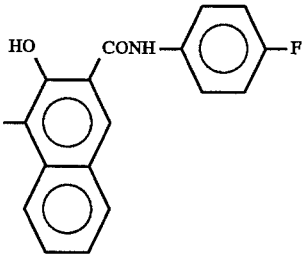

-continued

Pigment Example 5-6

$R_3$: —CN, $Ar_9$, $Ar_{10}$ and $Ar_{11}$: 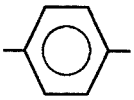

m: 0, n and p: 1

$Cp_{13}$, $Cp_{14}$ and $Cp_{15}$: 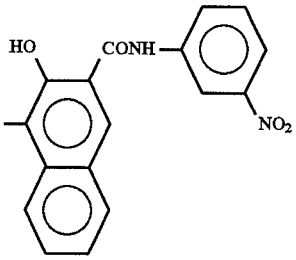

Pigment Example 5-7

$R_3$: —$CH_3$, $Ar_9$, $Ar_{10}$ and $Ar_{11}$: 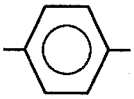

m: 0, n and p: 1

$Cp_{13}$, $Cp_{14}$ and $Cp_{15}$: 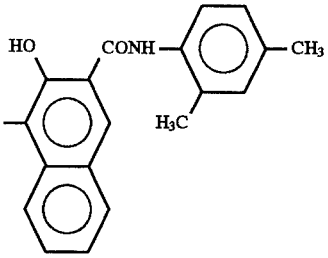

Pigment Example 5-8

$R_3$: —$CH_3$, $Ar_9$, $Ar_{10}$ and $Ar_{11}$: 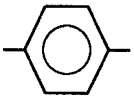

m: 0, n and p: 1

$Cp_{13}$, $Cp_{14}$ and $Cp_{15}$: 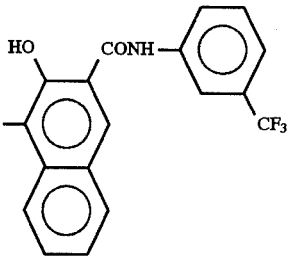

Pigment Example 5-9

$R_3$: —CN, $Ar_9$, $Ar_{10}$ and $Ar_{11}$: 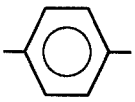

m: 0, n and p: 1

$Cp_{13}$, $Cp_{14}$ and $Cp_{15}$: 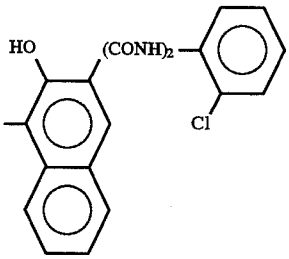

-continued

Pigment Example 5-10

$R_3$: —H, $Ar_9$, $Ar_{10}$ and $Ar_{11}$:

m: 0, n and p: 1

$Cp_{13}$, $Cp_{14}$ and $Cp_{15}$:

Pigment Example 5-11

$R_3$: —CN, $Ar_9$, $Ar_{10}$ and $Ar_{11}$:

m: 0, n and p: 1

$Cp_{13}$, $Cp_{14}$ and $Cp_{15}$:

Pigment Example 5-12

$R_3$: —CN, $Ar_9$, $Ar_{10}$ and $Ar_{11}$:

m: 0, n and p: 2

$Cp_{13}$, $Cp_{14}$ and $Cp_{15}$:

Pigment Example 5-13

$R_3$: —CN, $Ar_9$, $Ar_{10}$ and $Ar_{11}$:

m: 0, n and p: 1

$Cp_{13}$:

-continued $Cp_{14}$ and $Cp_{15}$:

Pigment Example 5-14

$R_3$: —CN, $Ar_9$, $Ar_{10}$ and $Ar_{11}$:

m: 0, n and p: 1

$Cp_{13}$, $Cp_{14}$ and $Cp_{15}$:

Pigment Example 5-15

$R_3$: —$CH_3$, $Ar_9$, $Ar_{10}$ and $Ar_{11}$:

m: 0, n and p: 1

$Cp_{13}$, $Cp_{14}$ and $Cp_{15}$:

Pigment Example 5-16

$R_3$: —$CH_3$, $Ar_9$, $Ar_{10}$ and $Ar_{11}$:

m: 0, n and p: 1

$Cp_{13}$, $Cp_{14}$ and $Cp_{15}$:

Pigment Example 5-17

$R_3$: —$C_2H_5$, $Ar_9$, $Ar_{10}$ and $Ar_{11}$:

-continued
m: 0, n and p: 1
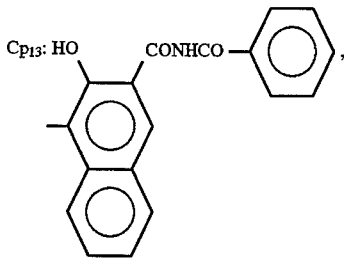
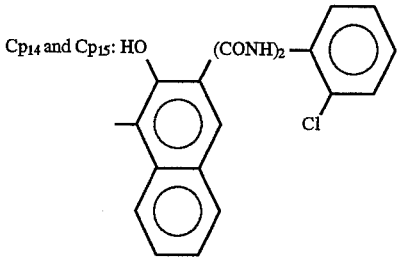
Pigment Example 5-18
R3: —C2H5, Ar9, Ar10 and Ar11: 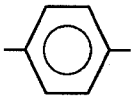
m: 0, n and p: 1
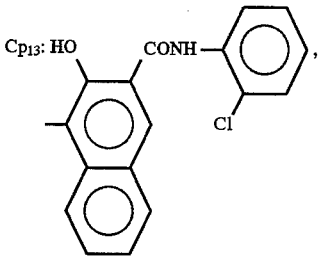
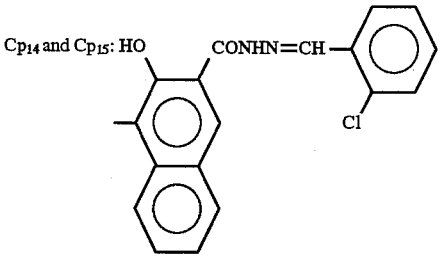
Pigment Example 5-19
R3: —CN, Ar9, Ar10 and Ar11: 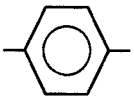
m: 0, n and p: 1
-continued
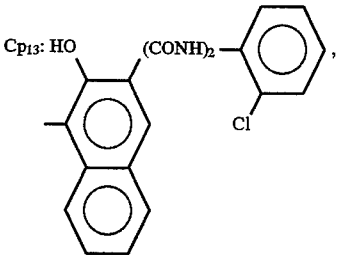
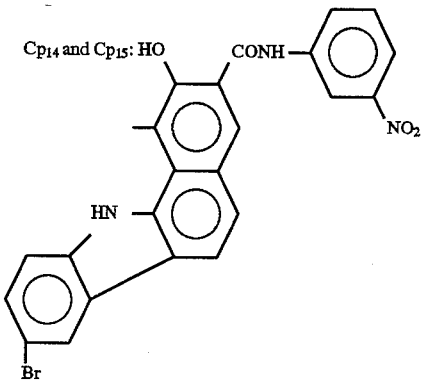
Pigment Example 5-20
R3: —CN, Ar9, Ar10 and Ar11: 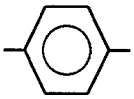
m: 0, n and p: 1
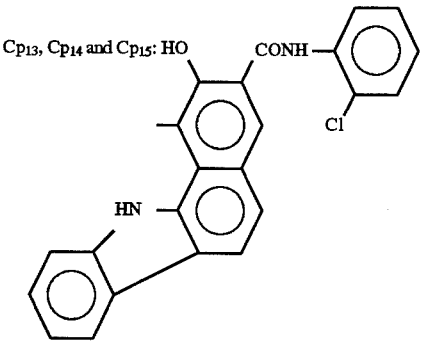
Pigment Example 5-21
R3: —CN, Ar9, Ar10 and Ar11: 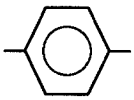
m: 0, n and p: 1

-continued
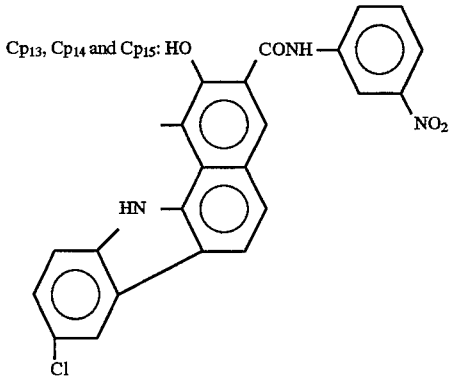
Pigment Example 5-22
$R_3$: —CN, $Ar_9$: 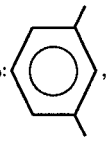 ,
$Ar_{10}$ and $Ar_{11}$: 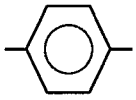
m: 0, n and p: 1
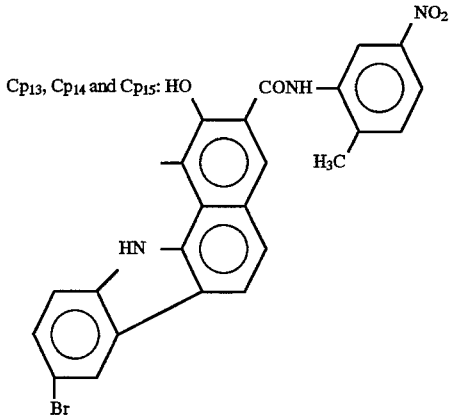
Pigment Example 5-23
$R_3$: —CN, $Ar_9$: 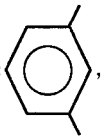 ,
$Ar_{10}$ and $Ar_{11}$: 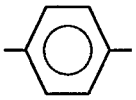
m: 0, n and p: 1
-continued
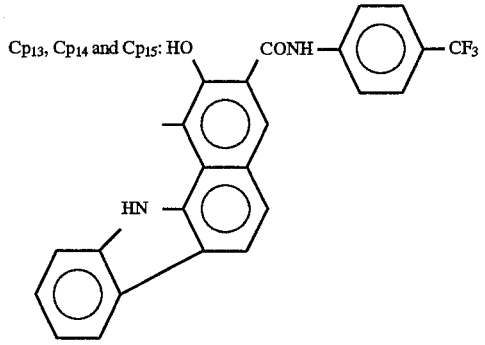
Pigment Example 5-24
$R_3$: —CN, $Ar_9$, $Ar_{10}$ and $Ar_{11}$: 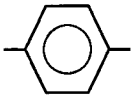
m: 0, n and p: 1
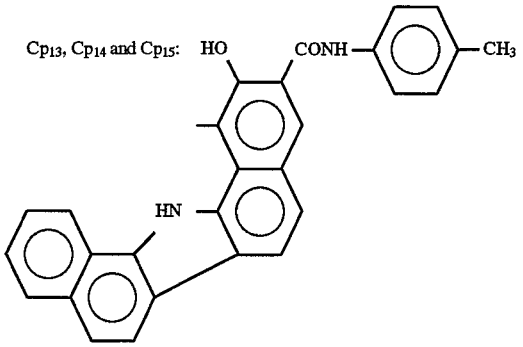
Pigment Example 5-25
$R_3$: —CN, $Ar_9$, $Ar_{10}$ and $Ar_{11}$: 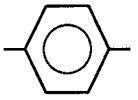
m: 0, n and p: 1
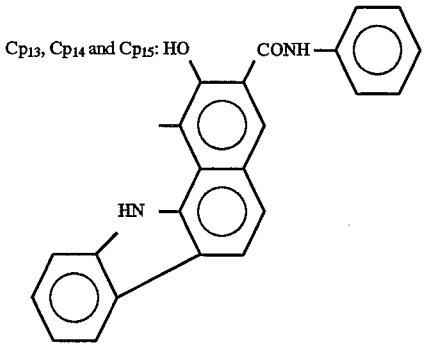
Pigment Example 5-26
$R_3$: —CN, $Ar_9$, $Ar_{10}$ and $Ar_{11}$: 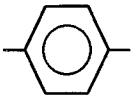
m: 0, n and p: 1

-continued $Cp_{13}$: HO CONH —

$Cp_{14}$ and $Cp_{15}$: HO CONH

HN

Pigment Example 5-27

$R_3$: —CN, $Ar_9$, $Ar_{10}$ and $Ar_{11}$:

m: 0, n and p: 1

$Cp_{13}$: HO CONH — $CH_3$, $Cp_{14}$ and $Cp_{15}$: HO CONH — Cl Cl

HN

Pigment Example 5-28

$R_3$: —$CH_3$, $Ar_9$, $Ar_{10}$ and $Ar_{11}$:

m: 0, n and p: 1

-continued $Cp_{13}$: HO CONH — Cl $Cp_{14}$: HO

O N O $Cp_{15}$: HO

O N — Cl O

Pigment Example 5-29

$R_3$: —$CH_3$, $Ar_9$, $Ar_{10}$ and $Ar_{11}$:

m: 0, n and p: 1

$Cp_{13}$, $Cp_{14}$ and $Cp_{15}$:

HO

O N — N $CH_3$ $CH_3$ O

Pigment Example 5-30

$R_3$: —H, $Ar_9$, $Ar_{10}$ and $Ar_{11}$:

m: 0, n and p: 2

$Cp_{13}$, $Cp_{14}$ and $Cp_{15}$:

HO

N N O

-continued
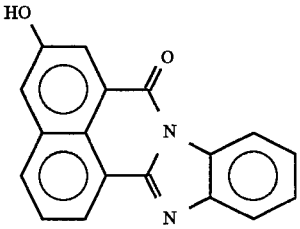
Pigment Example 5-31
$R_3$: —CN, $Ar_9$, $Ar_{10}$ and $Ar_{11}$: 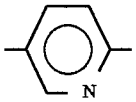
m: 0, n and p: 0
$Cp_{13}$: 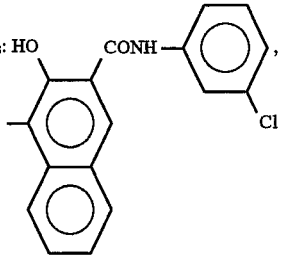
$Cp_{14}$: 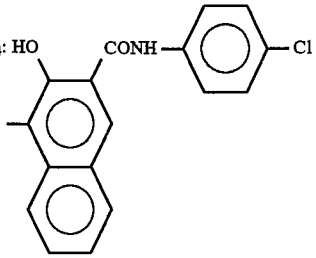
$Cp_{15}$: 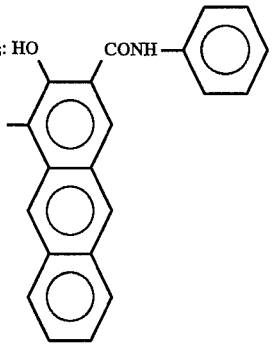
Pigment Example 5-32
$R_3$: —CN, $Ar_9$: 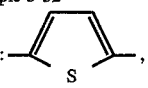 , $Ar_{10}$ and $Ar_{11}$: 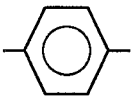
m: 0, n and p: 2
$Cp_{13}$, $Cp_{14}$ and $Cp_{15}$: 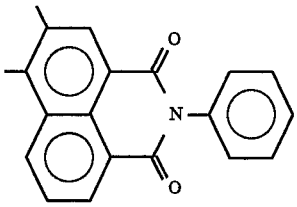
-continued
Pigment Example 5-33
$R_3$: —$CH_3$, $Ar_9$, $Ar_{10}$ and $Ar_{11}$: 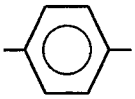
m: 0, n and p: 1
$Cp_{13}$, $Cp_{14}$ and $Cp_{15}$: 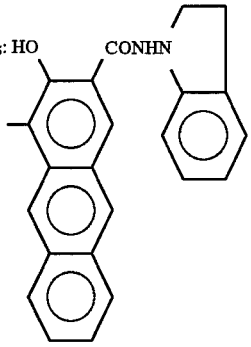
Pigment Example 5-34
$R_3$: —$CHCF_3$, $Ar_9$: 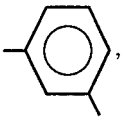 ,
$Ar_{10}$ and $Ar_{11}$: 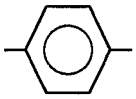
n and p: 1
$Cp_{13}$, $Cp_{14}$ and $Cp_{15}$: 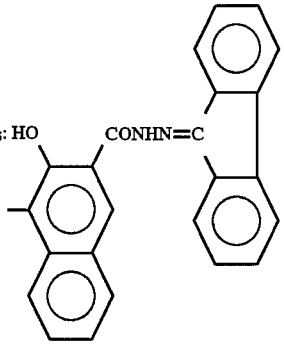
Pigment Example 5-35
$R_3$: —CN, $Ar_9$: 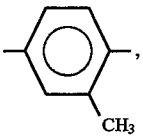 ,
$Ar_{10}$ and $Ar_{11}$: 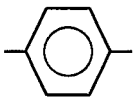
m: 0, n and p: 1

-continued

Cp13 and Cp14:

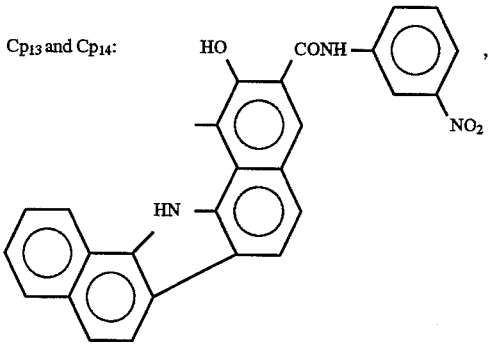

Cp15: HO

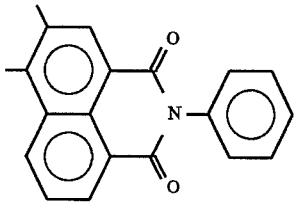

The azo pigment to be used in the present invention can easily be synthesized in such a manner that the corresponding triamine is formed into a hexazo form by a known method; and the hexazonium salt obtained and the corresponding coupler are coupled in an aqueous system in the presence of alkali; or in such a manner that the hexazonium salt is converted into borofluoride salt or zinc chloride double salt, and then the salt is coupled with the corresponding coupler in an organic solvent of N, N-dimethylformamide or dimethylsulfoxide in the presence of a base, such as sodium acetate, triethylamine or N-methylmorpholine. The azo pigment having different coupler residual groups in one molecule thereof can be synthesized by sequentially coupling each coupler. The sequential coupling method is exemplified by a method in which the number of the couplers with respect to the number of the azo groups is adjusted, a method which uses the difference in the coupler reaction speed, and a method in which a portion of the azo groups is temporarily protected by, for example, acetyl groups.

Synthesis Example 1 (Synthesis of Pigment Example 1-1)

150 ml of water, 20 ml (0.23 mol) of concentrated sulfuric acid and 11.85 g (0.032 mol) of the following triamine compound were charged into a 300 ml beaker:

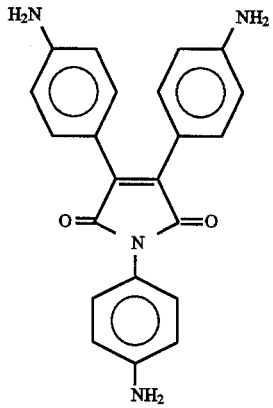

The temperature of the solution was then lowered to 0° C. A solution, in which 7.0 g (0.102 mol) of sodium nitrite was dissolved in 10 ml of water, was dripped into the foregoing solution over a period of 10 minutes while the temperature of the solution was maintained at 5° C. After the solution was stirred for 15 minutes, filtration using a carbon sheet was performed, and a solution in which 15.8 g (0.144 mol) of sodium borofluoride was dissolved in 120 ml of water was, while being stirred, dripped into the solution obtained. Deposited borofluoride salt was collected by filtration followed by cleaning the salt with cold water and acetonitrile. Then, the borofluoride salt was dried under reduced atmospheric pressure at room temperature. The yield was 15.79 g and the yield was 74%.

Then, 500 ml of dimethylformamide was charged into a 1 l beaker, and 10.97 g (0.042 mol) of the following coupler was dissolved:

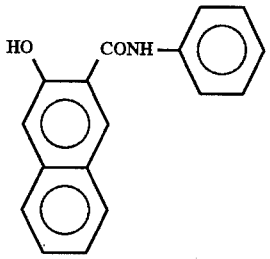

The temperature of the solution was then lowered to 5° C., and 9.34 g (0.014 mol) of the foregoing borofluoride salt was dissolved in the solution. Then, 4.7 g (0.046 mol) of triethylamine was dripped into the solution over a period of 5 minutes. The solution was stirred for 2 hours, and the deposited pigment was collected by filtering. The pigment was cleaned four times with dimethyl formamide and three times with water, and was freeze-dried. The yield was 13.06 g and the yield was 78%. The results of analysis of the elements are shown below:

| | Estimated Value (%) | Result of Measurement (%) |
|---|---|---|
| C | 73.29 | 72.99 |
| H | 4.29 | 4.10 |
| N | 11.71 | 11.98 |

Synthesis Example 2 (Synthesis of Pigment Example 2-2)

An azo pigment, pigment example 2-2, was synthesized by the same method as that employed in the synthesis of example 1 except that 11.76 g (0.032 mol) of a compound represented by the following formula was used as the triamine compound and 12.50 g (0.042 mol) of 2-hydroxy-3-naphthoic acid-2'-chloroanilide was used as the coupler.

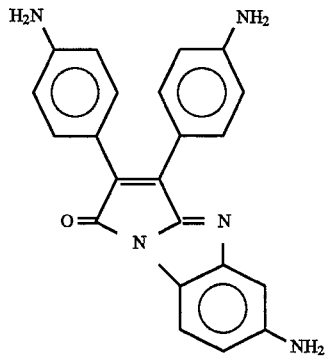

The yield of the borofluoride salt was 13.50 g and the ratio of the yield was 65%. The yield of the azo pigment was 14.50 g and the yield was 80%. The results of analysis of the elements are shown below:

| | Estimated Value (%) | Result of Measurement (%) |
|---|---|---|
| C | 67.78 | 67.15 |
| H | 3.43 | 3.39 |
| N | 11.91 | 11.75 |

Synthesis Example 3 (Synthesis of Pigment Example 3-1)

An azo pigment, pigment example 3-1, was synthesized by the same method as that employed in the synthesis of example 1 except that 12.56 g (0.032 mol) of a compound represented by the following formula was used as the triamine compound.

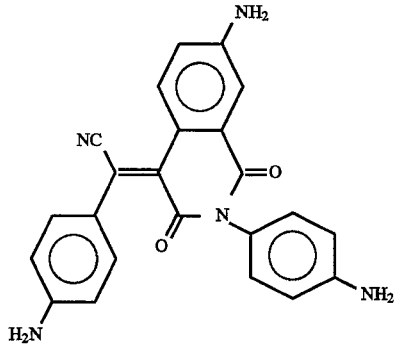

The yield of the borofluoride salt was 19.96 g and the yield was 92%. The yield of the azo pigment was 14.64 g and the yield was 90%. The results of analysis of the elements are shown below:

| | Estimated Value (%) | Result of Measurement (%) |
|---|---|---|
| C | 76.47 | 76.25 |
| H | 4.08 | 4.20 |
| N | 8.44 | 8.59 |

Synthesis Example 4 (Synthesis of Pigment Example 4-1)

An azo pigment, pigment example 4-1, was synthesized by the same method as that employed in the synthesis of example 2 except that 12.56 g (0.032 mol) of a compound represented by the following formula was used as the triamine compound.

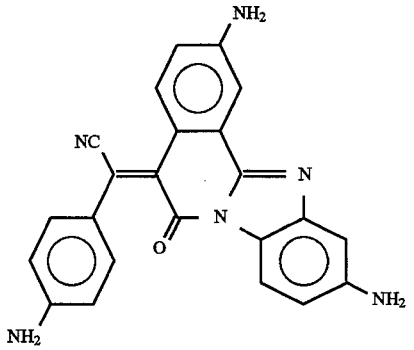

The yield of the borofluoride salt was 19.90 g and the ratio of the yield was 55%. The yield of the azo pigment was 11.5 g and the yield was 62%. The results of analysis of the elements are shown below:

| | Estimated Value (%) | Result of Measurement (%) |
|---|---|---|
| C | 67.40 | 67.15 |
| H | 3.29 | 3.42 |
| N | 12.75 | 12.95 |

Synthesis Example 5 (Synthesis of Pigment Example 5-1)

An azo pigment, pigment example 5-1, was synthesized by the same method as that employed in the synthesis of example 1 except that 12.24 g (0.032 mol) of a compound represented by the following formula was used as the triamine compound.

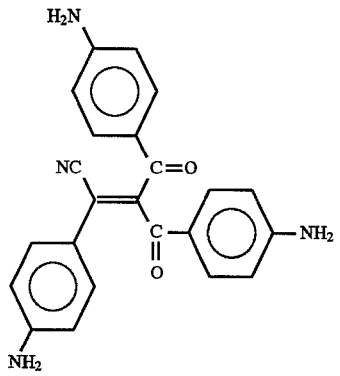

The yield of the borofluoride salt was 12.49 g and the ratio of the yield was 58%. The yield of the azo pigment was 15.34 g and the yield was 90%. The results of analysis of the elements are shown below:

| | Estimated Value (%) | Result of Measurement (%) |
|---|---|---|
| C | 73.01 | 72.32 |
| H | 4.97 | 5.23 |
| N | 11.51 | 12.00 |

The photosensitive layer of the electrophotographic photosensitive member according to the present invention may be any of the known types. It is preferable to employ a function-separated-type photosensitive layer having a charge generating layer containing the azo pigment according to the present invention and a charge transporting layer containing a charge transporting material on the charge generating layer.

The charge generating layer can be formed by vacuum-evaporating the azo pigment according to the present invention on a conductive substrate. Alternatively, it can be formed by applying a solution in which the azo pigment according to the present invention is, together with an appropriate binder resin, dispersed in an appropriate solvent by a known method to a conductive substrate. The thickness of the charge generating layer is preferably 5 μm or less and more preferably 0.1 to 1 μm.

The binder resin is selected from various insulating resin or organic photoconductive polymers such as polyvinyl butyral, polyvinyl benzal, polyarylate, polycarbonate, polyester, phenoxy resin, cellulose resin, acrylic resin or polyurethane resin. The resin may have a substituent exemplified by a halogen atom, an alkyl group, an alkoxy group, a nitro group, a trifluoromethyl group or a cyano group. It is preferable that the quantity of the binder resin be 80 wt % or less of the total weight of the charge generating layer and more preferably 40 wt % or less.

It is preferable that the solvent be a material of a type that dissolves the foregoing resin, but does not dissolve a charge transporting layer and an undercoating layer to be described later. Specifically, any of the following solvents is selected: ethers such as tetrahydrofuran and 1,4-dioxane; ketones such as cyclohexane and methylethyl ketone; amides such as N,N-dimethylformamide; esters such as methyl acetate and ethyl acetate; aromatic hydrocarbon compounds such as toluene, xylene and monochlorobenzene; alcohols such as methanol, ethanol and 2-propanol; and aliphatic hydrocarbon compounds such as chloroform and methylene chloride.

The charge transporting layer is laminated on or under the charge generating layer and performs a function of receiving charge carriers from the charge generating layer in the presence of an electric field and of transporting the charge carriers. The charge transporting layer can be formed by applying and drying a solution in which the charge transporting material is, together with an appropriate binder resin, dissolved in a solvent. The thickness of the charge transporting layer is preferably 5 to 40 μm and more preferably 15 to 30 μm.

The charge transporting materials are classified as electron transporting materials and positive hole transporting materials. The electron transporting material is exemplified by electron absorbing materials such as 2,4,7-trinitrofluorenone, 2,4,5,7-tetranitrofluorenone, chloranil, or tetracyanoquinodimethane; and polymers of the foregoing electron absorbing materials. The positive hole transporting material is exemplified by polycyclic aromatic compounds such as pyrene or anthracene; heterocyclic compounds such as carbazole type, indole type, imidazole type, oxazole type, thiazole type, oxadiazole type, pyrazole type, pyrazoline type, thiadiazole type or triazole type compound; hydrazone compounds such as p-diethylaminobenzaldehyde-N,N-diphenyl hydrazone, or N,N-diphenylhydrazino-3-methylidene-9-ethylcarbazole; styryl compounds such as α-phenyl-4'-N,N-diphenyl aminostilbene or 5-[4-(di-p-tolyllamino)benzilidene]-5H-dibenzo[a,d]cycloheptene; benzidine compounds; triarylmethane compounds; triphenylamine compounds; and a polymer (for example, poly-N-vinylcarbazole and polyvinyl anthrathene) having, in the main or side chain thereof, a group induced from the foregoing compounds. In addition to the foregoing organic charge transporting materials, inorganic materials, such as selenium, selenium-tellurium, amorphous silicon or cadmium sulfide may be used. The foregoing charge transporting materials may be used singly or two or more materials may be used in combination.

If the charge transporting material has little or no film-forming properties, an appropriate binder resin may be used. Specifically, any of the following resins may be used: insulating resins such as acrylic resin, polyarylate, polyester, polycarbonate, polystyrene, acrylonitrile-styrene copolymer, polyacrylamide, polyamide or chlorinated rubber; or organic photoconductive polymer such as poly-N-vinyl carbazole or polyvinyl anthracene. It is preferable that the quantity of the binder resin be 20 to 90 wt % or less of the total weight of the charge transporting layer and more preferably 40 to 70 wt %.

Another aspect of the present invention may be employed which has a structure having a photosensitive layer containing, in the same layer, the azo pigment according to the present invention and the foregoing charge transporting material. In this case, the charge transporting material may be a charge transporting complex, such as poly-N-vinylcarbazole and trinitrofluorenone. The electrophotographic photosensitive member can be prepared by dispersing and dissolving the azo pigment and the charge transporting material in an appropriate binder resin solution, by applying the solution on a conductive substrate, and then by drying it. It is preferable that the quantity of the binder resin be 20 to 90 wt % of the total weight of the photosensitive layer, preferably 40 to 70 wt %. The thickness is preferably 5 to 40 μm, preferably 15 to 30 μm.

Any of the electrophotographic photosensitive members may contain two or more types of the azo pigments according to the present invention or may contain a known charge generating material together with the foregoing azo pigment.

The conductive substrate according to the present invention may be made of aluminum, aluminum alloy, copper, zinc, stainless steel, vanadium, molybdenum, chromium, titanium, nickel, indium, gold or platinum. Any of the following may also be employed: a plastic (polyethylene, polypropylene, polyvinyl chloride, polyethylene terephthalate or acryl resin) substrate having a film formed by vacuum-evaporating the foregoing metal or alloy; a substrate manufactured by disposing a layer containing an appropriate binder and conductive particles (for example, carbon black or silver particles) dispersed therein on the foregoing plastic, a metal or alloy substrate; or a substrate manufactured by impregnating plastic or paper member with conductive particles. The conductive substrate may have a drum, sheet or belt shape. It is preferable that the shape be formed to be optimally adaptable to the corresponding electrophotographic apparatus.

In the present invention, an undercoating layer having a barrier function and an adhesion function may be provided between the conductive substrate and the photosensitive layer. It is preferable that the thickness of the undercoating layer be 5 μm or less, more preferably 0.1 to 3 μm. The undercoating layer may be formed of any of the following materials: casein, polyvinyl alcohol, nitrocellulose, polyamide (nylon 6, nylon 66, nylon 610, copolymer nylon or alkoxy methylated nylon), polyurethane or aluminum oxide.

In order to protect the photosensitive layer from adverse external mechanical or chemical influences, a protective layer may be provided on the photosensitive layer. The protective layer is a resin layer or a resin layer containing conductive particles or the charge transporting material.

The electrophotographic photosensitive member according to the present invention can be used widely in electrophotographic fields, for example, in a laser beam printer, a CRT printer, an LED printer, a liquid crystal printer, a laser plate-making apparatus or a facsimile machine, as well as use in the electrophotographic copying machine.

FIG. 1 illustrates an example of a schematic structure of an electrophotographic apparatus having the process cartridge with the electrophotographic photosensitive member according to the present invention.

Referring to FIG. 1, a drum type electrophotographic photosensitive member 1 according to the present invention is rotatable around a shaft 2 in the direction indicated by the arrow at a predetermined circumferential speed. During rotation, the electrophotographic photosensitive member 1 is, on the surface thereof, uniformly charged with positive or negative predetermined potential by a primary charging means 3. Then, the electrophotographic photosensitive member 1 is irradiated with image exposing light 4 emitted from a slit or laser beam scanning image exposing means (not shown). Thus, an electrostatic latent image is gradually formed on the surface of the electrophotographic photosensitive member 1.

The formed electrostatic latent image is developed into a toner image by a developing means 5, and the developed toner image is, by a transfer means 6, gradually transferred on to a transferring material 7 fed from a paper feeder (not shown) to a space between the electrophotographic photosensitive member 1 and the transfer means 6, the transportation of the transferring material 7 being performed in synchronization with the rotation of the electrophotographic photosensitive member 1.

The transferring material 7 having the image transferred thereto is separated from the surface of the electrophotographic photosensitive member 1 and introduced into an image fixing means 8 so that the image is fixed. Thus, a copy of the image is printed and made available externally of the apparatus.

The surface of the electrophotographic photosensitive member 1 is, after image transferring, subjected to a process of removing the residual toner by a cleaning means 9 so that the surface of the electrophotographic photosensitive member 1 is cleaned. Then, the electrophotographic photosensitive member 1 is discharged by pre-exposure light 10 emitted from a pre-exposing means (not shown). Thus, the electrophotographic photosensitive member 1 can be used repeatedly. In the case where the primary charging means 3 is a contact charging means using a charging roller or the like, the pre-exposure step can be omitted.

In the present invention, a plurality of components may be integrated to form a process cartridge, the components being selected from a group consisting of the electrophotographic photosensitive member 1, the primary charging means 3, the developing means 5 and the cleaning means 9. The process cartridge is detachably mounted on the body of an electrophotographic apparatus such as a copying machine or a laser beam printer. For example, at least one of the primary charging means 3, the developing means 5 and the cleaning means 9 is integrated with the electrophotographic photosensitive member 1 to be formed into a process cartridge 11 that can be attached/detached from the apparatus body by using, for example, rails 12 disposed in the apparatus body.

In a case where the electrophotographic apparatus is a copying machine or a printer, image exposing light 4 is light reflected by or transmitted through an original document or light emitted due to the following steps: an original document is read by a sensor and the image of the original document is formed into signals; and then in response to such signals a laser beam is scanned, an LED array is operated or a liquid crystal shutter array is operated.

Figure 2:
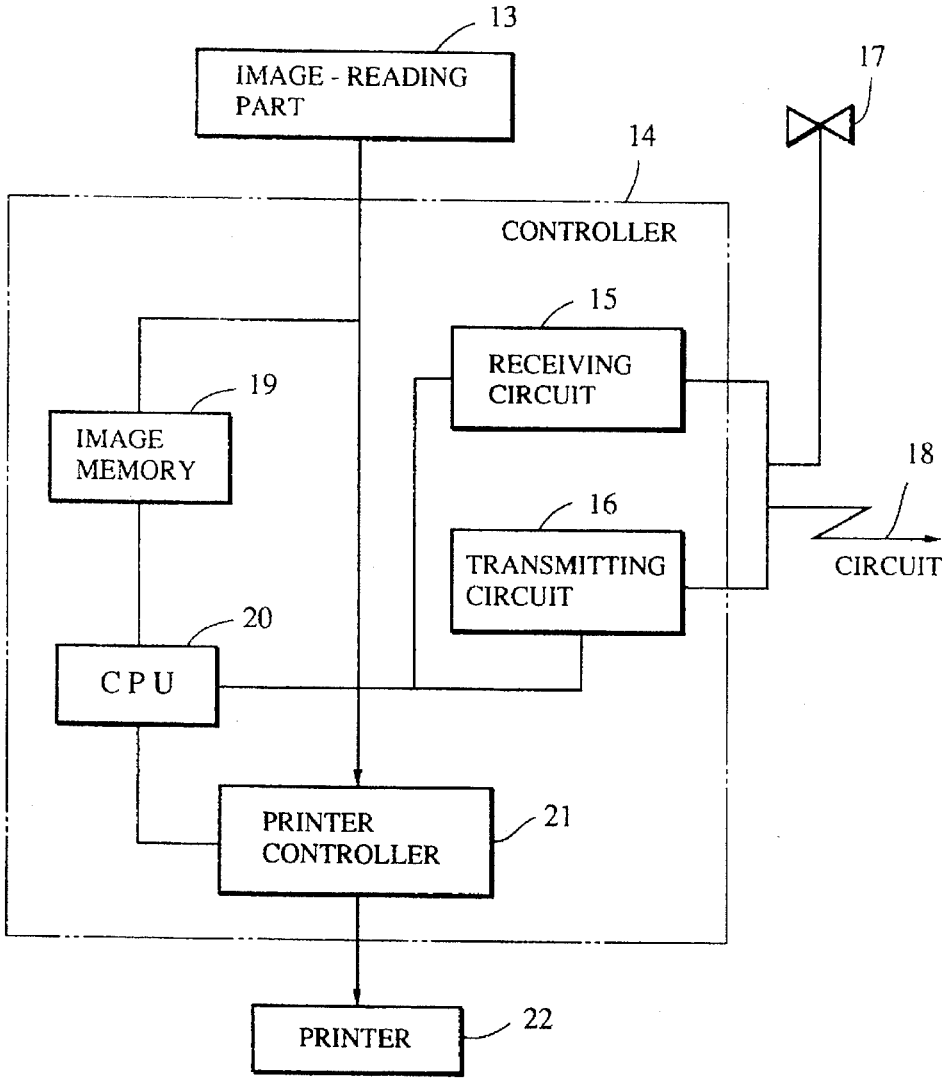
FIG. 2 illustrates an example of a block diagram of a facsimile machine having the electrophotographic photosensitive member according to the present invention.

If the electrophotographic apparatus is a printer for a facsimile machine, image exposing light 4 is exposing light for printing received data. FIG. 2 is a block diagram which illustrates an example of the foregoing structure.

A controller 14 controls an image-reading part 13 and a printer 22. The controller 14 is controlled by a CPU 20. Data read by the image-reading part 13 is transmitted to a connected station through a transmitting circuit 16. Data received from the connected station is supplied to the printer 22 through a receiving circuit 15. An image memory 19 stores a predetermined image data. A printer controller 21 controls the printer 22. Reference numeral 17 represents a telephone set.

An image (image information supplied from a remote terminal unit connected through a line) received from a line 18 is demodulated by the receiving circuit 15. Then, image information is decoded by the CPU 20 and sequentially stored in the image memory 19. When at least one page image has been stored in the image memory 19, the page image is printed or recorded. The CPU 20 reads image information for one page from the image memory 19 and transmits decoded image information for one page to the printer controller 21. When the printer controller 21 has received image information for one page from the CPU 20, the printer controller 21 controls the printer 22 to record image information for one page. The CPU 20 receives information of the next page during the printing operation performed by the printer 22.

Thus, an image is received and printed.

Examples of the present invention will now be described.

EXAMPLE 1

A solution, in which 5 g of methoxy methylated nylon (number average molecular weight of 32,000) and 10 g of alcohol-soluble copolymer nylon (number average molecular weight of 29,000) were dissolved in 95 g of methanol, was applied onto an aluminum substrate by using a wire bar and dried. Thus, an undercoating layer having a thickness of 1 μm was formed.

Then, 5 g of a pigment shown as Pigment Example 1-1 was added to a solution in which 2 g of polyvinyl butyral (butyralation degree of 63 mol %, a number average molecular polymerization degree of 2,000) was dissolved in 95 g of cyclohexane. Then, a sand mill was used to disperse the components for 20 hours. The dispersed solution was applied onto the undercoating layer by using a wire bar and dried. Thus, a charge generating layer having a thickness of 0.2 μm was formed.

Then, a solution in which 5 g of a hydrazone compound represented by the following formula:

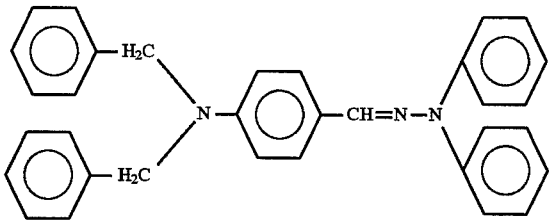

and 5 g of polymethylmethacrylate (a number average molecular weight of 100,000) were dissolved in 40 g of chlorobenzene, was applied onto the charge generating layer by using a wire bar and dried. Thus, a charge transporting layer having a thickness of 20 μm was formed.

The electrophotographic photosensitive member obtained was subjected to corona discharge of −5 KV by using an electrostatic copying paper testing apparatus (SP-428 manufactured by Kawaguchi Denki) to become negatively charged and was left in a dark place for one second. Then, the electrophotographic photosensitive member was exposed to light having an illuminance of 10 lux emitted from a halogen lamp so that its charging characteristics were evaluated. As the charging characteristics, the surface potential $V_0$ immediately after the charging operation and the exposure quantity, i.e., sensitivity ($E_{1/2}$), required to decay to half the surface potential after the electrophotographic photosensitive member being left in a dark place for one second, were measured. The results are shown in Table 1.

EXAMPLES 2 to 45

Electrophotographic photosensitive members were manufactured and evaluated as in Example 1, except for using the azo pigments shown in Table 1 in place of Pigment Example 1-1. The results are shown in Table 1.

| Example | Pigment Example | Vo (−V) | E ½ (lux sec) |
|---|---|---|---|
| 1 | 1-1 | 805 | 1.51 |
| 2 | 1-2 | 795 | 1.32 |
| 3 | 1-4 | 225 | 1.54 |
| 4 | 1-8 | 726 | 1.80 |
| 5 | 1-12 | 768 | 1.03 |
| 6 | 1-25 | 800 | 1.23 |
| 7 | 1-27 | 795 | 1.42 |
| 8 | 1-31 | 777 | 1.13 |
| 9 | 2-2 | 792 | 1.59 |
| 10 | 2-8 | 850 | 1.35 |
| 11 | 2-12 | 786 | 1.28 |
| 12 | 2-18 | 801 | 1.23 |
| 13 | 2-20 | 810 | 1.15 |
| 14 | 2-26 | 821 | 1.52 |
| 15 | 2-30 | 760 | 1.73 |
| 16 | 2-31 | 758 | 1.29 |
| 17 | 3-2 | 723 | 1.33 |
| 18 | 3-5 | 756 | 1.35 |
| 19 | 3-9 | 789 | 1.98 |
| 20 | 3-12 | 802 | 1.65 |
| 21 | 3-13 | 733 | 1.28 |
| 22 | 3-24 | 802 | 1.35 |
| 23 | 3-26 | 756 | 1.53 |
| 24 | 3-28 | 782 | 1.29 |
| 25 | 4-1 | 730 | 1.90 |
| 26 | 4-2 | 798 | 1.05 |
| 27 | 4-9 | 790 | 1.32 |
| 28 | 4-17 | 820 | 1.41 |
| 29 | 4-20 | 705 | 1.62 |
| 30 | 4-22 | 815 | 1.50 |
| 31 | 4-28 | 785 | 1.82 |
| 32 | 4-29 | 799 | 1.75 |
| 33 | 5-1 | 700 | 1.32 |
| 34 | 5-2 | 750 | 1.50 |
| 35 | 5-8 | 735 | 1.09 |
| 36 | 5-9 | 792 | 1.56 |
| 37 | 5-11 | 902 | 1.32 |
| 38 | 5-19 | 950 | 1.82 |
| 39 | 5-20 | 680 | 1.32 |
| 40 | 5-22 | 736 | 1.53 |
| 41 | 5-25 | 788 | 1.23 |
| 42 | 5-30 | 777 | 1.89 |
| 43 | 5-31 | 825 | 1.23 |
| 44 | 5-34 | 718 | 1.32 |
| 45 | 5-35 | 759 | 1.50 |

Comparative Examples 1 to 6

Electrophotographic photosensitive members were manufactured and evaluated as in Example 1 except for using the following comparative pigments A to F in place of Pigment Example 1-1. The results are shown in Table 2.

Comparative Pigment Example A (azo pigment disclosed in Japanese Patent Laid-Open No. 1-252966)
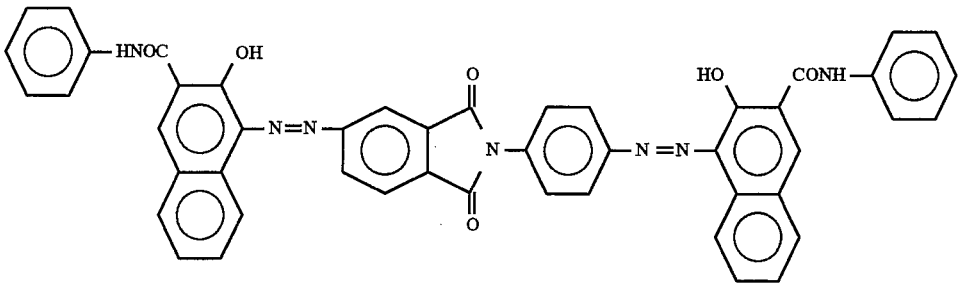
Comparative Pigment Example B (azo pigment disclosed in Japanese Patent Laid-Open No. 62-295062)
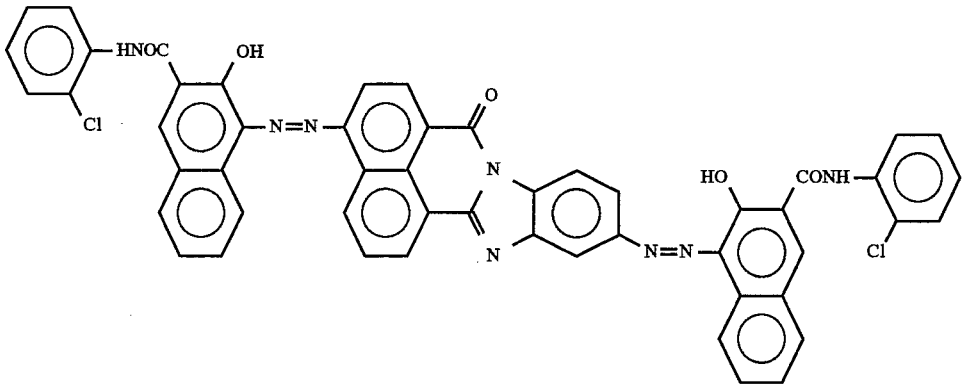
Comparative Pigment Example C
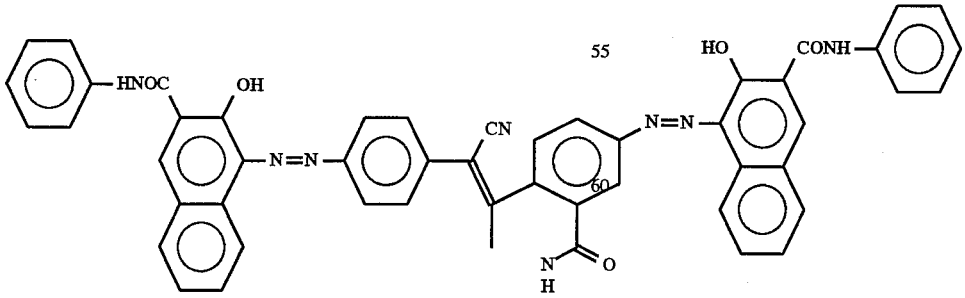

Comparative Pigment Example D (azo pigment disclosed in Japanese Patent Laid-Open No. 4-96068)
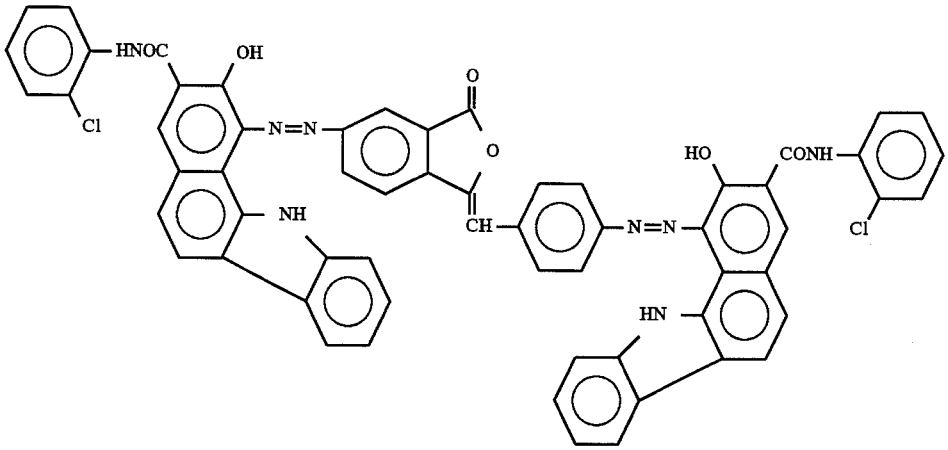
Comparative Pigment Example E (azo pigment disclosed in Japanese Patent Laid-Open No. 60-131539)
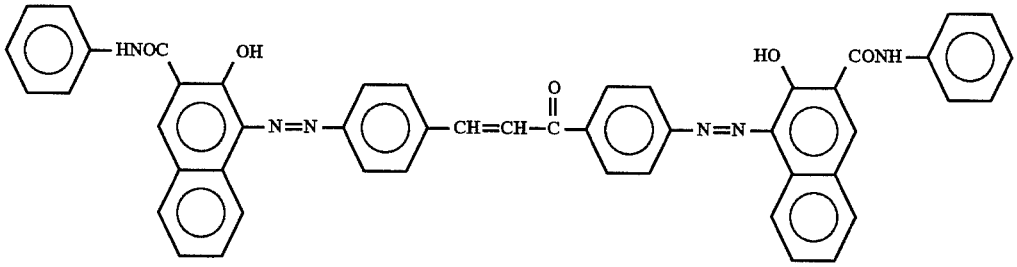
Comparative Pigment Example F (azo pigment disclosed in Japanese Patent Laid-Open No. 60-46561)
TABLE 2
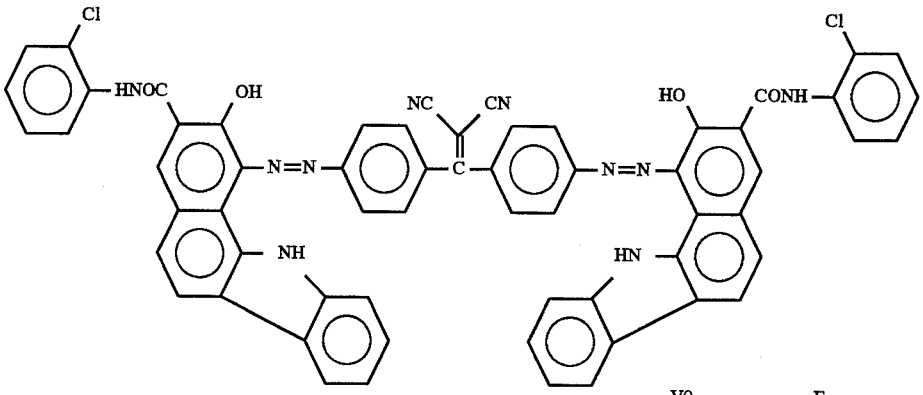
| Comparative Example | Comparative Pigment Example | V0 (−V) | $E_{1/2}$ (lux · sec) |
|---|---|---|---|
| 1 | A | 670 | 5.20 |
| 2 | B | 720 | 3.90 |
| 3 | C | 690 | 5.30 |
| 4 | D | 710 | 4.82 |
| 5 | E | 725 | 4.20 |
| 6 | F | 703 | 3.29 |
EXAMPLE 46

The electrophotographic photosensitive member manufactured in Example 2 was applied onto a cylinder of an electrophotographic copying apparatus comprising a −6.5 KV corona charger, an exposing optical system, a developing means, a transferring charger, a discharging exposing optical system and a cleaner.

The initial dark potential VD and light potential VL were each set to about −700 V and −200 V. The electrophotographic photosensitive member was used repeatedly 5,000 times to measure a changed quantity ΔVD in the dark part potential and a changed quantity ΔVL in the light part potential before and after repeated use in order to evaluate durability. The results are shown in Table 3. The negative sign of the changed quantity means that the absolute value of the potential was reduced, while the positive sign means that the absolute value of the potential was enhanced.

EXAMPLES 47 to 70

Electrophotographic photosensitive members were evaluated as in Example 46 except for using the electrophotographic photosensitive members manufactured similarly in Example 1 by using the azo pigments shown in Table 3 in place of the electrophotographic photosensitive member manufactured in Example 2. The results are shown in Table 3.

| Example | Pigment Example | $\Delta V_D$ (V) | $\Delta V_L$ (V) |
|---|---|---|---|
| 46 | 1-2 | +5 | +10 |
| 47 | 1-4 | 0 | +10 |
| 48 | 1-8 | −15 | −5 |
| 49 | 1-25 | 0 | +5 |
| 50 | 1-27 | 0 | +10 |
| 51 | 2-12 | −5 | −5 |
| 52 | 2-18 | 0 | +5 |
| 53 | 2-26 | +10 | +5 |
| 54 | 2-30 | 0 | −5 |
| 55 | 3-2 | −5 | +5 |
| 56 | 3-5 | +10 | 0 |
| 57 | 3-9 | 0 | +5 |
| 58 | 3-24 | +5 | +5 |
| 59 | 3-28 | 0 | +10 |
| 60 | 4-2 | +15 | 0 |
| 61 | 4-9 | 0 | +5 |
| 62 | 4-22 | 0 | 0 |
| 63 | 4-29 | 0 | +5 |
| 64 | 5-2 | −15 | +5 |
| 65 | 5-8 | −10 | 0 |
| 66 | 5-9 | −5 | 0 |
| 67 | 5-11 | −5 | +5 |
| 68 | 5-19 | −10 | +5 |
| 69 | 5-31 | +10 | 0 |
| 70 | 5-35 | −5 | 0 |

Comparative Examples 7 to 12

Electrophotographic photosensitive members were evaluated as in Example 46 except for using the electrophotographic photosensitive members manufactured in Comparative Examples 1 to 6 in place of the electrophotographic photosensitive member manufactured in Example 2. The results are shown in Table 4.

TABLE 4

| Comparative Example | Comparative Pigment | $\Delta V_D$ (V) | $\Delta V_L$ (V) |
|---|---|---|---|
| 7 | A | −35 | +35 |
| 8 | B | −55 | +30 |
| 9 | C | −80 | +25 |
| 10 | D | −65 | +30 |
| 11 | E | −35 | +40 |
| 12 | F | −110 | +30 |

EXAMPLE 71

A 0.5 μm thick undercoating layer of polyvinyl alcohol (number average molecular weight of 22,000) was formed on an aluminum surface evaporated onto a polyethylene terephthalate film.

5 g of the pigment shown as Pigment Example 1-4 was added to a solution in which 2 g of butyral resin (butyralation degree of 63 mol %, number average molecular polymerization degree of 2,000) was dissolved in 95 g of cyclohexane, the solution being dispersed for 20 hours by using a sand mill. The dispersed solution was applied onto the foregoing undercoating layer and dried. Thus, a charge generating layer having a thickness of 0.2 μm was formed.

Then, a solution in which 5 g of a stryl compound represented by the following formula:

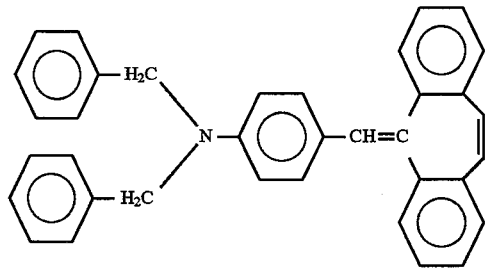

and 5 g of polycarbonate (number average molecular weight of 55,000) were dissolved in 40 g of tetrahydrofuran, was applied onto the charge generating layer and dried. Thus, a charge transporting layer having a thickness of 20 μm was formed.

The charging characteristics and the durability of the electrophotographic photosensitive member obtained were evaluated as in Examples 1 and 46. The results are shown in Table 5.

EXAMPLES 72 to 75

An electrophotographic photosensitive member was manufactured and evaluated as in Example 71 except for using the azo pigments shown in Table 5 in place of the azo pigment shown as Pigment Example 1-4. The results are shown in Table 5.

TABLE 5

| Example | Pigment Example | V0 (−V) | $E_{1/2}$ (lux · sec) | $\Delta V_D$ (V) | $\Delta V_L$ (V) |
|---|---|---|---|---|---|
| 71 | 1-4 | 818 | 1.85 | −5 | +10 |
| 72 | 2-12 | 770 | 1.35 | −5 | −5 |
| 73 | 3-9 | 823 | 2.09 | 0 | +15 |
| 74 | 4-2 | 790 | 1.19 | +5 | 0 |
| 75 | 5-9 | 760 | 1.60 | +5 | 0 |

EXAMPLES 76 to 80

An electrophotographic photosensitive member was manufactured and evaluated as in Examples 3, 11, 19, 25 and 34 except for forming the charge generating layer and the charge transporting layer in an inverse order. The polarity of charging was, however, made positive. The results are shown in Table 6.

TABLE 6

| Example | Pigment Example | Vo (V) | $E_{1/2}$ (lux · sec) |
|---|---|---|---|
| 76 | 1-4 | 763 | 2.22 |
| 77 | 2-18 | 790 | 2.21 |
| 78 | 3-9 | 820 | 2.50 |
| 79 | 4-1 | 850 | 2.23 |
| 80 | 5-2 | 693 | 1.53 |

EXAMPLE 81

An undercoating layer and a charge generating layer were formed as in Example 3.

Then, a solution in which 5 g of 2,4,7-trinitro-9-fluorenone and 5 g of polycarbonate (weight average molecular weight of 30,000) were dissolved in 50 g of tetrahydrofuran, was applied onto the charge generating layer using a wire bar and dried. Thus, a charge transporting layer having a thickness of 20 μm was formed.

The electrophotographic photosensitive member obtained was evaluated as in Example 1. The polarity of charging was, however, positive. The results are shown in Table 7.

EXAMPLE 82 to 85

An electrophotographic photosensitive member was manufactured and evaluated as in Example 81 except for forming the charge generating layer similarly to Examples 12, 19 and 25. However the thickness of the charge transporting layer according to Example 85 was 18 μm. The results are shown in Table 7.

TABLE 7

| Example | Pigment Example | Vo (V) | $E_{1/2}$ (lux · sec) |
|---|---|---|---|
| 81 | 1-4 | 779 | 2.90 |
| 82 | 2-18 | 783 | 2.53 |
| 83 | 3-9 | 698 | 3.01 |
| 84 | 4-1 | 802 | 3.53 |
| 85 | 5-2 | 702 | 2.35 |

EXAMPLE 86

0.5 g of an azo pigment shown as Pigment Example 1-2 was added to 9.5 g of cyclohexane and the mixture was dispersed by using a paint shaker for 5 hours. Then, a solution in which 5 g of the charge transporting material of Example 1 and 5 g of polycarbonate (weight average molecular weight of 80,000) were dissolved in 40 g of tetrahydrofuran, was added to the foregoing dispersed solution and further shaken for one hour. The solution obtained was applied onto an aluminum substrate using a wire bar and dried. Thus, a photosensitive layer having a thickness of 20 μm was formed. The electrophotographic photosensitive member obtained was evaluated as in Example 1. The charging polarity was, however, made positive. The results were shown in Table 8.

EXAMPLES 86 to 90

An electrophotographic photosensitive member was manufactured and evaluated as in Example 85 except for using the azo pigments shown in Table 8 in place of the azo pigment shown as Pigment Example 1-2. However the thickness of the charge transporting layer according to Example 90 was 16 μm. The results are shown in Table 8.

TABLE 8

| Example | Pigment Example | Vo (V) | $E_{1/2}$ (lux · sec) |
|---|---|---|---|
| 86 | 1-2 | 795 | 2.95 |
| 87 | 2-18 | 723 | 2.93 |
| 88 | 3-10 | 680 | 2.85 |
| 89 | 4-1 | 752 | 3.40 |
| 90 | 5-2 | 650 | 3.82 |

Although the invention has been described in its preferred form with a certain degree of particularity, it is to be understood that the present disclosure of the preferred form can be changed in details of construction and combination and arrangement of parts without departing from the spirit and scope of the invention as hereinafter claimed. The invention is therefore not to be limited except as set forth in the following claims:

What is claimed is:

1. An electrophotographic photosensitive member comprising a conductive substrate and a photosensitive layer on said conductive substrate, said photosensitive layer containing a charge transporting material and a charge generating material, said charge generating material comprising an azo pigment represented by at least one formula selected from the group consisting of formulas (1), (2), (3), (4) and (5) below:

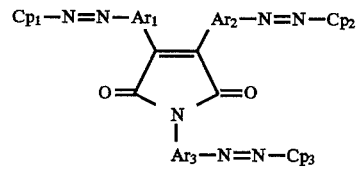

(1)

wherein $Ar_1$, $Ar_2$ and $Ar_3$ are the same or different and are each a substituted or unsubstituted aromatic hydrocarbon ring or a substituted or unsubstituted aromatic heterocyclic ring, and $Cp_1$, $Cp_2$ and $Cp_3$ are the same or different and are each a coupler residual group having a phenolic hydroxyl group:

(2)

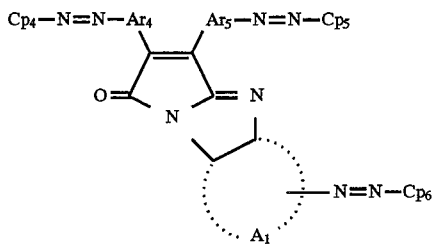

wherein $Ar_4$ and $Ar_5$ are the same or different and are each a substituted or unsubstituted aromatic hydrocarbon ring or a substituted or unsubstituted aromatic heterocyclic ring, $A_1$ is a residual group required to form a substituted or unsubstituted aromatic hydrocarbon ring or a substituted or unsubstituted aromatic heterocyclic ring with the carbon atoms in the formula above, and $Cp_4$, $Cp_5$ and $Cp_6$ are the same or different and are each a coupler residual group having a phenolic hydroxyl group:

(3)

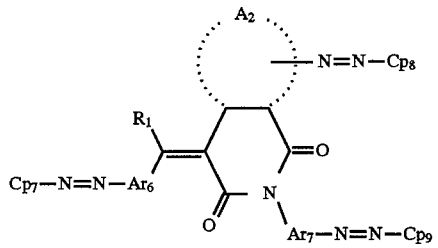

wherein $R_1$ is a hydrogen atom, a substituted or unsubstituted alkyl group or a cyano group, $Ar_6$ and $Ar_7$ are the same or different and are each a substituted or unsubstituted aromatic hydrocarbon ring or a substituted or unsubstituted aromatic heterocyclic ring, $A_2$ is a residual group required to form a substituted or unsubstituted aromatic hydrocarbon ring or a substituted or unsubstituted aromatic heterocyclic ring with the carbon atoms in the formula above, and $Cp_7$, $Cp_8$ and $Cp_9$ are the same or different and are each a coupler residual group having a phenolic hydroxyl group:

(4)

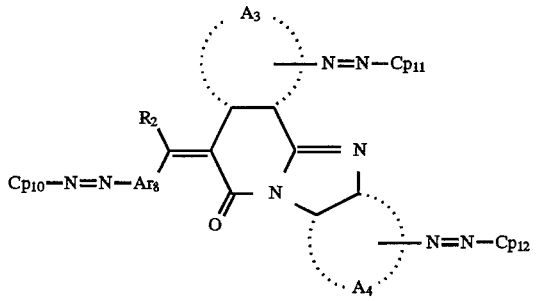

wherein $R_2$ is a hydrogen atom, a substituted or unsubstituted alkyl group or a cyano group, $Ar_8$ is the same or different and is a substituted or unsubstituted aromatic hydrocarbon ring or a substituted or unsubstituted aromatic heterocyclic ring, $A_3$ and $A_4$ are the same or different and are each a residual group required to form a substituted or unsubstituted aromatic hydrocarbon ring or a substituted or unsubstituted aromatic heterocyclic ring with the carbon atoms in the formula above, and $Cp_{10}$, $Cp_{11}$ and $Cp_{12}$ are the same or different and are each a coupler residual group having a phenolic hydroxyl group:

(5)

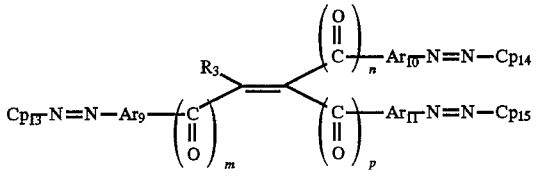

wherein $R_3$ is a hydrogen atom, a substituted or unsubstituted alkyl group or a cyano group, $Ar_9$, $Ar_{10}$ and $Ar_{11}$ are the same or different and are each a substituted or unsubstituted aromatic hydrocarbon ring or a substituted or unsubstituted aromatic heterocyclic ring, $Cp_{13}$, $Cp_{14}$ and $Cp_{15}$ are the same or different and are each a coupler residual group having a phenolic hydroxyl group, and m, n and p are the same or different and are each zero or a positive integer wherein m, n and p are not simultaneously zero.

2. An electrophotographic photosensitive member according to claim 1, wherein said azo pigment is represented by said formula (1).

3. An electrophotographic photosensitive member according to claim 1, wherein said azo pigment is represented by said formula (2).

4. An electrophotographic photosensitive member according to claim 1, wherein said azo pigment is represented by said formula (3).

5. An electrophotographic photosensitive member according to claim 1, wherein said azo pigment is represented by said formula (4).

6. An electrophotographic photosensitive member according to claim 1, wherein said azo pigment is represented by said formula (5).

7. An electrophotographic photosensitive member according to claim 1 or 2, wherein $Ar_1$ to $Ar_3$ are benzene rings.

8. An electrophotographic photosensitive member according to claim 1 or 3, wherein $Ar_4$ and $Ar_5$ are benzene rings, and Am is a residual group required to form a benzene ring with the carbon atoms in the formula above.

9. An electrophotographic photosensitive member according to claim 1 or 4, wherein $R_1$ is a hydrogen atom, a methyl group or a cyano group, $Ar_6$ is a benzene ring, $Ar_7$ is a benzene ring, a naphthalene ring or a pyridine ring, and $A_2$ is a residual group required to form a benzene ring with the carbon atoms in the formula above.

10. An electrophotographic photosensitive member according to claim 1 or 5, wherein $R_2$ is a hydrogen atom, a methyl group or a cyano group, $Ar_8$ is a benzene ring, and $A_3$ and $A_4$ are each a residual group to form a benzene ring with the carbon atoms in the formula above.

11. An electrophotographic photosensitive member according to claim 1 or 6, wherein $R_3$ is a hydrogen atom, a methyl group, an ethyl group or a cyano group, $Ar_9$ to $Ar_{11}$ are benzene rings, m is 0, n is 1, and p is 1 or 2.

12. A process cartridge comprising:

an electrophotographic photosensitive member and at least one means selected from the group consisting of a charging means, a developing means and a cleaning means;

said electrophotographic photosensitive member comprising a conductive substrate and a photosensitive layer on said conductive substrate, said photosensitive layer containing a charge transporting material and a charge generating material, said charge generating material comprising an azo pigment represented by at least one formula selected from the group consisting of formulas (1), (2), (3), (4) and (5) below:

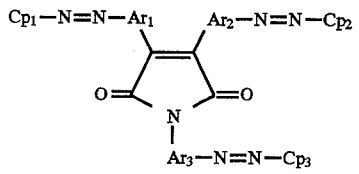

(1)

wherein $Ar_1$, $Ar_2$ and $Ar_3$ are the same or different and are each a substituted or unsubstituted aromatic hydrocarbon ring or a substituted or unsubstituted aromatic heterocyclic ring, and $Cp_1$, $Cp_2$ and $Cp_3$ are the same or different and are each a coupler residual group having a phenolic hydroxyl group:

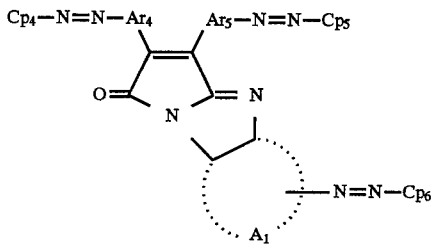

(2)

wherein $Ar_4$ and $Ar_5$ are the same or different and are each a substituted or unsubstituted aromatic hydrocarbon ring or a substituted or unsubstituted aromatic heterocyclic ring, $A_1$ is a residual group required to form a substituted or unsubstituted aromatic hydrocarbon ring or a substituted or unsubstituted aromatic heterocyclic ring with the carbon atoms in the formula above, and $Cp_4$, $Cp_5$ and $Cp_6$ are the same or different and are each a coupler residual group having a phenolic hydroxyl group:

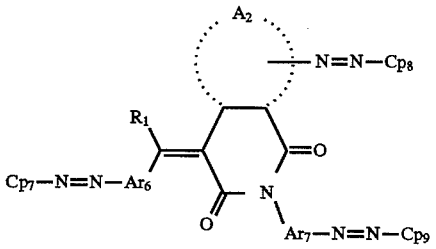

(3)

wherein $R_1$ is a hydrogen atom, a substituted or unsubstituted alkyl group or a cyano group, $Ar_6$ and $Ar_7$ are the same or different and are each a substituted or unsubstituted aromatic hydrocarbon ring or a substituted or unsubstituted aromatic heterocyclic ring, $A_2$ is a residual group required to form a substituted or unsubstituted aromatic hydrocarbon ring or a substituted or unsubstituted aromatic heterocyclic ring with the carbon atoms in the formula above, and $Cp_7$, $Cp_8$ and $Cp_9$ are the same or different and are each a coupler residual group having a phenolic hydroxyl group:

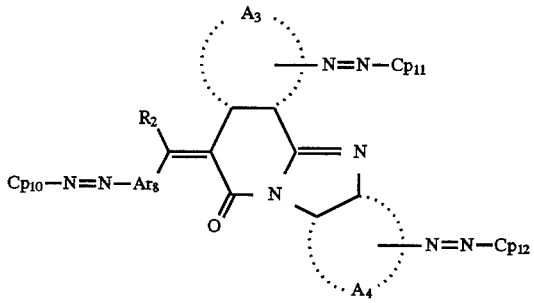

(4)

wherein $R_2$ is a hydrogen atom, a substituted or unsubstituted alkyl group or a cyano group, $Ar_8$ is the same or different and is a substituted or unsubstituted aromatic hydrocarbon ring or a substituted or unsubstituted aromatic heterocyclic ring, $A_3$ and $A_4$ are the same or different and are each a residual group required to form a substituted or unsubstituted aromatic hydrocarbon ring or a substituted or unsubstituted aromatic heterocyclic ring with the carbon atoms in the formula above, and $Cp_{10}$, $Cp_{11}$ and $Cp_{12}$ are the same or different and are each a coupler residual group having a phenolic hydroxyl group:

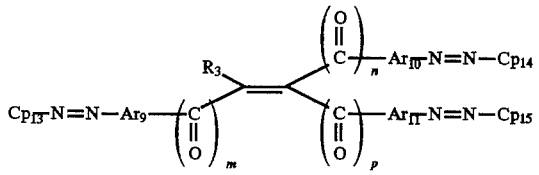

(5)

wherein $R_3$ is a hydrogen atom, a substituted or unsubstituted alkyl group or a cyano group, $Ar_9$, $Ar_{10}$ and $Ar_{11}$ are the same or different and are each a substituted or unsubstituted aromatic hydrocarbon ring or a substituted or unsubstituted aromatic heterocyclic ring, $Cp_{11}$, $Cp_{14}$ and $Cp_{15}$ are the same or different and are each a coupler residual group having a phenolic hydroxyl group, and m, n and p are the same or different and are each zero or a positive integer wherein m, n and p are not simultaneously zero.

13. A process cartridge according to claim 12, wherein said azo pigment is represented by said formula (1).

14. A process cartridge according to claim 12, wherein said azo pigment is represented by said formula (2).

15. A process cartridge according to claim 12, wherein said azo pigment is represented by said formula (3).

16. A process cartridge according to claim 12, wherein said azo pigment is represented by said formula (4).

17. A process cartridge according to claim 12, wherein said azo pigment is represented by said formula (5).

18. A process cartridge according to claim 12 or 13, wherein $Ar_1$ to $Ar_3$ are benzene rings.

19. A process cartridge according to claim 12 or 14, wherein $Ar_4$ and $Ar_5$ are benzene rings, and $A_1$ is a residual group required to form a benzene ring with the carbon atoms in the formula above.

20. A process cartridge according to claim 12 or 15, wherein $R_1$ is a hydrogen atom, a methyl group or a cyano group, $Ar_6$ is a benzene ring, $Ar_7$ is a benzene ring, a naphthalene ring or a pyridine ring, and $A_2$ is a residual group required to form a benzene ring with the carbon atoms in the formula above.

21. A process cartridge according to claim 12 or 16, wherein $R_2$ is a hydrogen atom, a methyl group or a cyano group, $Ar_8$ is a benzene ring, and $A_3$ and $A_4$ are each a residual group to form a benzene ring with the carbon atoms in the formula above.

22. A process cartridge according to claim 12 or wherein $R_3$ is a hydrogen atom, a methyl group, an ethyl group or a cyano group, $Ar_9$ to $Ar_{11}$ are benzene rings, m is 0, n is 1, and p is 1 or 2.

23. An electrophotographic apparatus comprising:

an electrophotographic photosensitive member, charging means, image exposing means, developing means, and transfer means, said electrophotographic photosensitive member comprising a conductive substrate and a photosensitive layer on said conductive substrate, said photosensitive layer containing a charge transporting material and a charge generating material, said charge generating material comprising an azo pigment represented by at least one formula selected from the group consisting of formulas (1), (2), (3), (4) and (5) below:

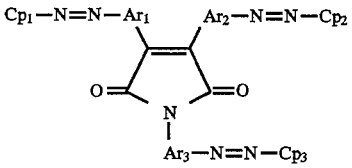

(1)

wherein $Ar_1$, $Ar_2$ and $Ar_3$ are the same or different and are each a substituted or unsubstituted aromatic hydrocarbon ring or a substituted or unsubstituted aromatic heterocyclic ring, and $Cp_1$, $Cp_2$ and $Cp_3$ are the same or different and are each a coupler residual group having a phenolic hydroxyl group:

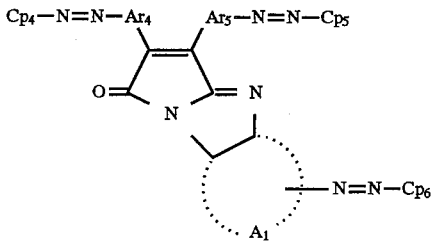

(2)

wherein $Ar_4$ and $Ar_5$ are the same or different and are each a substituted or unsubstituted aromatic hydrocarbon ring or a substituted or unsubstituted aromatic heterocyclic ring, $A_1$ is a residual group required to form a substituted or unsubstituted aromatic hydrocarbon ring or a substituted or unsubstituted aromatic heterocyclic ring with the carbon atoms in the formula above, and $Cp_4$, $Cp_5$ and $Cp_6$ are the same or different and are each a coupler residual group having a phenolic hydroxyl group:

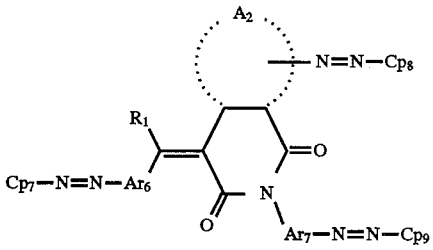

(3)

wherein $R_1$ is a hydrogen atom, a substituted or unsubstituted alkyl group or a cyano group, $Ar_6$ and $Ar_7$ are the same or different and are each a substituted or unsubstituted aromatic hydrocarbon ring or a substituted or unsubstituted aromatic heterocyclic ring, $A_2$ is a residual group required to form a substituted or unsubstituted aromatic hydrocarbon ring or a substituted or unsubstituted aromatic heterocyclic ring with the carbon atoms in the formula above, and $Cp_7$, $Cp_8$ and $Cp_9$ are the same or different and are each a coupler residual group having a phenolic hydroxyl group:

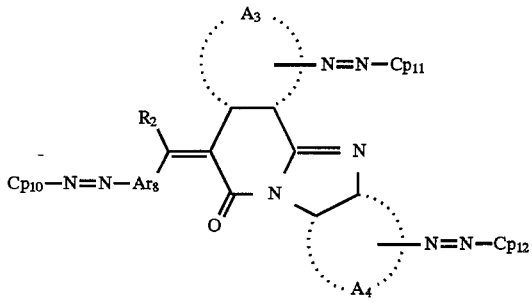

(4)

wherein $R_2$ is a hydrogen atom, a substituted or unsubstituted alkyl group or a cyano group, $Ar_8$ is the same or different and is a substituted or unsubstituted aromatic hydrocarbon ring or a substituted or unsubstituted aromatic heterocyclic ring, $A_3$ and $A_4$ are the same or different and are each a residual group required to form a substituted or unsubstituted aromatic hydrocarbon ring or a substituted or unsubstituted aromatic heterocyclic ring with the carbon atoms in the formula above, and $Cp_{10}$, $Cp_{11}$ and $Cp_{12}$ are the same or different and are each a coupler residual group having a phenolic hydroxyl group:

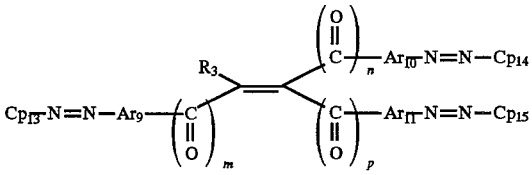

(5)

wherein $R_3$ is a hydrogen atom, a substituted or unsubstituted alkyl group or a cyano group, $Ar_9$, $Ar_{10}$ and $Ar_{11}$ are the same or different and are each a substituted or unsubstituted aromatic hydrocarbon ring or a substituted or unsubstituted aromatic heterocyclic ring, $Cp_{13}$, $Cp_{14}$ and $Cp_{15}$ are the same or different and are each a coupler residual group having a phenolic hydroxyl group, and m, n and p are the same or different and are each zero or a positive integer wherein m, n and p are not simultaneously zero.

24. An electrophotographic apparatus according to claim 23, wherein said azo pigment is represented by said formula (1).

25. An electrophotographic apparatus according to claim 23, wherein said azo pigment is represented by said formula (2).

26. An electrophotographic apparatus according to claim 3, wherein said azo pigment is represented by said formula (3).

27. An electrophotographic apparatus according to claim 23, wherein said azo pigment is represented by said formula (4).

28. An electrophotographic apparatus according to claim 23, wherein said azo pigment is represented by said formula (5).

29. An electrophotographic apparatus according to claim 23 or 24, wherein $Ar_1$ to $Ar_3$ are benzene rings.

30. An electrophotographic apparatus according to claim 23 or 25, wherein $Ar_4$ and $Ar_5$ are benzene rings, and $A_1$ is a residual group required to form a benzene ring with the carbon atoms in the formula above.

31. An electrophotographic apparatus according to claim 23 or 26, wherein $R_1$ is a hydrogen atom, a methyl group or a cyano group, $Ar_6$ is a benzene ring, $Ar_7$ is a benzene ring, a naphthalene ring or a pyridine ring, and $A_2$ is a residual group required to form a benzene ring with the carbon atoms in the formula above.

32. An electrophotographic apparatus according to claim 23 or 27, wherein $R_2$ is a hydrogen atom, a methyl group or a cyano group, $Ar_8$ is a benzene ring, and $A_3$ and $A_4$ are each a residual group to form a benzene ring with the carbon atoms in the formula above.

33. An electrophotographic apparatus according to claim 23 or 28, wherein $R_3$ is a hydrogen atom, a methyl group, an ethyl group or a cyano group, $Ar_9$ to $Ar_{11}$ are benzene rings, m is 0, n is 1, and p is 1 or 2.

34. An electrophotographic photosensitive member comprising a conductive substrate and a photosensitive layer on said conductive substrate, said photosensitive layer comprising a charge transport layer and a charge generation layer, said charge generation layer comprising an azo pigment represented by at least one formula selected from the group consisting of formulas (1), (2), (3), (4) and (5) below:

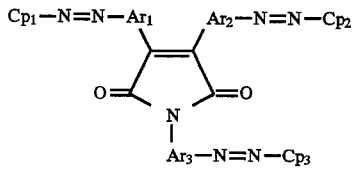

(1)

wherein $Ar_1$, $Ar_2$ and $Ar_3$ are the same or different and are each a substituted or unsubstituted aromatic hydrocarbon ring or a substituted or unsubstituted aromatic heterocyclic ring, and $Cp_1$, $Cp_2$ and $Cp_3$ are the same or different and are each a coupler residual group having a phenolic hydroxyl group:

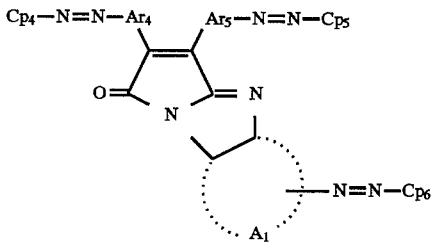

(2)

wherein $Ar_4$ and $Ar_5$ are the same or different and are each a substituted or unsubstituted aromatic hydrocarbon ring or a substituted or unsubstituted aromatic heterocyclic ring, $A_1$ is a residual group required to form a substituted or unsubstituted aromatic hydrocarbon ring or a substituted or unsubstituted aromatic heterocyclic ring with the carbon atoms in the formula above, and $Cp_4$, $Cp_5$ and $Cp_6$ are the same or different and are each a coupler residual group having a phenolic hydroxyl group:

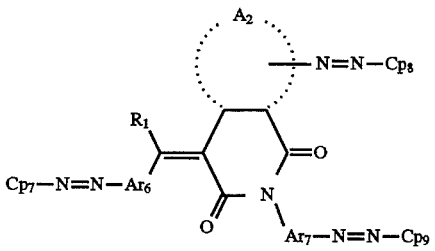

(3)

wherein $R_1$ is a hydrogen atom, a substituted or unsubstituted alkyl group or a cyano group, $Ar_6$ and $Ar_7$ are the same or different and are each a substituted or unsubstituted aromatic hydrocarbon ring or a substituted or unsubstituted aromatic heterocyclic ring, $A_2$ is a residual group required to form a substituted or unsubstituted aromatic hydrocarbon ring or a substituted or unsubstituted aromatic heterocyclic ring with the carbon atoms in the formula above, and $Cp_7$, $Cp_8$ and $Cp_9$ are the same or different and are each a coupler residual group having a phenolic hydroxyl group:

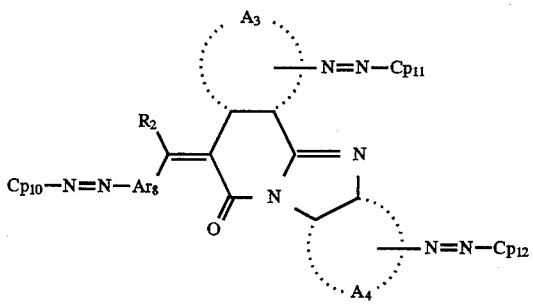

(4)

wherein $R_2$ is a hydrogen atom, a substituted or unsubstituted alkyl group or a cyano group, $Ar_8$ is the same or different and is a substituted or unsubstituted aromatic hydrocarbon ring or a substituted or unsubstituted aromatic heterocyclic ring, $A_3$ and $A_4$ are the same or different and are each a residual group required to form a substituted or unsubstituted aromatic hydrocarbon ring or a substituted or unsubstituted aromatic heterocyclic ring with the carbon atoms in the formula above, and $Cp_{10}$, $Cp_{11}$ and $Cp_{12}$ are the same or different and are each a coupler residual group having a phenolic hydroxyl group:

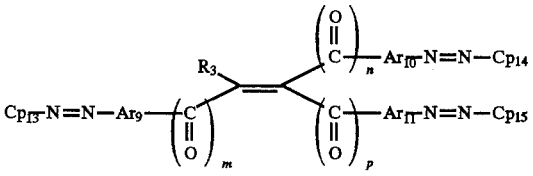

(5)

wherein $R_3$ is a hydrogen atom, a substituted or unsubstituted alkyl group or a cyano group, $Ar_9$, $Ar_{10}$ and $Ar_{11}$ are the same or different and are each a substituted or unsubstituted aromatic hydrocarbon ring or a substituted or unsubstituted aromatic heterocyclic ring, $Cp_{13}$, $Cp_{14}$ and $Cp_{15}$ are the same or different and are each a coupler residual group having a phenolic hydroxyl group, and m, n and p are the same or different and are each zero or a positive integer wherein m, n and p are not simultaneously zero.

35. A process cartridge comprising:

an electrophotographic photosensitive member and at least one means selected from the group consisting of a charging means, a developing means and a cleaning means;

said electrophotographic photosensitive member comprising a conductive substrate and a photosensitive layer on said conductive substrate, said photosensitive layer comprising a charge transport layer and a charge generation layer, said charge generation layer comprising an azo pigment represented by at least one formula selected from the group consisting of formulas (1), (2), (3), (4) and (5) below:

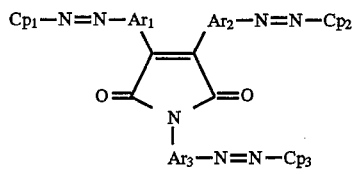

(1)

wherein $Ar_1$, $Ar_2$ and $Ar_3$ are the same or different and are each a substituted or unsubstituted aromatic hydrocarbon ring or a substituted or unsubstituted aromatic heterocyclic ring, and $Cp_1$, $Cp_2$ and $Cp_3$ are the same or different and are each a coupler residual group having a phenolic hydroxyl group:

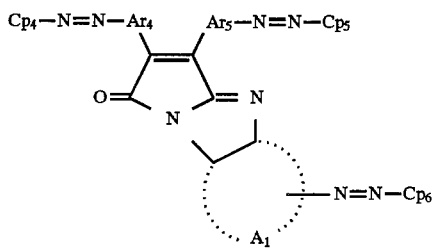

(2)

wherein $Ar_4$ and $Ar_5$ are the same or different and are each a substituted or unsubstituted aromatic hydrocarbon ring or a substituted or unsubstituted aromatic heterocyclic ring, $A_1$ is a residual group required to form a substituted or unsubstituted aromatic hydrocarbon ring or a substituted or unsubstituted aromatic heterocyclic ring with the carbon atoms in the formula above, and $Cp_4$, $Cp_5$ and $Cp_6$ are the same or different and are each a coupler residual group having a phenolic hydroxyl group:

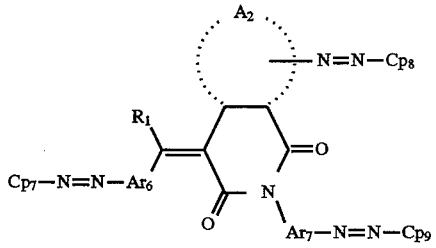

(3)

wherein $R_1$ is a hydrogen atom, a substituted or unsubstituted alkyl group or a cyano group, $Ar_6$ and $Ar_7$ are the same or different and are each a substituted or unsubstituted aromatic hydrocarbon ring or a substituted or unsubstituted aromatic heterocyclic ring, $A_2$ is a residual group required to form a substituted or unsubstituted aromatic hydrocarbon ring or a substituted or unsubstituted aromatic heterocyclic ring with the carbon atoms in the formula above, and $Cp_7$, $Cp_8$ and $Cp_9$ are the same or different and are each a coupler residual group having a phenolic hydroxyl group:

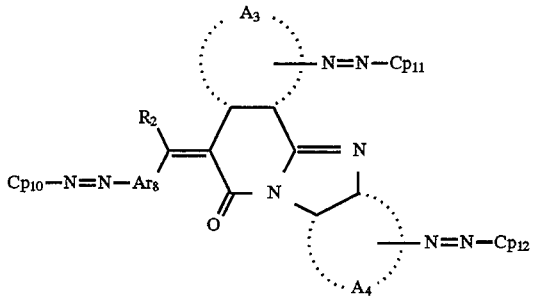

(4)

wherein $R_2$ is a hydrogen atom, a substituted or unsubstituted alkyl group or a cyano group, $Ar_8$ is the same or different and is a substituted or unsubstituted aromatic hydrocarbon ring or a substituted or unsubstituted aromatic heterocyclic ring, $A_3$ and $A_4$ are the same or different and are each a residual group required to form a substituted or unsubstituted aromatic hydrocarbon ring or a substituted or unsubstituted aromatic heterocyclic ring with the carbon atoms in the formula above, and $Cp_{10}$, $Cp_{11}$ and $Cp_{12}$ are the same or different and are each a coupler residual group having a phenolic hydroxyl group:

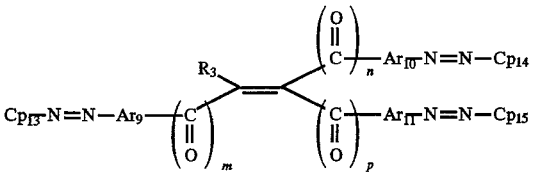

(5)

wherein $R_3$ is a hydrogen atom, a substituted or unsubstituted alkyl group or a cyano group, $Ar_9$, $Ar_{10}$ and $Ar_{11}$ are the same or different and are each a substituted or unsubstituted aromatic hydrocarbon ring or a substituted or unsubstituted aromatic heterocyclic ring, $Cp_{13}$, $Cp_{14}$ and $Cp_{15}$ are the same or different and are each a coupler residual group having a phenolic hydroxyl group, and m, n and p are the same or different and are each zero or a positive integer wherein m, n and p are not simultaneously zero.

36. An electrophotographic apparatus comprising:

an electrophotographic photosensitive member, charging means, image exposing means, developing means, and transfer means, said electrophotographic photosensitive member comprising a conductive substrate and a photosensitive layer on said conductive substrate, said photosensitive layer comprising a charge transport layer and a charge generation layer, said charge generation layer comprising an azo pigment represented by at least one formula selected from the group consisting of formulas (1), (2), (3), (4) and (5) below:

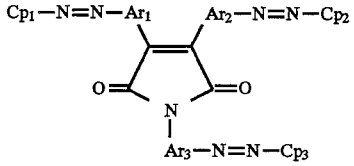

(1)

wherein $Ar_1$, $Ar_2$ and $Ar_3$ are the same or different and are each a substituted or unsubstituted aromatic hydrocarbon ring or a substituted or unsubstituted aromatic heterocyclic ring, and $Cp_1$, $Cp_2$ and $Cp_3$ are the same or different and are each a coupler residual group having a phenolic hydroxyl group:

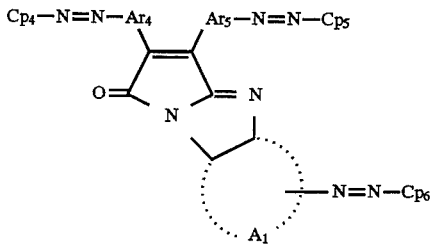

(2)

wherein $Ar_4$ and $Ar_5$ are the same or different and are each a substituted or unsubstituted aromatic hydrocarbon ring or a substituted or unsubstituted aromatic heterocyclic ring, $A_1$ is a residual group required to form a substituted or unsubstituted aromatic hydrocarbon ring or a substituted or unsubstituted aromatic heterocyclic ring with the carbon atoms in the formula above, and $Cp_4$, $Cp_5$ and $Cp_6$ are the same or different and are each a coupler residual group having a phenolic hydroxyl group:

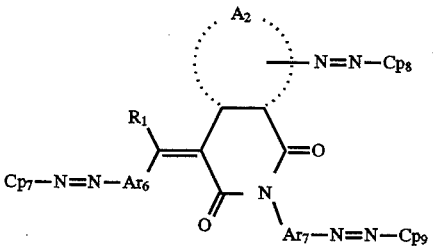

(3)

wherein $R_1$ is a hydrogen atom, a substituted or unsubstituted alkyl group or a cyano group, $Ar_6$ and $Ar_7$ are the same or different and are each a substituted or unsubstituted aromatic hydrocarbon ring or a substituted or unsubstituted aromatic heterocyclic ring, $A_2$ is a residual group required to form a substituted or unsubstituted aromatic hydrocarbon ring or a substituted or unsubstituted aromatic heterocyclic ring with the carbon atoms in the formula above, and $Cp_7$, $Cp_8$ and $Cp_9$ are the same or different and are each a coupler residual group having a phenolic hydroxyl group:

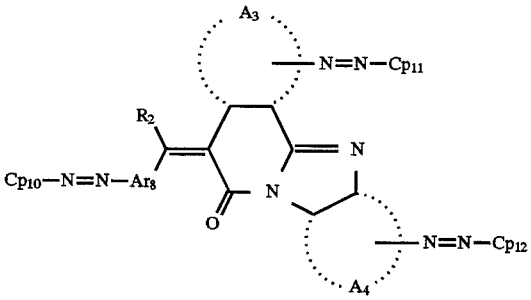

(4)

wherein $R_2$ is a hydrogen atom, a substituted or unsubstituted alkyl group or a cyano group, $Ar_8$ is the same or different and is a substituted or unsubstituted aromatic hydrocarbon ring or a substituted or unsubstituted aromatic heterocyclic ring, $A_3$ and $A_4$ are the same or different and are each a residual group required to form a substituted or unsubstituted aromatic hydrocarbon ring or a substituted or unsubstituted aromatic heterocyclic ring with the carbon atoms in the formula above, and $Cp_{10}$, $Cp_{11}$ and $Cp_{12}$ are the same or different and are each a coupler residual group having a phenolic hydroxyl group:

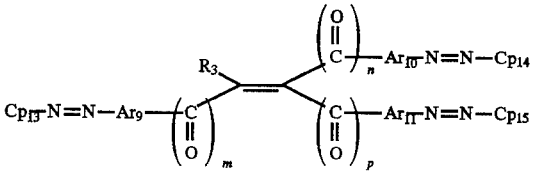

(5)

wherein $R_3$ is a hydrogen atom, a substituted or unsubstituted alkyl group or a cyano group, $Ar_9$, $Ar_{10}$ and $Ar_{11}$ are the same or different and are each a substituted or unsubstituted aromatic hydrocarbon ring or a substituted or unsubstituted aromatic heterocyclic ring, $Cp_{13}$, $Cp_{14}$ and $Cp_{15}$ are the same or different and are each a coupler residual group having a phenolic hydroxyl group, and m, n and p are the same or different and are each zero or a positive integer wherein m, n and p are not simultaneously zero.

37. An electrophotographic photosensitive member comprising a conductive substrate and a photosensitive layer on said conductive substrate, said photosensitive layer comprising at least one layer, said one layer containing a charge transport material and a charge generating material, said charge generating material comprising an azo pigment represented by at least one formula selected from the group consisting of formulas (1), (2), (3), (4) and (5) below:

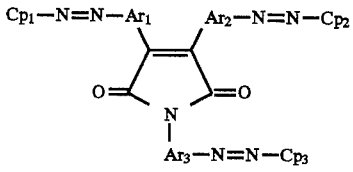

(1)

wherein $Ar_1$, $Ar_2$ and $Ar_3$ are the same or different and are each a substituted or unsubstituted aromatic hydrocarbon ring or a substituted or unsubstituted aromatic heterocyclic ring, and $Cp_1$, $Cp_2$ and $Cp_3$ are the same or different and are each a coupler residual group having a phenolic hydroxyl group:

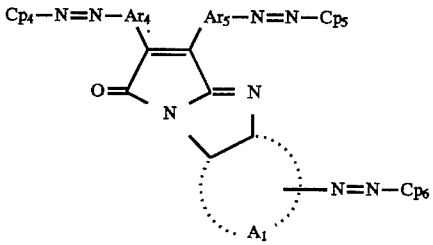

(2)

wherein $Ar_4$ and $Ar_5$ are the same or different and are each a substituted or unsubstituted aromatic hydrocarbon ring or a substituted or unsubstituted aromatic heterocyclic ring, $A_1$ is a residual group required to form a substituted or unsubstituted aromatic hydrocarbon ring or a substituted or unsubstituted aromatic heterocyclic ring with the carbon atoms in the formula above, and $Cp_4$, $Cp_5$ and $Cp_6$ are the same or different and are each a coupler residual group having a phenolic hydroxyl group:

(3)

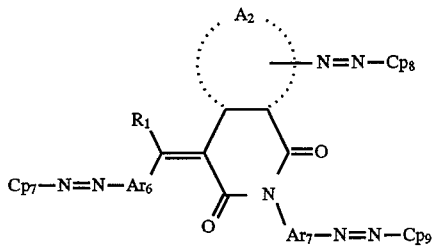

wherein $R_1$ is a hydrogen atom, a substituted or unsubstituted alkyl group or a cyano group, $Ar_6$ and $Ar_7$ are the same or different and are each a substituted or unsubstituted aromatic hydrocarbon ring or a substituted or unsubstituted aromatic heterocyclic ring, $A_2$ is a residual group required to form a substituted or unsubstituted aromatic hydrocarbon ring or a substituted or unsubstituted aromatic heterocyclic ring with the carbon atoms in the formula above, and $Cp_7$, $Cp_8$ and $Cp_9$ are the same or different and are each a coupler residual group having a phenolic hydroxyl group:

(4)

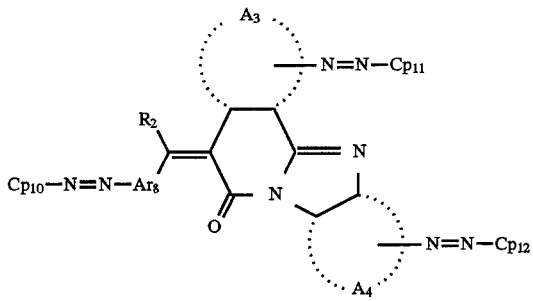

wherein $R_2$ is a hydrogen atom, a substituted or unsubstituted alkyl group or a cyano group, $Ar_8$ is the same or different and is a substituted or unsubstituted aromatic hydrocarbon ring or a substituted or unsubstituted aromatic heterocyclic ring, $A_3$ and $A_4$ are the same or different and are each a residual group required to form a substituted or unsubstituted aromatic hydrocarbon ring or a substituted or unsubstituted aromatic heterocyclic ring with the carbon atoms in the formula above, and $Cp_{10}$, $Cp_{11}$ and $Cp_{12}$ are the same or different and are each a coupler residual group having a phenolic hydroxyl group:

(5)

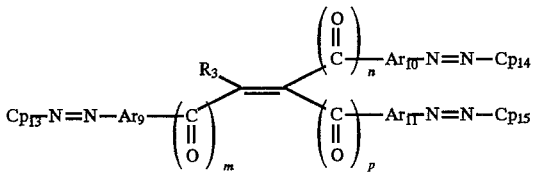

wherein $R_3$ is a hydrogen atom, a substituted or unsubstituted alkyl group or a cyano group, $Ar_9$, $Ar_{10}$ and $Ar_{11}$ are the same or different and are each a substituted or unsubstituted aromatic hydrocarbon ring or a substituted or unsubstituted aromatic heterocyclic ring, $Cp_{13}$, $Cp_{14}$ and $Cp_{15}$ are the same or different and are each a coupler residual group having a phenolic hydroxyl group, and m, n and p are the same or different and are each zero or a positive integer wherein m, n and p are not simultaneously zero.

38. A process cartridge comprising:

an electrophotographic photosensitive member and at least one means selected from the group consisting of a charging means, a developing means and a cleaning means;

said electrophotographic photosensitive member comprising a conductive substrate and a photosensitive layer on said conductive substrate, said photosensitive layer comprising at least one layer, said one layer containing a charge transport material and a charge generating material, said charge generating material comprising an azo pigment represented by at least one formula selected from the group consisting of formulas (1), (2), (3), (4) and (5) below:

(1)

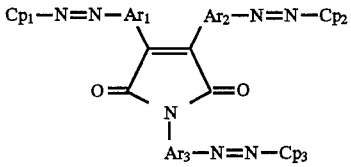

wherein $Ar_1$, $Ar_2$ and $Ar_3$ are the same or different and are each a substituted or unsubstituted aromatic hydrocarbon ring or a substituted or unsubstituted aromatic heterocyclic ring, and $Cp_1$, $Cp_2$ and $Cp_3$ are the same or different and are each a coupler residual group having a phenolic hydroxyl group:

(2)

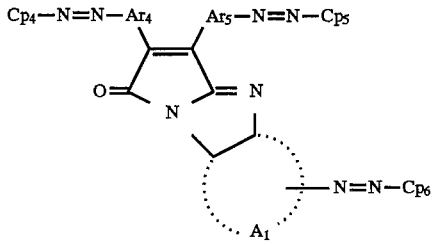

wherein $Ar_4$ and $Ar_5$ are the same or different and are each a substituted or unsubstituted aromatic hydrocarbon ring or a substituted or unsubstituted aromatic heterocyclic ring, $A_1$ is a residual group required to form a substituted or unsubstituted aromatic hydrocarbon ring or a substituted or unsubstituted aromatic heterocyclic ring with the carbon atoms in the formula above, and $Cp_4$, $Cp_5$ and $Cp_6$ are the same or different and are each a coupler residual group having a phenolic hydroxyl group:

(3)

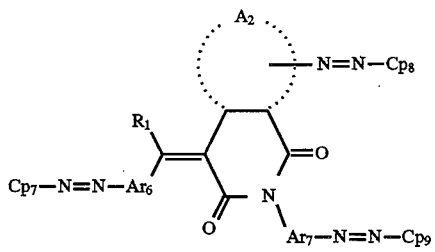

wherein $R_1$ is a hydrogen atom, a substituted or unsubstituted alkyl group or a cyano group, $Ar_6$ and $Ar_7$ are the same or different and are each a substituted or unsubstituted aromatic hydrocarbon ring or a substituted or unsubstituted aromatic heterocyclic ring, $A_2$ is a residual group required to form a substituted or unsubstituted aromatic hydrocarbon ring or a substituted or unsubstituted aromatic heterocyclic ring with the carbon atoms in the formula above, and $Cp_7$, $Cp_8$ and $Cp_9$ are the same or different and are each a coupler residual group having a phenolic hydroxyl group:

(4)

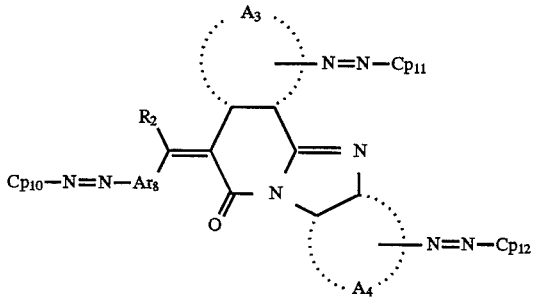

wherein $R_2$ is a hydrogen atom, a substituted or unsubstituted alkyl group or a cyano group, $Ar_8$ is the same or different and is a substituted or unsubstituted aromatic hydrocarbon ring or a substituted or unsubstituted aromatic heterocyclic ring, $A_3$ and $A_4$ are the same or different and are each a residual group required to form a substituted or unsubstituted aromatic hydrocarbon ring or a substituted or unsubstituted aromatic heterocyclic ring with the carbon atoms in the formula above, and $Cp_{10}$, $Cp_{11}$ and $Cp_{12}$ are the same or different and are each a coupler residual group having a phenolic hydroxyl group:

(5)

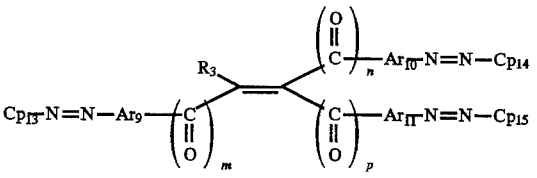

wherein $R_3$ is a hydrogen atom, a substituted or unsubstituted alkyl group or a cyano group, $Ar_9$, $Ar_{10}$ and $Ar_{11}$ are the same or different and are each a substituted or unsubstituted aromatic hydrocarbon ring or a substituted or unsubstituted aromatic heterocyclic ring, $Cp_{13}$, $Cp_{14}$ and $Cp_{15}$ are the same or different and are each a coupler residual group having a phenolic hydroxyl group, and m, n and p are the same or different and are each zero or a positive integer wherein m, n and p are not simultaneously zero.

39. An electrophotographic apparatus comprising:

an electrophotographic photosensitive member, charging means, image exposing means, developing means, and transfer means, said electrophotographic photosensitive member comprising a conductive substrate and a photosensitive layer on said conductive substrate, said photosensitive layer comprising at least one layer, said one layer containing a charge transport material and a charge generating material, said charge generating material comprising an azo pigment represented by at least one formula selected from the group consisting of formulas (1), (2), (3), (4) and (5) below:

(1)

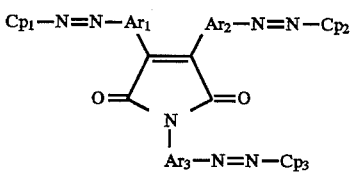

wherein $Ar_1$, $Ar_2$ and $Ar_3$ are the same or different and are each a substituted or unsubstituted aromatic hydrocarbon ring or a substituted or unsubstituted aromatic heterocyclic ring, and $Cp_1$, $Cp_2$ and $Cp_3$ are the same or different and are each a coupler residual group having a phenolic hydroxyl group:

(2)

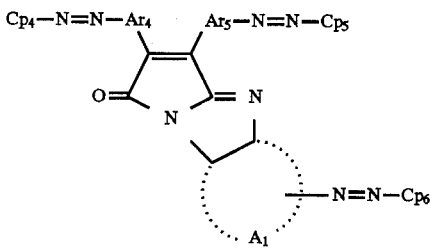

wherein $Ar_4$ and $Ar_5$ are the same or different and are each a substituted or unsubstituted aromatic hydrocarbon ring or a substituted or unsubstituted aromatic heterocyclic ring, $A_1$ is a residual group required to form a substituted or unsubstituted aromatic hydrocarbon ring or a substituted or unsubstituted aromatic heterocyclic ring with the carbon atoms in the formula above, and $Cp_4$, $Cp_5$ and $Cp_6$ are the same or different and are each a coupler residual group having a phenolic hydroxyl group:

(3)

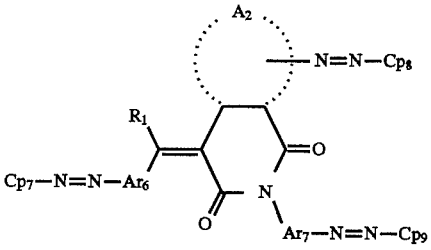

wherein $R_1$ is a hydrogen atom, a substituted or unsubstituted alkyl group or a cyano group, $Ar_6$ and $Ar_7$ are the same or different and are each a substituted or unsubstituted aromatic hydrocarbon ring or a substituted or unsubstituted aromatic heterocyclic ring, $A_2$ is a residual group required to form a substituted or unsubstituted aromatic hydrocarbon ring or a substituted or unsubstituted aromatic heterocyclic ring with the carbon atoms in the formula above, and $Cp_7$, $Cp_8$ and $Cp_9$ are the same or different and are each a coupler residual group having a phenolic hydroxyl group:

(4)

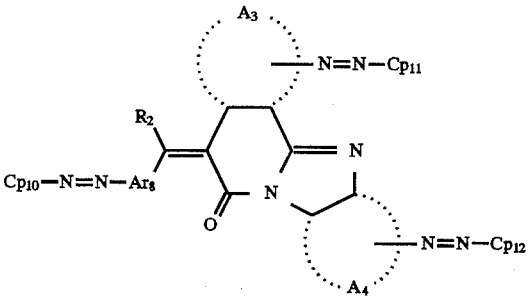

wherein $R_2$ is a hydrogen atom, a substituted or unsubstituted alkyl group or a cyano group, $Ar_8$ is the same or different and is a substituted or unsubstituted aromatic hydrocarbon ring or a substituted or unsubstituted aromatic heterocyclic ring, $A_3$ and $A_4$ are the same or different and are each a residual group required to form a substituted or unsubstituted aromatic hydrocarbon ring or a substituted or unsubstituted aromatic heterocyclic ring with the carbon atoms in the formula above, and $Cp_{10}$, $Cp_{11}$ and $Cp_{12}$ are the same or different and are each a coupler residual group having a phenolic hydroxyl group:

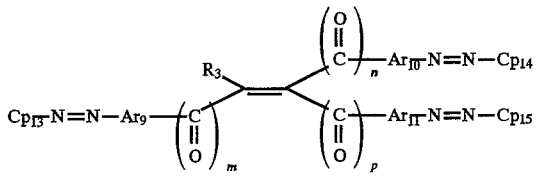

(5)

wherein $R_3$ is a hydrogen atom, a substituted or unsubstituted alkyl group or a cyano group, $Ar_9$, $Ar_{10}$ and $Ar_{11}$ are the same or different and are each a substituted or unsubstituted aromatic hydrocarbon ring or a substituted or unsubstituted aromatic heterocyclic ring, $Cp_{13}$, $Cp_{14}$ and $Cp_{15}$, are the same or different and are each a coupler residual group having a phenolic hydroxyl group, and m, n and p are the same or different and are each zero or a positive integer wherein m, n and p are not simultaneously zero.

* * * * *

UNITED STATES PATENT AND TRADEMARK OFFICE

CERTIFICATE OF CORRECTION

PATENT NO. : 5,629,116

DATED : May 13, 1997

INVENTOR(S) : YOSHIO KASHIZAKI ET AL.

It is certified that error appears in the above-identified patent and that said Letters Patent is hereby corrected as shown below:

COLUMN 1

Line 25, "has" should read --have--.

COLUMN 8

Line 19, "carbarnoyl;" should read --carbamoyl;--.

COLUMN 36

Pig. Ex. 36, 3-15, "$R_1$:-$CH_{3,Ar6}$:" should read --$R_1$:-$CH_3$,$Ar_6$:--.

COLUMN 55

Pig. Ex. 5-12, "m:0, n and p: 2" should read --m:0, n:1, p:2--.

COLUMN 61

Pig. Ex. 5-26

"

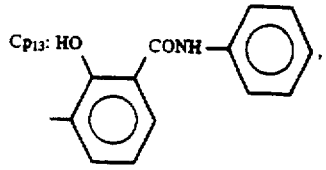

should read

"

--

Cp13:

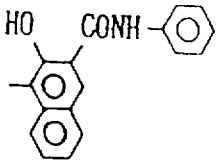

--.

UNITED STATES PATENT AND TRADEMARK OFFICE

CERTIFICATE OF CORRECTION

PATENT NO. : 5,629,116

DATED : May 13, 1997

INVENTOR(S) : YOSHIO KASHIZAKI ET AL.

It is certified that error appears in the above-identified patent and that said Letters Patent is hereby corrected as shown below:

COLUMN 62

Pig. Ex. 5-30, "m:0, n and p: 2" should read --m:0, n:1, p:2--.

COLUMN 63

Pig. Ex. 5-31, "m:0, n and p: 0" should read --m and n:1, p: 0--.

COLUMN 71

Line 55, "on to" should read --onto--.

COLUMN 74

Line 2, Insert: --TABLE 1--.

COLUMN 77

Line 43, "TABLE 2" should be deleted.

Line 59,

"Comparative Example Comparative Pigment Example VO (-V) $E_{1/2}$ (lux · sec)"

should read

--Table 2

| Comparative Example | Comparative Pigment Example | VO (-V) | $E_{1/2}$ (lux · sec) |
|---|---|---|---|

UNITED STATES PATENT AND TRADEMARK OFFICE

CERTIFICATE OF CORRECTION

PATENT NO. : 5,629,116

DATED : May 13, 1997

INVENTOR(S) : YOSHIO KASHIZAKI ET AL.

It is certified that error appears in the above-identified patent and that said Letters Patent is hereby corrected as shown below:

COLUMN 79

Line 1, "The" should read --EXAMPLE 46 ¶ The--.

COLUMN 81

Line 45, "EXAMPLE" should read --EXAMPLES--.

COLUMN 82

Line 42, "claims:" should read --claims.--.

COLUMN 84

Line 37, "Am" should read --A,--.

COLUMN 86

Line 36, "$Cp_{11}$," should read --$Cp_{13}$,--.

COLUMN 87

Line 4, "claim 12 or" should read --claim 12 or 17,--.

UNITED STATES PATENT AND TRADEMARK OFFICE

CERTIFICATE OF CORRECTION

PATENT NO. : 5,629,116

DATED : May 13, 1997

INVENTOR(S) : YOSHIO KASHIZAKI ET AL.

It is certified that error appears in the above-identified patent and that said Letters Patent is hereby corrected as shown below:

COLUMN 88

Line 54, "3," should read --23,--.

Signed and Sealed this

Eighteenth Day of November 1997

*Attest:*

*Attesting Officer*

BRUCE LEHMAN

*Commissioner of Patents and Trademarks*